US011143196B2

(12) United States Patent
Kennedy et al.

(10) Patent No.: US 11,143,196 B2
(45) Date of Patent: Oct. 12, 2021

(54) FAN SYSTEM

(71) Applicant: Air Distribution Technologies IP, LLC, Milwaukee, WI (US)

(72) Inventors: Juan Kennedy, Plano, TX (US); Luis L. Vargas, Plano, TX (US); Saurabh S. Apte, Dallas, TX (US); Anup T. Kole, District Sangli (IN); Hongdan Wang, Wuxi (CN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 134 days.

(21) Appl. No.: 16/520,079

(22) Filed: Jul. 23, 2019

(65) Prior Publication Data

US 2020/0173453 A1 Jun. 4, 2020

Related U.S. Application Data

(60) Provisional application No. 62/774,665, filed on Dec. 3, 2018.

(51) Int. Cl.
*F04D 29/28* (2006.01)
*F04D 17/16* (2006.01)
(Continued)

(52) U.S. Cl.
CPC ..... *F04D 29/281* (2013.01); *F04D 17/165* (2013.01); *F04D 25/08* (2013.01); *F04D 29/4253* (2013.01); *F05D 2250/38* (2013.01)

(58) Field of Classification Search
CPC .. F04D 17/165; F04D 29/4253; F04D 29/281; F04D 29/4226
See application file for complete search history.

(56) References Cited

U.S. PATENT DOCUMENTS 1,787,655 A * 1/1931 Anderson ..... F04D 27/009 415/58.3
2,889,107 A * 6/1959 Stalker ..... F04D 29/284 416/194
(Continued)

FOREIGN PATENT DOCUMENTS

CN 103321923 A * 9/2013
CN 108252949 A * 7/2018
(Continued)

OTHER PUBLICATIONS

Greenheck. "Mixed Flow Fans: Models QEI and QEID" Apr. 2010 (Year: 2010).*

*Primary Examiner* — Igor Kershteyn
*Assistant Examiner* — Topaz L. Elliott
(74) *Attorney, Agent, or Firm* — Fletcher Yoder P.C.

(57) ABSTRACT

Embodiments of the present disclosure are directed to an inline centrifugal mixed flow fan system that includes a wheel assembly disposed within an outer housing and comprising a hub cone, a plurality of fan blades directly coupled to and extending radially outward from the hub cone, and a shroud directly coupled to and at least partially radially surrounding the plurality of fan blades. The wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis.

32 Claims, 13 Drawing Sheets

(51) Int. Cl.
*F04D 25/08* (2006.01)
*F04D 29/42* (2006.01)

(56) References Cited

U.S. PATENT DOCUMENTS

| | | | | | |
|---|---|---|---|---|---|
| 3,584,968 | A | | 6/1971 | Keith | |
| 4,211,514 | A | * | 7/1980 | Hawes | F04D 17/16 415/142 |
| 4,411,453 | A | * | 10/1983 | Philipps | F04D 29/4213 285/18 |
| 5,810,557 | A | * | 9/1998 | Akinkuotu | F04D 29/281 415/206 |
| 6,082,969 | A | * | 7/2000 | Carroll | F04D 29/326 416/169 A |
| 7,048,499 | B2 | | 5/2006 | Mathson et al. | |
| 8,052,386 | B1 | | 11/2011 | Fitzpatrick et al. | |
| 8,672,614 | B1 | | 3/2014 | Fitzpatrick | |
| 8,932,013 | B2 | | 1/2015 | Khalitov et al. | |
| 9,505,092 | B2 | | 11/2016 | Brownell et al. | |
| 9,636,722 | B2 | | 5/2017 | Enzenroth et al. | |
| 2010/0329871 | A1 | * | 12/2010 | Cahill | F04D 29/281 416/187 |
| 2016/0342730 | A1 | * | 11/2016 | Choi | G06F 17/11 |

FOREIGN PATENT DOCUMENTS

| | | | | | |
|---|---|---|---|---|---|
| GB | 849744 | A | * | 9/1960 | F04D 17/165 |
| KR | 970005255 | B1 | * | 4/1997 | |
| WO | WO-9819070 | A1 | * | 5/1998 | F04D 17/06 |

* cited by examiner

FAN SYSTEM

CROSS REFERENCE TO RELATED APPLICATION

This application claims priority from and the benefit of U.S. Provisional Application Ser. No. 62/774,665, entitled "FAN SYSTEM," filed Dec. 3, 2018, which is hereby incorporated by reference in its entirety for all purposes.

BACKGROUND

The present disclosure relates generally to air handling systems, such as heating, ventilation, and/or air conditioning (HVAC) systems, and specifically relates to an inline centrifugal mixed flow fan system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Conventional centrifugal fans are generally used to intake air parallel to a central longitudinal axis of the fan, and to accelerate the air radially outward from the central longitudinal axis. As such, conventional centrifugal fans often include a scroll-type housing to direct the radial air flow into a specific direction that is generally transverse to the central longitudinal axis. In contrast, conventional axial fans are generally used to intake air parallel to a central longitudinal axis of the fan, and to accelerate the air axially along the central longitudinal axis. As such, conventional axial fans often include a box-type housing having a relatively constant cross-sectional area along the central longitudinal axis. In general, each of these types of fans include certain advantages as well as certain drawbacks. Accordingly, it has been recognized that combining certain features of centrifugal and axial fans may prove beneficial.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, an inline centrifugal mixed flow fan system includes a wheel assembly disposed within an outer housing and comprising a hub cone, a plurality of fan blades directly coupled to and extending radially outward from the hub cone, and a shroud directly coupled to and at least partially radially surrounding the plurality of fan blades. The wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis. A ratio of an axial length of the hub cone relative to an outer diameter of the hub cone is within a range of approximately 0.31 to approximately 0.44.

In other embodiments, an inline centrifugal mixed flow fan system includes a wheel assembly disposed within an outer housing and comprising a hub cone, a plurality of fan blades directly coupled to and extending radially outward from the hub cone, and a shroud directly coupled to and at least partially radially surrounding the plurality of fan blades. The wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis. A ratio of an axial length of the shroud relative to an outer diameter of the shroud is within a range of approximately 0.16 to approximately 0.30.

DRAWINGS

Various aspects of this disclosure may be better understood upon reading the following detailed description and upon reference to the drawings in which.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As used herein, the terms "approximately", "generally", and "substantially", and so forth, are intended to mean that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−1%, within +/−1%, or even closer, the given value. Similarly, when a given feature is described as being "substantially parallel" to another feature, "generally perpendicular" to another feature, and so forth, this is intended to mean that the given feature is within +/−5%, within +/−4%, within +/−3%, within +/−1%, within +/−1%, or even closer, to having the described nature, such as being parallel to another feature, being perpendicular to another feature, and so forth. Mathematical terms, such as parallel and perpendicular, should not be rigidly interpreted in a mathematical sense, but as one of ordinary skill in the art would interpret such terms. For example, one of ordinary skill in the art would understand that two lines that are substantially parallel to each other are parallel to a substantial degree, with only minor deviation from parallel.

The present disclosure is directed to an inline centrifugal mixed flow fan system that utilizes a highly efficient mixed flow fan wheel assembly suitable for supply, exhaust, and/or return air applications. The relatively compact and lightweight design of the inline centrifugal mixed flow fan system described herein combines the relatively higher volume advantage of axial fan systems with the relatively lower sound and relatively higher efficiency of centrifugal fan systems. Through this versatility, the inline centrifugal mixed flow fan system described herein surpasses the efficiency of conventional centrifugal fan systems and axial fan systems.

Figure 1:
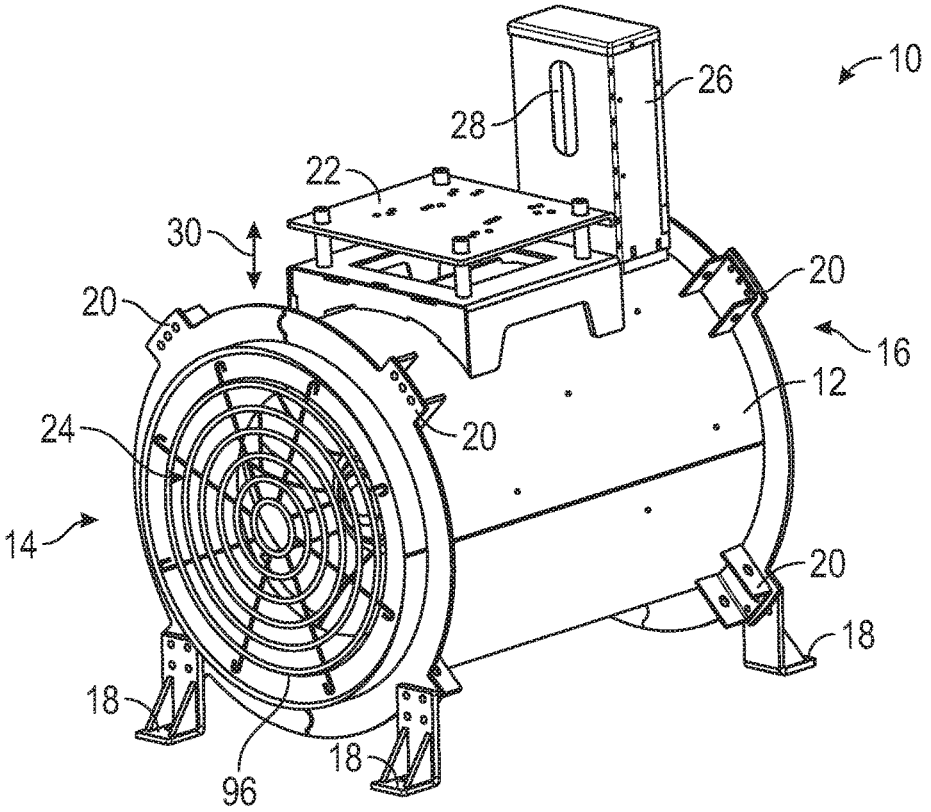
FIG. 1 is a front perspective view of an inline centrifugal mixed flow fan system, in accordance with an aspect of the present disclosure.
Figure 2:
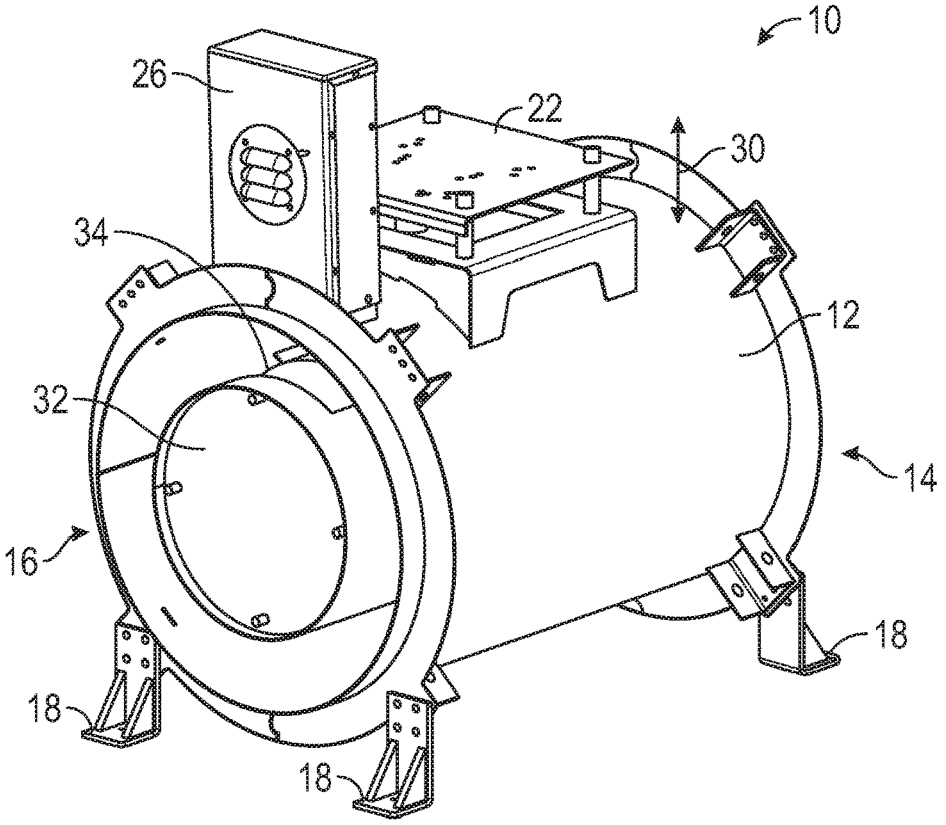
FIG. 2 is a rear perspective views of an inline centrifugal mixed flow fan system, in accordance with an aspect of the present disclosure.

Turning now to the drawings, FIGS. 1 and 2 are front and rear perspective views of an inline centrifugal mixed flow fan system 10, in accordance with an aspect of the present disclosure. As illustrated, in certain embodiments, the fan system 10 includes a generally cylindrically-shaped outer housing 12 having an inlet end 14 that intakes air from the surrounding environment, and a discharge end 16 that discharges air back into the surrounding environment. As used herein, the terms "inlet end", "inlet side", "upstream end", "upstream side", "axially upstream end", "axially upstream side", and so forth, are intended to mean ends and sides of components that are closer, for example, as referenced along a central longitudinal axis of the fan system 10, to the inlet end 14 of the fan system 10, whereas the terms "discharge end", "discharge side", "downstream end", "downstream side", "axially downstream end", "axially downstream side", and so forth, are intended to mean ends and sides of components that are closer, for example, as referenced along a central longitudinal axis of the fan system 10, to the discharge end 16 of the fan system 10.

As illustrated in FIGS. 1 and 2, in certain embodiments, the fan system 10 includes a plurality of mounting features, such as bolted mounting feet 18 and mounting rails 20, which facilitate the fan system 10 being fixedly mounted to external structures. As also illustrated, in certain embodiments, the fan system 10 may include an adjustable motor mounting base 22 to which a motor, such as an electric motor in certain embodiments, may be fixedly mounted. As described in greater detail herein, the motor may be used to rotate a fan wheel assembly 24 disposed within the outer housing 12 of the fan system 10 to cause air to flow through the fan system 10, as described in greater detail herein.

In addition, in certain embodiments, the fan system 10 may include a belt tunnel 26 within which a drive belt may be disposed, wherein the drive belt is physically coupled to an output shaft of the motor and a drive shaft disposed within the outer housing 12 of the fan system 10 such that the drive belt facilitates the motor driving rotation of the drive shaft and, in turn, the fan wheel assembly 24. As illustrated in FIG. 1, in certain embodiments, the belt tunnel 26 may include an elongated motor output shaft opening 28 through which the output shaft of the motor may extend such that the output shaft may physically couple to the drive belt. In certain embodiments, a distance of the motor mounting base 22 from the outer housing 12 of the fan system 10 may be adjustable, such as illustrated by arrow 30, and the elongated shape of the motor output shaft opening 28 facilitates varying distances of the motor mounting base 22 (and, in turn, the output shaft of the motor) from the outer housing 12.

As also illustrated in FIG. 2, in certain embodiments, the fan system 10 may include a bearing tunnel 32 within which bearings that support the drive shaft may be disposed. As illustrated in FIG. 2, in certain embodiments, the bearing tunnel 32 may include a belt drive opening 34 through which the belt drive that is physically coupled to both the output shaft of the motor and the drive shaft may extend.

Figure 3:
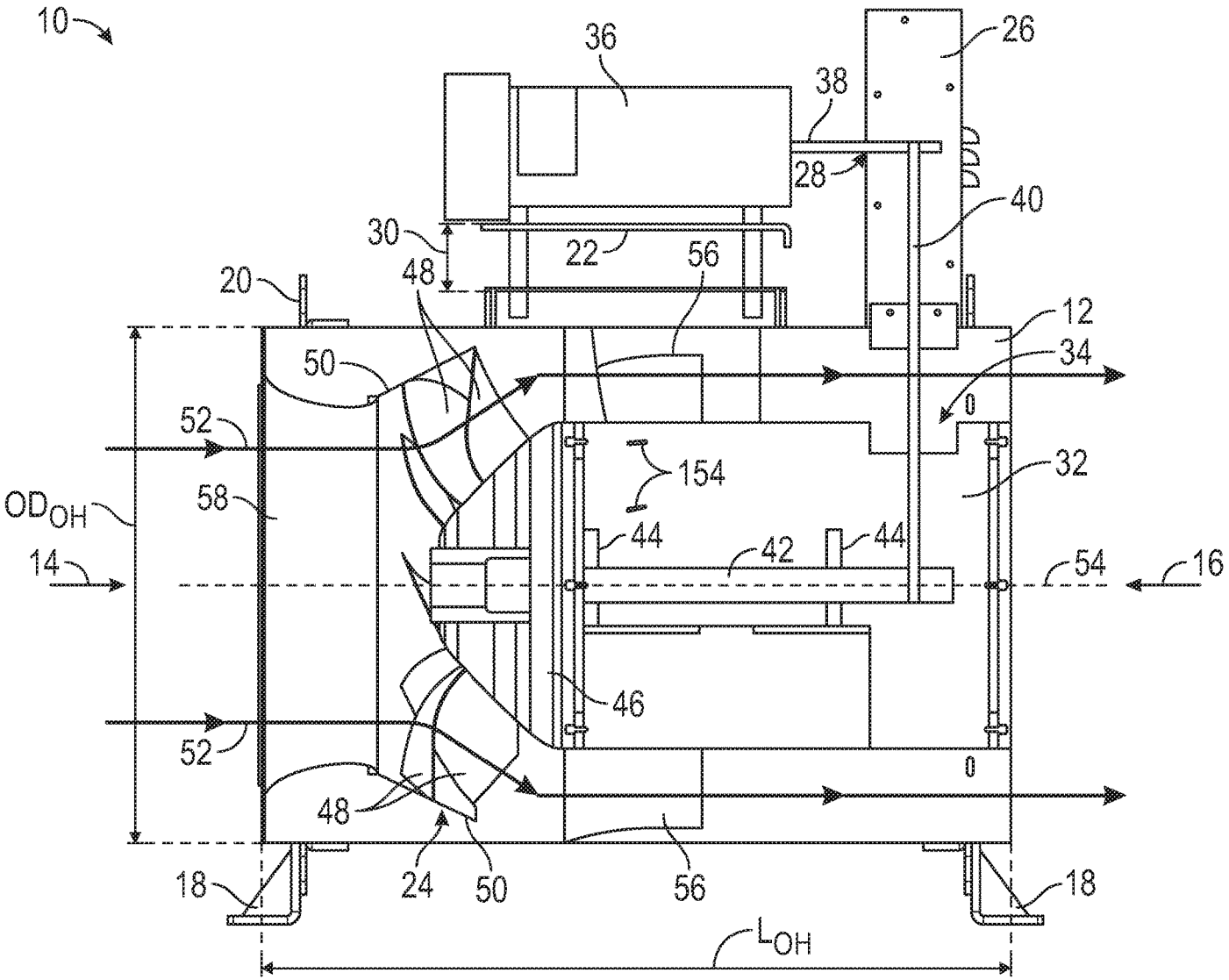
FIG. 3 is a partial cutaway view of the inline centrifugal mixed flow fan system, in accordance with an aspect of the present disclosure.

FIG. 3 is a partial cutaway view of the inline centrifugal mixed flow fan system 10, in accordance with an aspect of the present disclosure. As illustrated in FIG. 3, a motor 36 may be physical coupled to the motor mounting base 22, and an output shaft 38 of the motor 36 may extend into the motor output shaft opening 28 of the belt tunnel 26, where the output shaft 38 physically couples to a drive belt 40 that is also physically coupled to a drive shaft 42 disposed within the bearing tunnel 32. As such, the motor 36 may cause rotation of the drive shaft 42 (and, in turn, the fan wheel assembly 24 to which the drive shaft 42 is physically coupled) via interaction of the output shaft 38 of the motor 36, the drive belt 40, and the drive shaft 42. As also illustrated in FIG. 3, one or more bearings 44 may be disposed within the bearing tunnel 32 of the fan system 10, and may support the drive shaft 42.

As illustrated in FIG. 3, in certain embodiments, the wheel assembly 24 of the fan system 10 includes a generally conical-shaped hub cone 46, a plurality of fan blades 48 extending from the hub cone 46, and a shroud 50 that at least partially radially surrounds the plurality of fan blades 48. In certain embodiments, each of the plurality of fan blades 48 are physically connected, such as welded, to both the hub cone 46 and the shroud 50 such that the hub cone 46, the plurality of fan blades 48, and the shroud 50 collectively form an integrated fan wheel assembly 24 that rotates in unison with each other. More specifically, rotation of the drive shaft 42 causes the hub cone 46, the plurality of fan blades 48, and the shroud 50 to rotate in unison to draw air flow 52 in from the inlet end 14 of the fan system 10, for example, generally parallel to a central longitudinal axis 54 of the outer housing 12 of the fan system 10, to pressurize the air flow 52 and accelerate the air flow 52 radially outward with respect to the central longitudinal axis 54, axially along the central longitudinal axis 54, and circumferentially with respect to the central longitudinal axis 54 across the plurality of fan blades 48, and to force the air flow 52 across a plurality of guide vanes 56 to generally "straighten", for example, generally counteract radial and circumferential movement of, the air flow 52 to travel substantially axially, for example, generally parallel to the central longitudinal axis 54, out through the discharge end 16 of the fan system 10. As also illustrated in FIG. 3, an inlet venturi 58 is disposed at the inlet end 14 of the fan system 10 to funnel the air flow 52 into the fan wheel assembly 24. In certain embodiments, the inlet venturi 58 is fixedly coupled to the outer housing 12 of the fan system 10 such that the inlet venturi 58 remains in a fixed position, whereas the fan wheel assembly 24 that is disposed adjacent the inlet venturi 58 rotates about the central longitudinal axis 54 relative to the inlet venturi 58.

As such, as described above, the inline centrifugal mixed flow fan system 10 described herein generally combines features of centrifugal fan systems and axial fan systems to generate air flows 52 that share features with air flows generated by both centrifugal fan systems and axial fan systems. For example, centrifugal fan systems are generally used to intake air parallel to a central longitudinal axis of the fan, and to accelerate the air radially outward from, for example, generally transverse to, the central longitudinal axis. In contrast, axial fan systems are used to intake air parallel to a central longitudinal axis of the fan, and to accelerate the air axially along the central longitudinal axis. The inline centrifugal mixed flow fan system 10 described herein combines certain features of both centrifugal fan systems and axial fan systems by accelerating the air flow 52 radially, axially, and circumferentially, for example, with respect to the central longitudinal axis 54, using the fan wheel assembly 24 described herein, and then straightening the air flow 52 downstream of the fan wheel assembly 24 using the plurality of guide vanes 56. As such, the wheel assembly 24 and the plurality of guide vanes 56 function together to provide centrifugal air flow that includes radial, axial, and circumferential components that constitute a mixed flow that is "straightened" to exit the fan system 10 generally axially, hence, the designation of the fan system 10 as an inline centrifugal mixed flow fan system.

By combining aspects of both centrifugal fan systems and axial fan systems, the inline centrifugal mixed flow fan system 10 described herein produces certain benefits of both centrifugal fan systems and axial fan systems, such as exceptionally efficient air movement, higher static pressures, relatively low ambient noise, and a relatively steep fan curve. For example, as described in greater detail herein, the fan wheel assembly 24 of the inline centrifugal mixed flow fan system 10 is specifically designed to help produce these benefits. In addition, the plurality of guide vanes 56 of the inline centrifugal mixed flow fan system 10 creates even higher static pressures and, thus, saving energy as compared to other fan systems. In particular, it is noted that the relative dimensions and spatial relationships of the inline centrifugal mixed flow fan system 10 described herein have been specifically designed to increase the efficiency of the air movement, at relatively higher static pressures, creating relatively lower ambient noise, and so forth.

Figure 4:
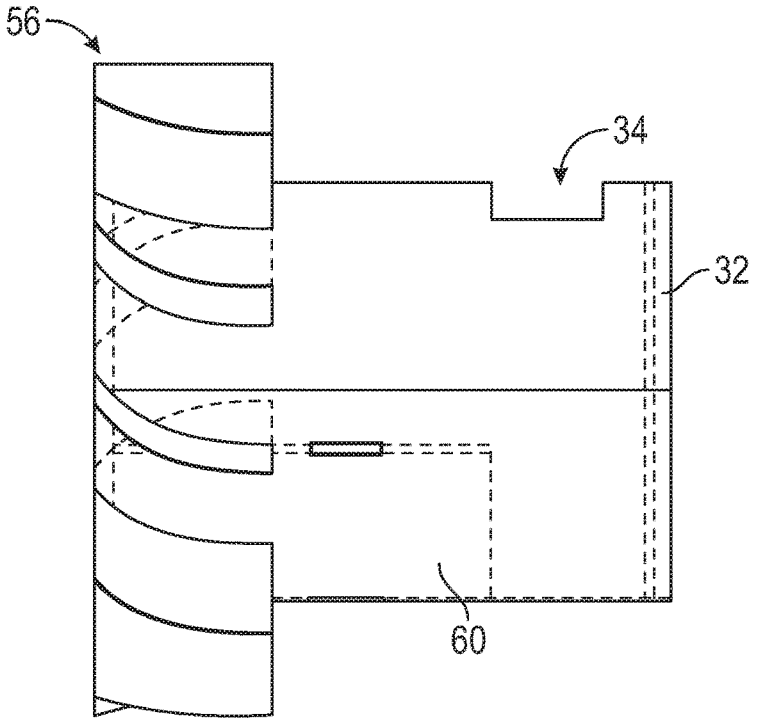
FIG. 4 is a side view of a bearing tunnel and a plurality of guide vanes of the inline centrifugal mixed flow fan system, in accordance with an aspect of the present disclosure.
Figure 5:
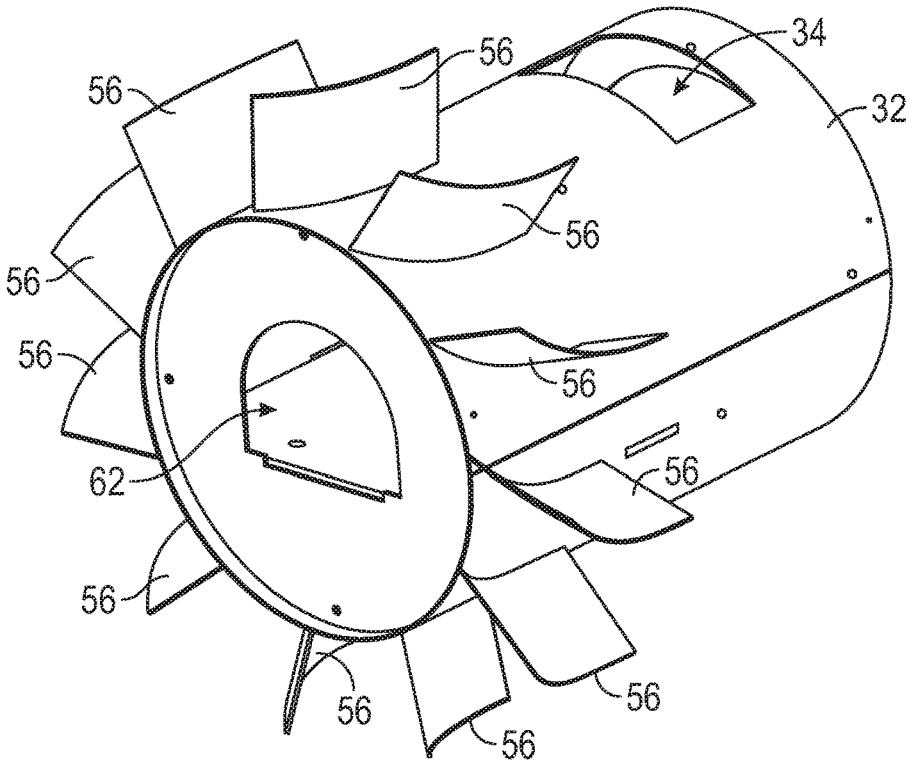
FIG. 5 is a perspective front view of a bearing tunnel and a plurality of guide vanes of the inline centrifugal mixed flow fan system, in accordance with an aspect of the present disclosure.
Figure 6:
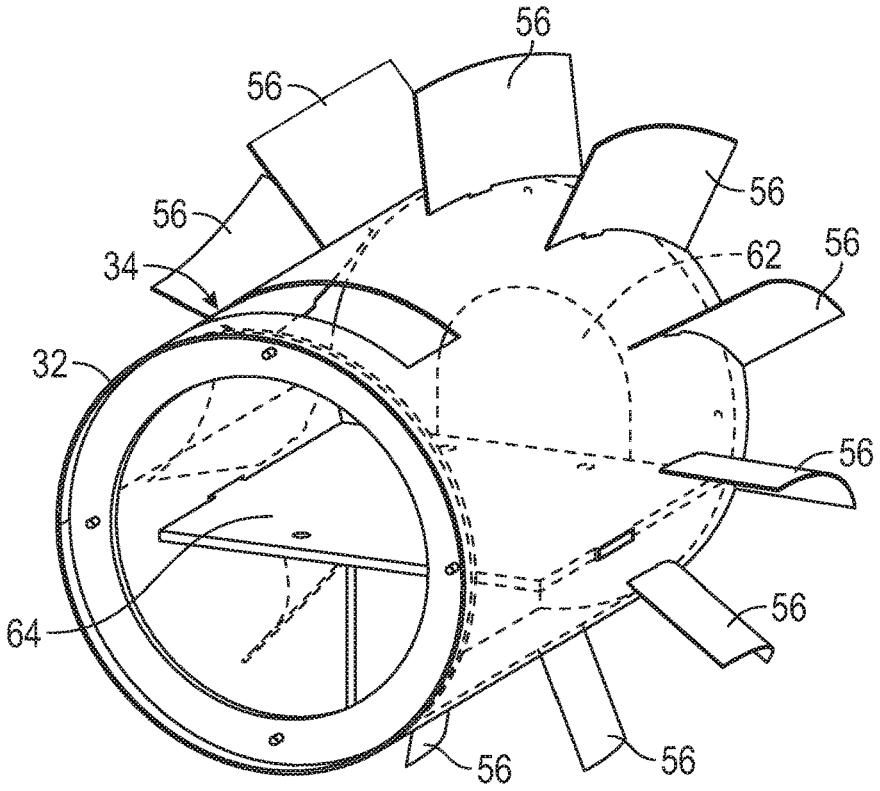
FIG. 6 is a perspective rear view of a bearing tunnel and a plurality of guide vanes of the inline centrifugal mixed flow fan system, in accordance with an aspect of the present disclosure.

FIGS. 4, 5, and 6 are a side view, a perspective front view, and a perspective rear view, respectively, of the bearing tunnel 32 and the plurality of guide vanes 56 of the inline centrifugal mixed flow fan system 10, in accordance with an aspect of the present disclosure. As illustrated, in certain embodiments, the fan system 10 may include eleven guide vanes 56 disposed circumferentially equiangular from each other about the central longitudinal axis 54 of the bearing tunnel 32. However, in other embodiments, the fan system 10 may include any number of guide vanes 56, such as eight, nine, ten, twelve, and so forth, that are disposed circumferentially equiangular from each other about the central longitudinal axis 54.

As illustrated in FIG. 4, in certain embodiments, the bearing tunnel 32 may include an access door 60 that enables access to the interior of the bearing tunnel 32. In certain embodiments, the access door 60 may be removably bolted to the bearing tunnel 32 and/or be physical coupled to the bearing tunnel 32 via a hinge. As illustrated in FIG. 5, in certain embodiments, the bearing tunnel 32 may include a drive shaft opening 62 through which the drive shaft 42 and, in certain embodiments, a bearing 44 may extend. As illustrated in FIG. 6, in certain embodiments, the bearing tunnel 32 may have a base plate 64 disposed therein, which may be used to support the bearings 44, which in turn support the drive shaft 42 within the bearing tunnel 32.

In certain embodiments, a ratio of an axial length LBT of the bearing tunnel 32 relative to an axial length $L_{OH}$ of the outer housing 12 of the fan system 10 may be within a range of approximately 0.52 to approximately 0.67, may be within a range of approximately 0.54 to approximately 0.65, may be within a range of approximately 0.56 to approximately 0.63, or may be within a range of approximately 0.58 to approximately 0.61. Conversely, in certain embodiments, a ratio of the axial length $L_{OH}$ of the outer housing 12 relative to the axial length LBT of the bearing tunnel 32 may be within a range of approximately 1.50 to approximately 1.95, may be within a range of approximately 1.55 to approximately 1.85, may be within a range of approximately 1.60 to approximately 1.75, or may be within a range of approximately 1.66 to approximately 1.70.

In certain embodiments, a ratio of an outer diameter $OD_{BT}$ of the bearing tunnel 32 relative to the axial length $L_{OH}$ of the outer housing 12 of the fan system 10 may be within a range of approximately 0.36 to approximately 0.51, may be within a range of approximately 0.38 to approximately 0.49, may be within a range of approximately 0.40 to approximately 0.47, or may be within a range of approximately 0.42 to approximately 0.45. Conversely, in certain embodiments, a ratio of the axial length $L_{OH}$ of the outer housing 12 relative to the outer diameter $OD_{BT}$ of the bearing tunnel 32 may be within a range of approximately 1.95 to approximately 2.75, may be within a range of approximately 2.05 to approximately 2.60, may be within a range of approximately 2.15 to approximately 2.45, or may be within a range of approximately 2.25 to approximately 2.35.

In certain embodiments, a ratio of the axial length LBT of the bearing tunnel 32 relative to an outer diameter $OD_{OH}$ of the outer housing 12 of the fan system 10 may be within a range of approximately 0.80 to approximately 1.00, may be within a range of approximately 0.83 to approximately 0.98, may be within a range of approximately 0.86 to approximately 0.95, or may be within a range of approximately 0.89 to approximately 0.92. Conversely, in certain embodiments, a ratio of the outer diameter $OD_{OH}$ of the outer housing 12 relative to the axial length LBT of the bearing tunnel 32 may be within a range of approximately 1.00 to approximately 1.25, may be within a range of approximately 1.03 to approximately 1.20, may be within a range of approximately 1.06 to approximately 1.15, or may be within a range of approximately 1.08 to approximately 1.12.

In certain embodiments, a ratio of the outer diameter $OD_{BT}$ of the bearing tunnel 32 relative to the outer diameter $OD_{OH}$ of the outer housing 12 of the fan system 10 may be within a range of approximately 0.57 to approximately 0.72, may be within a range of approximately 0.59 to approximately 0.70, may be within a range of approximately 0.61 to approximately 0.68, or may be within a range of approximately 0.63 to approximately 0.66. Conversely, in certain embodiments, a ratio of the outer diameter $OD_{OH}$ of the outer housing 12 relative to the outer diameter $OD_{BT}$ of the bearing tunnel 32 may be within a range of approximately 1.35 to approximately 1.75, may be within a range of approximately 1.40 to approximately 1.70, may be within a range of approximately 1.45 to approximately 1.65, or may be within a range of approximately 1.50 to approximately 1.60.

Figure 7:
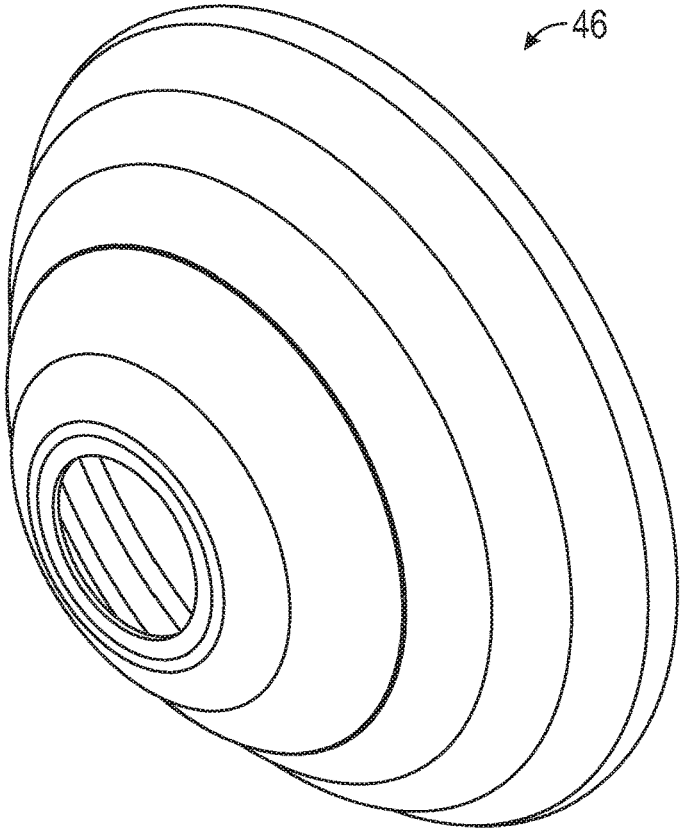
FIG. 7 is a perspective view of a hub cone of a wheel assembly of the inline centrifugal mixed flow fan system, in accordance with an aspect of the present disclosure.
Figure 8:
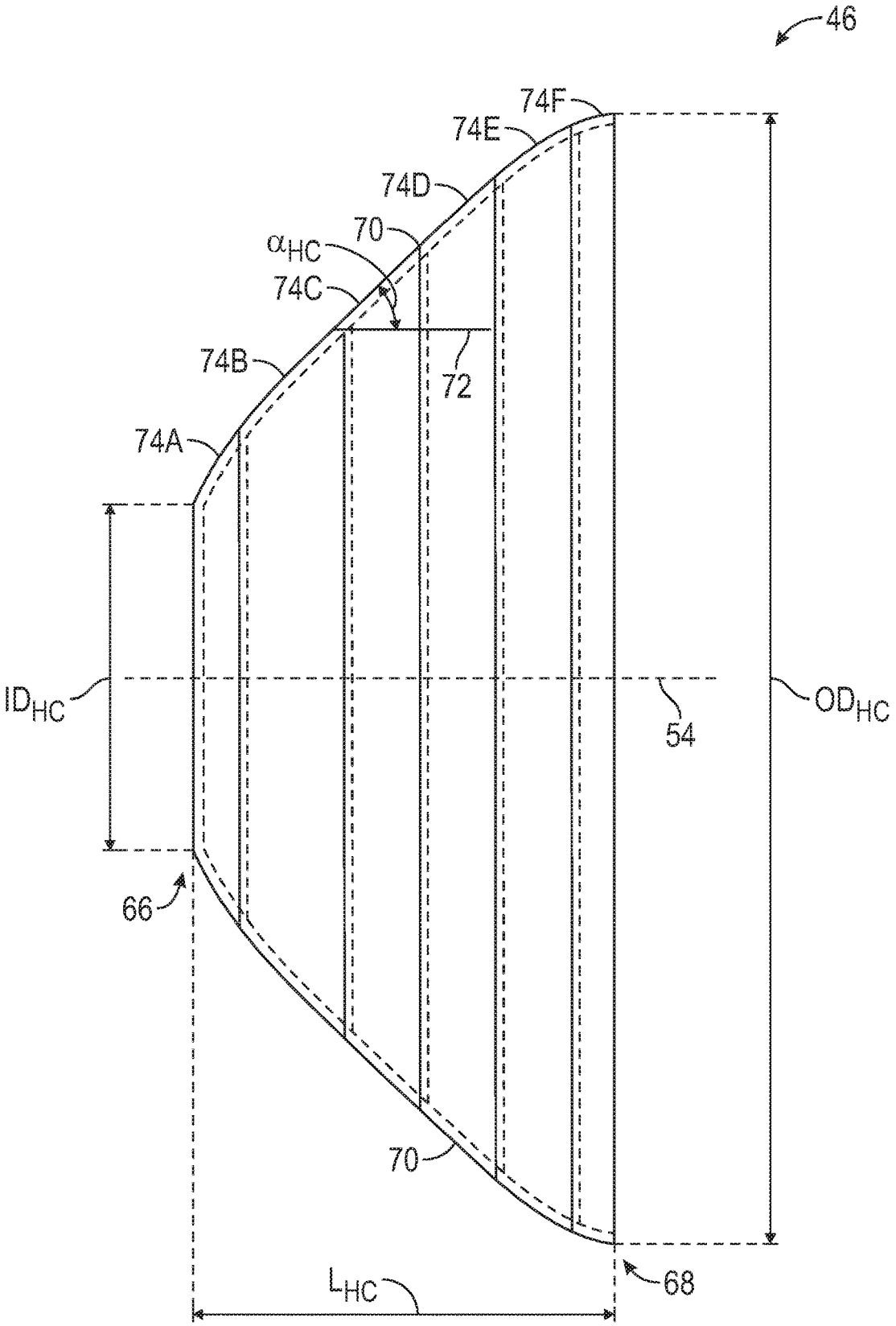
FIG. 8 is a side view of a hub cone of a wheel assembly of the inline centrifugal mixed flow fan system, in accordance with an aspect of the present disclosure.

FIGS. 7 and 8 are a perspective view and a side view, respectively, of the hub cone 46 of the wheel assembly 24 of the inline centrifugal mixed flow fan system 10, in accordance with an aspect of the present disclosure. As illustrated in FIG. 8, in certain embodiments, the hub cone 46 is generally conical in shape from an inlet, or upstream, end 66 of the hub cone 46 to a discharge, or downstream, end 68 of the hub cone 46. More specifically, in certain embodiments, the hub cone 46 is in the form of a truncated convex cone insofar as the inlet end 66 of the hub cone 46 does not converge to a point. Rather, the hub cone 46 includes generally circular openings at both ends 66, 68. In certain embodiments, an angle $\alpha_{HC}$, for example, relative to a line 72 parallel to the central longitudinal axis 54, of the walls 70 of the hub cone 46 may be within a range of approximately 40 degrees to approximately 47 degrees, may be within a range of approximately 41 degrees to approximately 46 degrees, may be within a range of approximately 42 degrees to approximately 45 degrees, or may be within a range of approximately 43 degrees to approximately 44 degrees.

It should be noted that all of the angles described herein that are defined as being angles between two lines are intended to be the smaller of the two angles that are formed by the intersection of the two lines in a particular plane of reference, for example, usually the plane illustrated in the particular figure. In other words, unless the two lines are perpendicular to each other, the two lines will, by definition, form two angles—one acute angle and one obtuse angle—between each other in the particular plane of reference. However, again, when defined herein as being an angle between two lines, the angle is intended to be the smaller (acute) of the two angles in the particular plane of reference.

As also illustrated in FIG. 8, in certain embodiments, the hub cone 46 includes a plurality of discrete hub cone segments 74 disposed adjacent each other axially along the central longitudinal axis 54 of the hub cone 46 to form the walls 70 of the hub cone 46, wherein each of the hub cone segments 74 are individually in the form of truncated convex cones. In particular, the walls 70 of the hub cone 46 may comprise a relatively complex spline that includes any number of hub cone segments 74, or tangent arches. As illustrated in FIGS. 7 and 8, in certain embodiments, the hub cone 46 may include six hub cone segments 74. However, in other embodiments, the hub cone 46 may include any number of hub cone segments 74, such as between 5 and 24 hub cone segments 74, in certain embodiments.

In certain embodiments, the radii of curvature of the hub cone segments 74 of the hub cone 46 may vary from a first hub cone segment 74A at the inlet end 66 of the hub cone 46 to a last hub cone segment 74F at the discharge end 68 of the hub cone 46. For example, in certain embodiments, the radii of curvature from the first hub cone segment 74A at the inlet end 66 of the hub cone 46 to the last hub cone segment 74F at the discharge end 68 of the hub cone 46 may gradually increase from the first hub cone segment 74A to a maximum radius of curvature, for example, of an intermediate hub cone segment, such as a third hub cone segment 74C or a fourth hub cone segment 74D, and then gradually decrease to the last hub cone segment 74F.

In certain embodiments, the hub cone 46 may be relatively narrow. For example, in certain embodiments, a ratio of the axial length $L_{HC}$ of the hub cone 46 relative to an inner diameter $ID_{HC}$ of the hub cone 46 may be within a range of approximately 1.41 to approximately 2.00, may be within a range of approximately 1.50 to approximately 1.90, may be within a range of approximately 1.59 to approximately 1.80, or may be within a range of approximately 1.68 to approximately 1.71. In addition, in certain embodiments, a ratio of the axial length Luc of the hub cone 46 relative to an outer diameter $OD_{HC}$ of the hub cone 46 may be within a range of approximately 0.31 to approximately 0.44, may be within a range of approximately 0.33 to approximately 0.42, may be within a range of approximately 0.35 to approximately 0.40, or may be within a range of approximately 0.37 to approximately 0.38. It is noted that, in certain embodiments, the outer diameter $OD_{HC}$ of the hub cone 46 may be substantially similar to the outer diameter $OD_{BT}$ of the bearing tunnel 32 of the fan system 10 such that the hub cone 46 and the bearing tunnel 32 are generally flush with each other at the axial position where the hub cone 46 and the bearing tunnel 32 are adjacent each other.

In addition, in certain embodiments, the hub cone 46 may also be relatively narrow with respect to the shroud 50 of the wheel assembly 24. For example, in certain embodiments, a ratio of the axial length $L_{HC}$ of the hub cone 46 relative to an inner diameter $ID_s$ of the shroud 50 may be within a range of approximately 0.27 to approximately 0.37, may be within a range of approximately 0.28 to approximately 0.36, may be within a range of approximately 0.29 to approximately 0.35, may be within a range of approximately 0.30 to approximately 0.34, or may be within a range of approximately 0.31 to approximately 0.33. In addition, in certain embodiments, a ratio of the axial length $L_{HC}$ of the hub cone 46 relative to an outer diameter $OD_S$ of the shroud 50 may be within a range of approximately 0.21 to approximately 0.30, may be within a range of approximately 0.22 to approximately 0.29, may be within a range of approximately 0.23 to approximately 0.28, may be within a range of approximately 0.24 to approximately 0.27, or may be within a range of approximately 0.25 to approximately 0.26.

In addition, in certain embodiments, a ratio of the axial length $L_{HC}$ of the hub cone 46 relative to the outer diameter $OD_{OH}$ of the outer housing 12 of the fan system 10 may be within a range of approximately 0.20 to approximately 0.28, may be within a range of approximately 0.21 to approximately 0.27, may be within a range of approximately 0.22 to approximately 0.26, or may be within a range of approximately 0.23 to approximately 0.25. In addition, in certain embodiments, a ratio of the axial length $L_{HC}$ of the hub cone 46 relative to the axial length $L_{OH}$ of the outer housing 12 may be within a range of approximately 0.13 to approximately 0.19, may be within a range of approximately 0.14 to approximately 0.18, or may be within a range of approximately 0.15 to approximately 0.17.

In addition, in certain embodiments, a ratio of the inner diameter $ID_{HC}$ of the hub cone 46 relative to the axial length $L_{HC}$ of the hub cone 46 may be within a range of approximately 0.49 to approximately 0.72, may be within a range of approximately 0.52 to approximately 0.68, may be within a range of approximately 0.55 to approximately 0.64, or may be within a range of approximately 0.58 to approximately 0.60. In addition, in certain embodiments, a ratio of the inner diameter $ID_{HC}$ of the hub cone 46 relative to the outer diameter $OD_{HC}$ of the hub cone 46 may be within a range of approximately 0.18 to approximately 0.26, may be within a range of approximately 0.19 to approximately 0.25, may be within a range of approximately 0.20 to approximately 0.24, or may be within a range of approximately 0.21 to approximately 0.23.

In addition, in certain embodiments, a ratio of the inner diameter $ID_{HC}$ of the hub cone 46 relative to the inner diameter $ID_s$ of the shroud 50 may be within a range of approximately 0.16 to approximately 0.22, may be within a range of approximately 0.17 to approximately 0.21, or may be within a range of approximately 0.18 to approximately 0.20. In addition, in certain embodiments, a ratio of the inner diameter $ID_{HC}$ of the hub cone 46 relative to the outer diameter $OD_S$ of the shroud 50 may be within a range of approximately 0.12 to approximately 0.18, may be within a range of approximately 0.13 to approximately 0.17, or may be within a range of approximately 0.14 to approximately 0.16.

In addition, in certain embodiments, a ratio of the inner diameter $ID_{HC}$ of the hub cone 46 relative to the outer diameter $OD_{OH}$ of the outer housing 12 of the fan system 10 may be within a range of approximately 0.11 to approximately 0.17, may be within a range of approximately 0.12 to approximately 0.16, or may be within a range of approximately 0.13 to approximately 0.15. In addition, in certain embodiments, a ratio of the inner diameter $ID_{HC}$ of the hub cone 46 relative to the axial length $L_{OH}$ of the outer housing 12 may be within a range of approximately 0.06 to approximately 0.13, may be within a range of approximately 0.07 to approximately 0.12, or may be within a range of approximately 0.08 to approximately 0.11.

In addition, in certain embodiments, a ratio of the outer diameter $OD_{HC}$ of the hub cone 46 relative to the axial length $L_{HC}$ of the hub cone 46 may be within a range of approximately 2.25 to approximately 3.25, may be within a range of approximately 2.35 to approximately 3.00, may be within a range of approximately 2.45 to approximately 2.90, or may be within a range of approximately 2.60 to approximately 2.70. In addition, in certain embodiments, a ratio of the outer diameter $OD_{HC}$ of the hub cone 46 relative to the inner diameter $ID_{HC}$ of the hub cone 46 may be within a range of approximately 3.90 to approximately 5.20, may be within a range of approximately 4.05 to approximately 5.05, may be within a range of approximately 4.20 to approximately 4.90, or may be within a range of approximately 4.35 to approximately 4.75.

In addition, in certain embodiments, a ratio of the outer diameter $OD_{HC}$ of the hub cone 46 relative to the inner diameter $ID_s$ of the shroud 50 may be within a range of approximately 0.72 to approximately 1.00, may be within a range of approximately 0.77 to approximately 0.95, or may be within a range of approximately 0.80 to approximately 0.90. In addition, in certain embodiments, a ratio of the outer diameter $OD_{HC}$ of the hub cone 46 relative to the outer diameter $OD_S$ of the shroud 50 may be within a range of approximately 0.60 to approximately 0.76, may be within a range of approximately 0.62 to approximately 0.74, may be within a range of approximately 0.64 to approximately 0.72, or may be within a range of approximately 0.66 to approximately 0.70.

In addition, in certain embodiments, a ratio of the outer diameter $OD_{HC}$ of the hub cone 46 relative to the outer diameter $OD_{OH}$ of the outer housing 12 of the fan system 10 may be within a range of approximately 0.57 to approximately 0.72, may be within a range of approximately 0.59 to approximately 0.70, may be within a range of approximately 0.61 to approximately 0.68, or may be within a range of approximately 0.63 to approximately 0.66. In addition, in certain embodiments, a ratio of the outer diameter $OD_{HC}$ of the hub cone 46 relative to the axial length $L_{OH}$ of the outer housing 12 may be within a range of approximately 0.36 to approximately 0.51, may be within a range of approximately 0.38 to approximately 0.49, may be within a range of approximately 0.40 to approximately 0.47, or may be within a range of approximately 0.42 to approximately 0.45.

Figure 9:
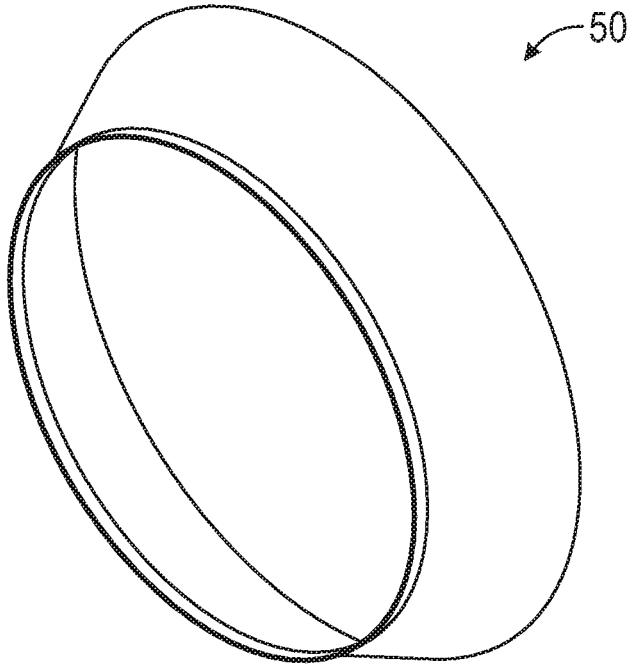
FIG. 9 is a perspective view of a shroud of the wheel assembly of the inline centrifugal mixed flow fan system, in accordance with an aspect of the present disclosure.
Figure 10:
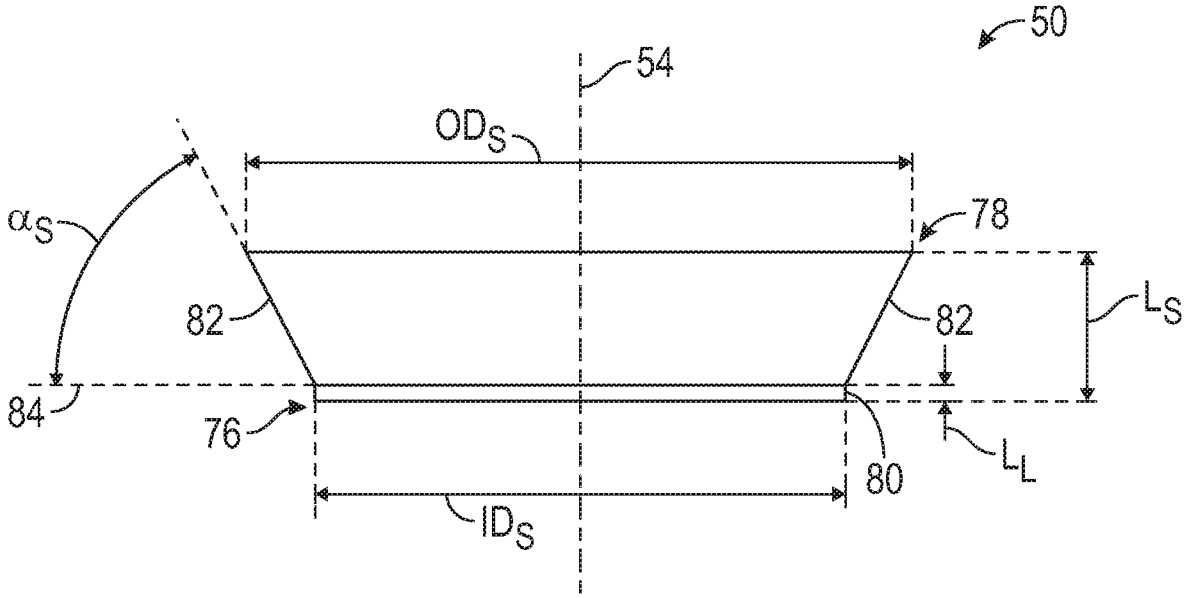
FIG. 10 is a side view of a shroud of the wheel assembly of the inline centrifugal mixed flow fan system, in accordance with an aspect of the present disclosure.
Figure 11:
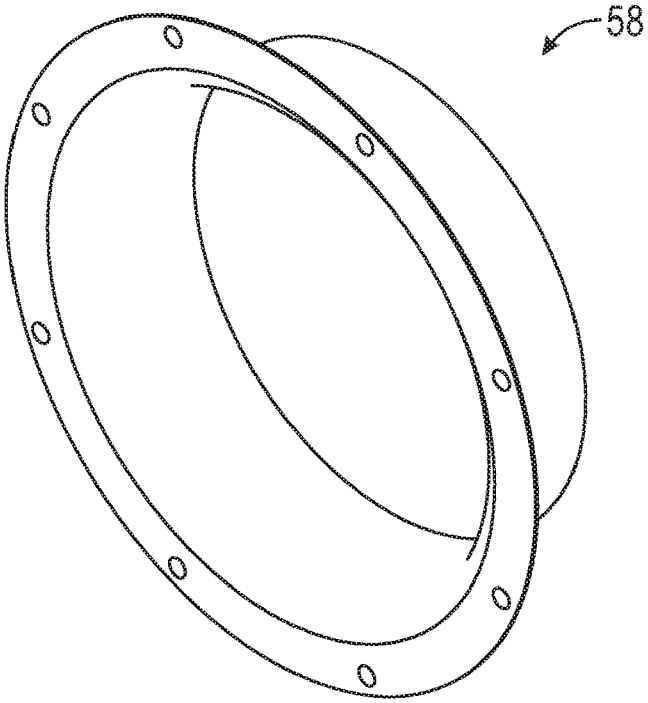
FIG. 11 is a perspective view of an inlet venturi of the inline centrifugal mixed flow fan system, in accordance with an aspect of the present disclosure.

FIGS. 9 and 10 are a perspective view and a side view, respectively, of the shroud 50 of the wheel assembly 24 of the inline centrifugal mixed flow fan system 10, in accordance with an aspect of the present disclosure. As illustrated in FIG. 10, in certain embodiments, similar to the hub cone 46 of the wheel assembly 24, the shroud 50 is also generally conical in shape from an inlet, or upstream, end 76 of the shroud 50 to a discharge, or downstream, end 78 of the shroud 50. More specifically, in certain embodiments, the shroud 50 is generally in the form of a truncated convex cone insofar as the inlet end 76 of the shroud 50 does not converge to a point. Rather, the shroud 50 includes generally circular openings at both ends 76, 78.

In addition, as illustrated in FIG. 10, in certain embodiments, the shroud 50 includes a relatively narrow cylindrical lip 80 adjacent the main walls 82 of the shroud 50 at the inlet end 76 of the shroud 50. In certain embodiments, a ratio of an axial length $L_L$ of the cylindrical lip 80 relative to an axial length $L_S$ of the shroud 50 may be within a range of approximately 0.07 to approximately 0.15, may be within a range of approximately 0.08 to approximately 0.14, may be within a range of approximately 0.09 to approximately 0.13, or may be within a range of approximately 0.10 to approximately 0.12. In certain embodiments, the cylindrical lip 80 of the shroud 50 is configured to be disposed radially around a discharge, or downstream, end 90 of the inlet venturi 58 of the fan system 10 to ensure that the air flow 52 does not escape radially between the inlet venturi 58 and the wheel assembly 24 as the wheel assembly 24 rotates, for example, about the central longitudinal axis 54, relative to the stationary inlet venturi 58.

In certain embodiments, an angle $\alpha_S$ relative to a line 84 perpendicular to the central longitudinal axis 54 of the walls 82 of the shroud 50 may be within a range of approximately 60 degrees to approximately 68 degrees, may be within a range of approximately 61 degrees to approximately 67 degrees, may be within a range of approximately 62 degrees to approximately 66 degrees, or may be within a range of approximately 63 degrees to approximately 65 degrees.

In certain embodiments, similar to the hub cone 46, the shroud 50 may be relatively narrow. For example, in certain embodiments, a ratio of the axial length $L_S$ of the shroud 50 relative to the inner diameter $ID_S$ of the shroud 50 may be within a range of approximately 0.22 to approximately 0.35, may be within a range of approximately 0.24 to approximately 0.33, may be within a range of approximately 0.26 to approximately 0.31, or may be within a range of approximately 0.28 to approximately 0.29. In addition, in certain embodiments, a ratio of the axial length $L_S$ of the shroud 50 relative to the outer diameter $OD_S$ of the shroud 50 may be within a range of approximately 0.16 to approximately 0.30, may be within a range of approximately 0.18 to approximately 0.28, may be within a range of approximately 0.20 to approximately 0.26, or may be within a range of approximately 0.22 to approximately 0.24.

In addition, in certain embodiments, a ratio of the axial length $L_S$ of the shroud 50 relative to the outer diameter $OD_{OH}$ of the outer housing 12 of the fan system 10 may be within a range of approximately 0.17 to approximately 0.26, may be within a range of approximately 0.18 to approximately 0.25, may be within a range of approximately 0.19 to approximately 0.24, or may be within a range of approximately 0.20 to approximately 0.23. In addition, in certain embodiments, a ratio of the axial length $L_S$ of the shroud 50 relative to the axial length $L_{OH}$ of the outer housing 12 may be within a range of approximately 0.11 to approximately 0.18, may be within a range of approximately 0.12 to approximately 0.17, or may be within a range of approximately 0.13 to approximately 0.16.

In addition, in certain embodiments, a ratio of the inner diameter $ID_S$ of the shroud 50 relative to the axial length $L_S$ of the shroud 50 may be within a range of approximately 2.80 to approximately 4.50, may be within a range of approximately 3.00 to approximately 4.20, may be within a range of approximately 3.20 to approximately 3.90, or may be within a range of approximately 3.40 to approximately 3.60. In addition, in certain embodiments, a ratio of the inner diameter $ID_S$ of the shroud 50 relative to the outer diameter $OD_S$ of the shroud 50 may be within a range of approximately 0.75 to approximately 0.85, may be within a range of approximately 0.76 to approximately 0.84, may be within a range of approximately 0.77 to approximately 0.83, may be within a range of approximately 0.78 to approximately 0.82, or may be within a range of approximately 0.79 to approximately 0.81.

In addition, in certain embodiments, a ratio of the inner diameter $ID_S$ of the shroud 50 relative to the outer diameter $OD_{OH}$ of the outer housing 12 of the fan system 10 may be within a range of approximately 0.67 to approximately 0.82, may be within a range of approximately 0.70 to approximately 0.79, or may be within a range of approximately 0.73 to approximately 0.76. In addition, in certain embodiments, a ratio of the inner diameter $ID_S$ of the shroud 50 relative to the axial length $L_{OH}$ of the outer housing 12 may be within a range of approximately 0.45 to approximately 0.56, may be within a range of approximately 0.47 to approximately 0.54, or may be within a range of approximately 0.49 to approximately 0.52.

In addition, in certain embodiments, a ratio of the outer diameter $OD_S$ of the shroud 50 relative to the axial length $L_S$ of the shroud 50 may be within a range of approximately 3.40 to approximately 5.10, may be within a range of approximately 3.70 to approximately 4.90, may be within a range of approximately 4.00 to approximately 4.70, or may be within a range of approximately 4.30 to approximately 4.50. In addition, in certain embodiments, a ratio of the outer diameter $OD_S$ of the shroud 50 relative to the inner diameter $ID_S$ of the shroud 50 may be within a range of approximately 1.15 to approximately 1.35, may be within a range of approximately 1.18 to approximately 1.32, may be within a range of approximately 1.20 to approximately 1.30, or may be within a range of approximately 1.22 to approximately 1.28.

In addition, in certain embodiments, a ratio of the outer diameter $OD_S$ of the shroud 50 relative to the outer diameter $OD_{OH}$ of the outer housing 12 of the fan system 10 may be within a range of approximately 0.90 to approximately 0.97, may be within a range of approximately 0.91 to approximately 0.96, or may be within a range of approximately 0.92 to approximately 0.95. In addition, in certain embodiments, a ratio of the outer diameter $OD_S$ of the shroud 50 relative to the axial length $L_{OH}$ of the outer housing 12 may be within a range of approximately 0.57 to approximately 0.69, may be within a range of approximately 0.59 to approximately 0.67, or may be within a range of approximately 0.61 to approximately 0.65.

Figure 12:
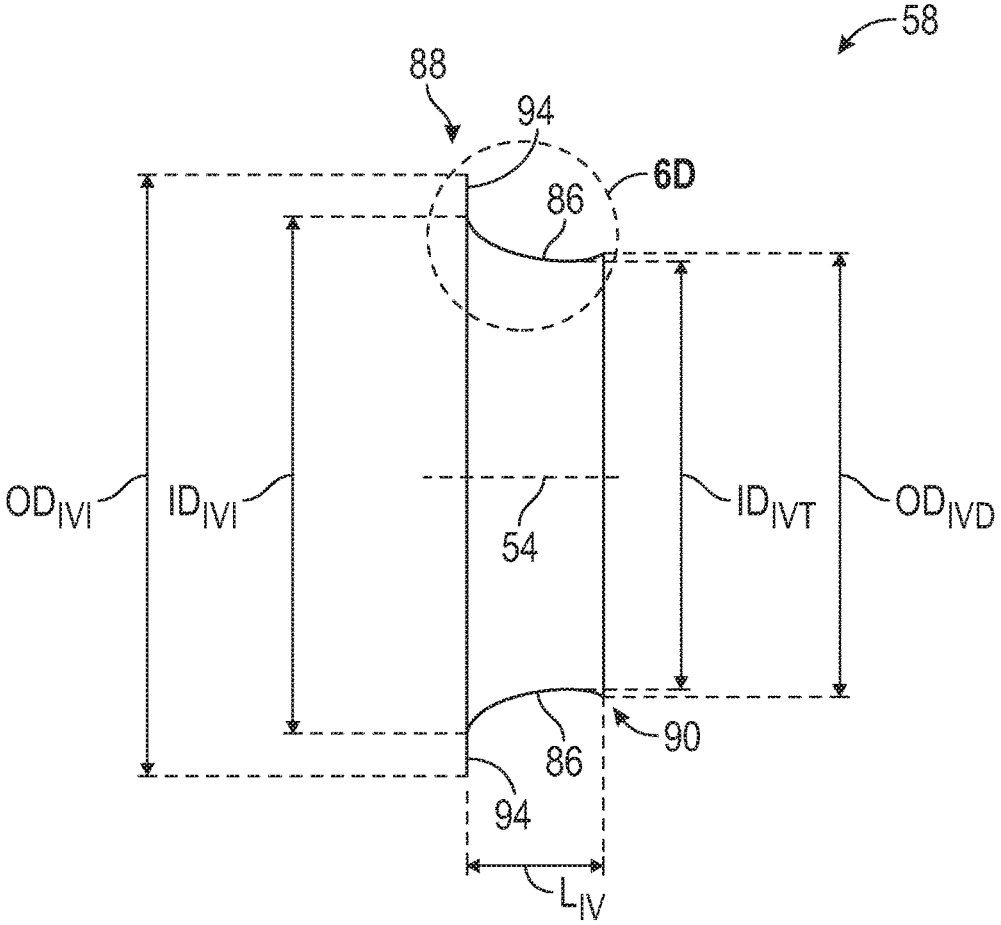
FIG. 12 is a side view of an inlet venturi of the inline centrifugal mixed flow fan system, in accordance with an aspect of the present disclosure.

FIGS. 11, 12, 13, and 14 are a perspective view, a side view, an axial view, and a partial side view, respectively, of the inlet venturi 58 of the inline centrifugal mixed flow fan system 10, in accordance with an aspect of the present disclosure. As illustrated in FIG. 12, in certain embodiments, the walls 86 of the inlet venturi 58 form a relatively complex spline profile that may, for example, includes anywhere from five to twelve tangent arches. In general, the walls 86 of the inlet venturi 58 have an inner diameter $ID_{IVI}$ at an inlet, or upstream, end 88 of the inlet venturi 58 that gradually decreases along the central longitudinal axis 54 to a throat inner diameter $ID_{IVT}$, and then gradually increases toward the discharge end 90 of the inlet venturi 58. As such, it will be appreciated that the throat 92 of the inlet venturi 58 is the point along the walls 86 of the inlet venturi 58 that have the smallest inner diameter.

In addition, as illustrated in FIG. 12, in certain embodiments, the inlet venturi 58 may have an inlet flange 94 at the inlet end 88 of the inlet venturi 58 that extends radially from the inner diameter $ID_{IVI}$ at the inlet end 88 of the inlet venturi 58 to an outer diameter $ID_{IVI}$ at the inlet end 88 of the inlet venturi 58. In general, the inlet flange 94 of the inlet venturi 58 may be used to physically couple an inlet screen 96 to the inlet venturi 58.

In certain embodiments, a ratio of the axial length $L_{IV}$ along the central longitudinal axis 54 of the inlet venturi 58 relative to the inner diameter $ID_{IVI}$ at the inlet end 88 of the inlet venturi 58 may be within a range of approximately 0.19 to approximately 0.34, may be within a range of approximately 0.21 to approximately 0.32, may be within a range of approximately 0.23 to approximately 0.30, or may be within a range of approximately 0.25 to approximately 0.28. In addition, in certain embodiments, a ratio of the axial length $L_{IV}$ along the central longitudinal axis 54 of the inlet venturi 58 relative to the outer diameter $OD_{IVD}$ at the discharge end 90 of the inlet venturi 58 may be within a range of approximately 0.23 to approximately 0.38, may be within a range of approximately 0.25 to approximately 0.36, may be within a range of approximately 0.27 to approximately 0.34, or may be within a range of approximately 0.29 to approximately 0.32.

In addition, in certain embodiments, a ratio of the axial length $L_{IV}$ along the central longitudinal axis 54 of the inlet venturi 58 relative to the outer diameter $OD_{OH}$ of the outer housing 12 of the fan system 10 may be within a range of approximately 0.18 to approximately 0.27, may be within a range of approximately 0.19 to approximately 0.26, may be within a range of approximately 0.20 to approximately 0.25, or may be within a range of approximately 0.21 to approximately 0.24. In addition, in certain embodiments, a ratio of the axial length $L_{IV}$ along the central longitudinal axis 54 of the inlet venturi 58 relative to the axial length $L_{OH}$ of the outer housing 12 may be within a range of approximately 0.12 to approximately 0.18, may be within a range of approximately 0.13 to approximately 0.17, or may be within a range of approximately 0.14 to approximately 0.16.

In certain embodiments, a ratio of the inner diameter $ID_{IVI}$ at the inlet end 88 of the inlet venturi 58 relative to the axial length $L_{IV}$ along the central longitudinal axis 54 of the inlet venturi 58 may be within a range of approximately 3.00 to approximately 4.50, may be within a range of approximately 3.20 to approximately 4.30, may be within a range of approximately 3.40 to approximately 4.10, or may be within a range of approximately 3.60 to approximately 3.90. In addition, in certain embodiments, a ratio of the inner diameter $ID_{IVI}$ at the inlet end 88 of the inlet venturi 58 relative to the outer diameter $OD_{IVI}$ at the discharge end 90 of the inlet venturi 58 may be within a range of approximately 1.00 to approximately 1.30, may be within a range of approximately 1.04 to approximately 1.26, may be within a range of approximately 1.08 to approximately 1.22, or may be within a range of approximately 1.12 to approximately 1.18.

In addition, in certain embodiments, a ratio of the inner diameter $ID_{IVI}$ at the inlet end 88 of the inlet venturi 58 relative to the outer diameter $OD_{OH}$ of the outer housing 12 of the fan system 10 may be within a range of approximately 0.80 to approximately 0.88, may be within a range of approximately 0.81 to approximately 0.87, may be within a range of approximately 0.82 to approximately 0.86, or may be within a range of approximately 0.83 to approximately 0.85. In addition, in certain embodiments, a ratio of the inner diameter $ID_{IVI}$ at the inlet end 88 of the inlet venturi 58 relative to the axial length $L_{OH}$ of the outer housing 12 may be within a range of approximately 0.52 to approximately 0.61, may be within a range of approximately 0.53 to approximately 0.60, may be within a range of approximately 0.54 to approximately 0.59, or may be within a range of approximately 0.55 to approximately 0.58.

In certain embodiments, a ratio of the outer diameter $OD_{IVD}$ at the discharge end 90 of the inlet venturi 58 relative to the axial length $L_{IV}$ along the central longitudinal axis 54 of the inlet venturi 58 may be within a range of approximately 2.50 to approximately 4.00, may be within a range of approximately 2.70 to approximately 3.80, may be within a range of approximately 2.90 to approximately 3.60, or may be within a range of approximately 3.10 to approximately 3.40. In addition, in certain embodiments, a ratio of the outer diameter $OD_{IVI}$ at the discharge end 90 of the inlet venturi 58 relative to the inner diameter $ID_{IVI}$ at the inlet end 88 of the inlet venturi 58 may be within a range of approximately 0.77 to approximately 1.00, may be within a range of approximately 0.80 to approximately 0.96, may be within a range of approximately 0.83 to approximately 0.92, or may be within a range of approximately 0.85 to approximately 0.89.

In addition, in certain embodiments, a ratio of the outer diameter $OD_{IVI}$ at the discharge end 90 of the inlet venturi 58 relative to the outer diameter $OD_{OH}$ of the outer housing 12 of the fan system 10 may be within a range of approximately 0.69 to approximately 0.77, may be within a range of approximately 0.70 to approximately 0.76, may be within a range of approximately 0.71 to approximately 0.75, or may be within a range of approximately 0.72 to approximately 0.74. In addition, in certain embodiments, a ratio of the outer diameter $OD_{IVI}$ at the discharge end 90 of the inlet venturi 58 relative to the axial length $L_{OH}$ of the outer housing 12 may be within a range of approximately 0.44 to approximately 0.54, may be within a range of approximately 0.45 to approximately 0.53, may be within a range of approximately 0.46 to approximately 0.52, or may be within a range of approximately 0.47 to approximately 0.51.

In certain embodiments, a ratio of the outer diameter $OD_{IVI}$ at the inlet end 88 of the inlet venturi 58 relative to the axial length $L_{IV}$ along the central longitudinal axis 54 of the inlet venturi 58 may be within a range of approximately 3.70 to approximately 5.20, may be within a range of approximately 3.90 to approximately 5.00, may be within a range of approximately 4.10 to approximately 4.80, or may be within a range of approximately 4.30 to approximately 4.60. In addition, in certain embodiments, a ratio of the outer diameter $OD_{IVI}$ at the inlet end 88 of the inlet venturi 58 relative to the inner diameter $ID_{IVI}$ at the inlet end 88 of the inlet venturi 58 may be within a range of approximately 1.04 to approximately 1.32, may be within a range of approximately 1.08 to approximately 1.28, may be within a range of approximately 1.12 to approximately 1.24, or may be within a range of approximately 1.16 to approximately 1.20. In addition, in certain embodiments, a ratio of the outer diameter $OD_{IVI}$ at the inlet end 88 of the inlet venturi 58 relative to the outer diameter $OD_{IVD}$ at the discharge end 90 of the inlet venturi 58 may be within a range of approximately 1.21 to approximately 1.50, may be within a range of approximately 1.25 to approximately 1.46, may be within a range of approximately 1.29 to approximately 1.42, or may be within a range of approximately 1.33 to approximately 1.38.

In addition, in certain embodiments, a ratio of the outer diameter $OD_{IVI}$ at the inlet end 88 of the inlet venturi 58 relative to the axial length $L_{OH}$ of the outer housing 12 may be within a range of approximately 0.62 to approximately 0.71, may be within a range of approximately 0.63 to approximately 0.70, may be within a range of approximately 0.64 to approximately 0.69, or may be within a range of approximately 0.65 to approximately 0.68. It is noted that, in certain embodiments, the outer diameter $OD_{IVI}$ at the inlet end 88 of the inlet venturi 58 may be substantially similar to the outer diameter $OD_{OH}$ of the outer housing 12 of the fan system 10 such that the inlet venturi 58 and the outer housing 12 are generally flush with each other where the inlet venturi 58 and the outer housing 12 are adjacent each other.

In certain embodiments, a ratio of the throat inner diameter $ID_{IVT}$ of the inlet venturi 58 relative to the axial length $L_{IV}$ along the central longitudinal axis 54 of the inlet venturi 58 may be within a range of approximately 2.60 to approximately 3.60, may be within a range of approximately 2.70 to approximately 3.50, may be within a range of approximately 2.80 to approximately 3.40, or may be within a range of approximately 2.90 to approximately 3.30. In addition, in certain embodiments, a ratio of the throat inner diameter $ID_{IVT}$ of the inlet venturi 58 relative to the inner diameter $ID_{IVI}$ at the inlet end 88 of the inlet venturi 58 may be within a range of approximately 0.73 to approximately 0.92, may be within a range of approximately 0.76 to approximately 0.89, may be within a range of approximately 0.79 to approximately 0.86, or may be within a range of approximately 0.81 to approximately 0.84. In addition, in certain embodiments, a ratio of the throat inner diameter $ID_{IVT}$ of the inlet venturi 58 relative to the outer diameter $OD_{IVI}$ at the discharge end 90 of the inlet venturi 58 may be within a range of approximately 0.92 to approximately 0.99, may be within a range of approximately 0.93 to approximately 0.98, may be within a range of approximately 0.94 to approximately 0.97, or may be within a range of approximately 0.95 to approximately 0.96.

In addition, in certain embodiments, a ratio of the throat inner diameter $ID_{IVT}$ of the inlet venturi 58 relative to the outer diameter $OD_{OH}$ of the outer housing 12 of the fan system 10 may be within a range of approximately 0.66 to approximately 0.74, may be within a range of approximately 0.67 to approximately 0.73, may be within a range of approximately 0.68 to approximately 0.72, or may be within a range of approximately 0.69 to approximately 0.71. In addition, in certain embodiments, a ratio of the throat inner diameter $ID_{IVT}$ of the inlet venturi 58 relative to the axial length $L_{OH}$ of the outer housing 12 may be within a range of approximately 0.43 to approximately 0.51, may be within a range of approximately 0.44 to approximately 0.50, may be within a range of approximately 0.45 to approximately 0.49, or may be within a range of approximately 0.46 to approximately 0.48.

Figure 13:
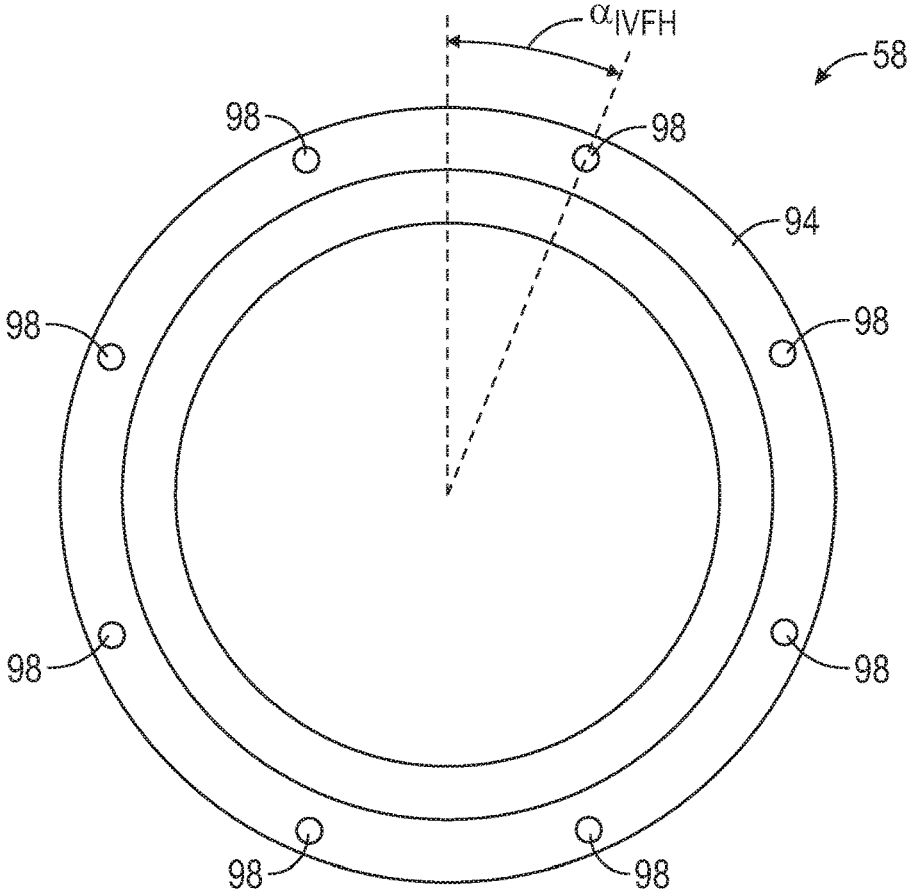
FIG. 13 is an axial view of an inlet venturi of the inline centrifugal mixed flow fan system, in accordance with an aspect of the present disclosure.

As illustrated in FIG. 13, in certain embodiments, the flange 94 the inlet venturi 58 may include a plurality of holes 98 disposed circumferentially around a periphery of the flange 94. In general, the plurality of holes 98 may be configured to physically couple to an inlet screen 96. In certain embodiments, the plurality of holes 98 may be disposed circumferentially around the periphery of the flange 94 at constant angles from each other around the periphery of the flange 94. Any number of holes 98 may be used, in certain embodiments. For example, although illustrated in FIG. 13 as including eight holes 98 disposed 45 degrees apart from each other around the periphery of the flange 94, in other embodiments, four holes 98 may be used and may be disposed 90 degrees apart from each other around the periphery of the flange 94, six holes 98 may be used and may be disposed 60 degrees from each around the periphery of the flange 94, and so forth. As illustrated in FIG. 13, an angle $\alpha_{IVFH}$ may be defined as half of the angle between successive holes 98 around the periphery of the flange 94.

Figure 14:
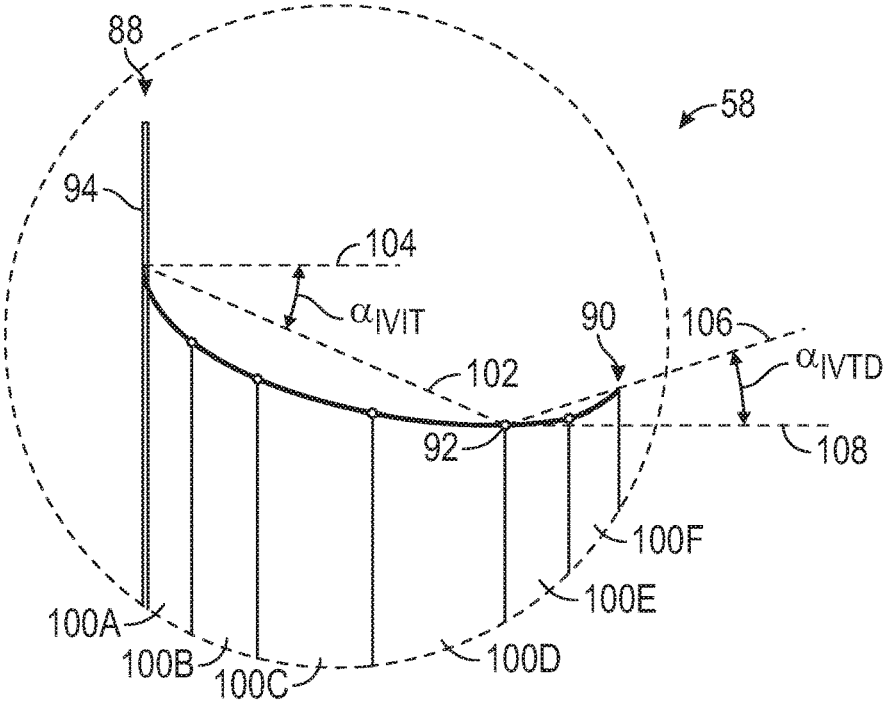
FIG. 14 is a partial side view of an inlet venturi of the inline centrifugal mixed flow fan system, in accordance with an aspect of the present disclosure.

As illustrated in FIG. 14, as discussed above, similar to the hub cone 46, in certain embodiments, the inlet venturi 58 may include a plurality of discrete inlet venturi segments 100 disposed adjacent each other axially along the central longitudinal axis 54 of the inlet venturi 58 to form the walls 86 of the inlet venturi 58. In particular, the walls 86 of the inlet venturi 58 may comprise a relatively complex spline that includes any number of inlet venturi segments 100, or tangent arches. As illustrated in FIG. 14, in certain embodiments, the inlet venturi 58 may include six inlet venturi segments 100. However, in other embodiments, the inlet venturi 58 may include any number of inlet venturi segments 100, such as between three and twelve inlet venturi segments 100, in certain embodiments.

In certain embodiments, the radii of curvature of the inlet venturi segments 100 of the inlet venturi 58 may vary from a first inlet venturi segment 100A at the inlet end 88 of the inlet venturi 58 to a last inlet venturi segment 100F at the discharge end 90 of the inlet venturi 58. For example, in certain embodiments, the radii of curvature from the first inlet venturi segment 100A at the inlet end 88 of the inlet venturi 58 to the last inlet venturi segment 100F at the discharge end 90 of the inlet venturi 58 may gradually increase from the first inlet venturi segment 100A to a maximum radius of curvature, for example, between adjacent inlet venturi segments 100 at the throat 92 of the inlet venturi 58, and then gradually decrease to the last inlet venturi segment 100F. It is noted that, unlike the convex hub cone segments 74 of the hub cone 46, the inlet venturi segments 100 of the inlet venturi 58 are instead concave in shape.

As also illustrated in FIG. 14, in certain embodiments, certain angles exist between the inlet end 88 of the inlet venturi 58 to the throat 92 of the inlet venturi 58, and between the throat 92 of the inlet venturi 58 and the discharge end 90 of the inlet venturi 58. For example, in certain embodiments, an inlet venturi inlet-throat angle $\alpha_{IVIT}$, which may be defined as an angle between a first line 102 from the inner diameter $ID_{IVI}$ at the inlet end 88 of the inlet venturi 58 to the throat 92 of the inlet venturi 58 relative to a second line 104 parallel to the central longitudinal axis 54, may be within a range of approximately 20 degrees to approximately 30 degrees, may be within a range of approximately 21 degrees to approximately 29 degrees, or may be within a range of approximately 22 degrees to approximately 28 degrees. In addition, in certain embodiments, an inlet venturi throat-discharge angle $\alpha_{IVTD}$, which may be defined as an angle between a first line 106 from the throat 92 of the inlet venturi 58 to the outer diameter $OD_{IVD}$ at the discharge end 90 of the inlet venturi 58 relative to a second line 108 parallel to the central longitudinal axis 54, may be within a range of approximately 15 degrees to approximately 25 degrees, may be within a range of approximately 16 degrees to approximately 24 degrees, or may be within a range of approximately 17 degrees to approximately 23 degrees.

Figure 16:
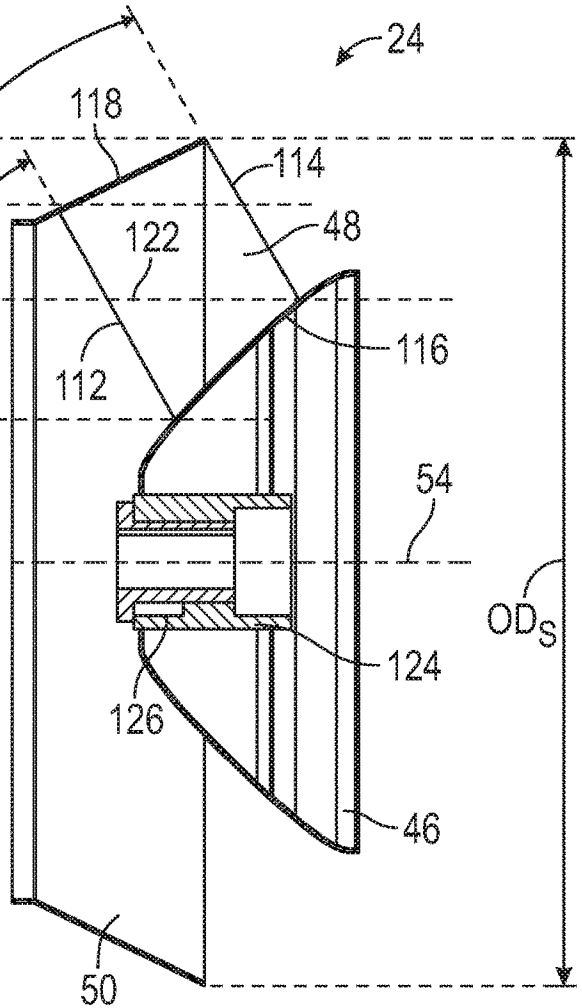
FIG. 16 is a cutaway side view of the wheel assembly of the inline centrifugal mixed flow fan system, in accordance with an aspect of the present disclosure.
Figure 15:
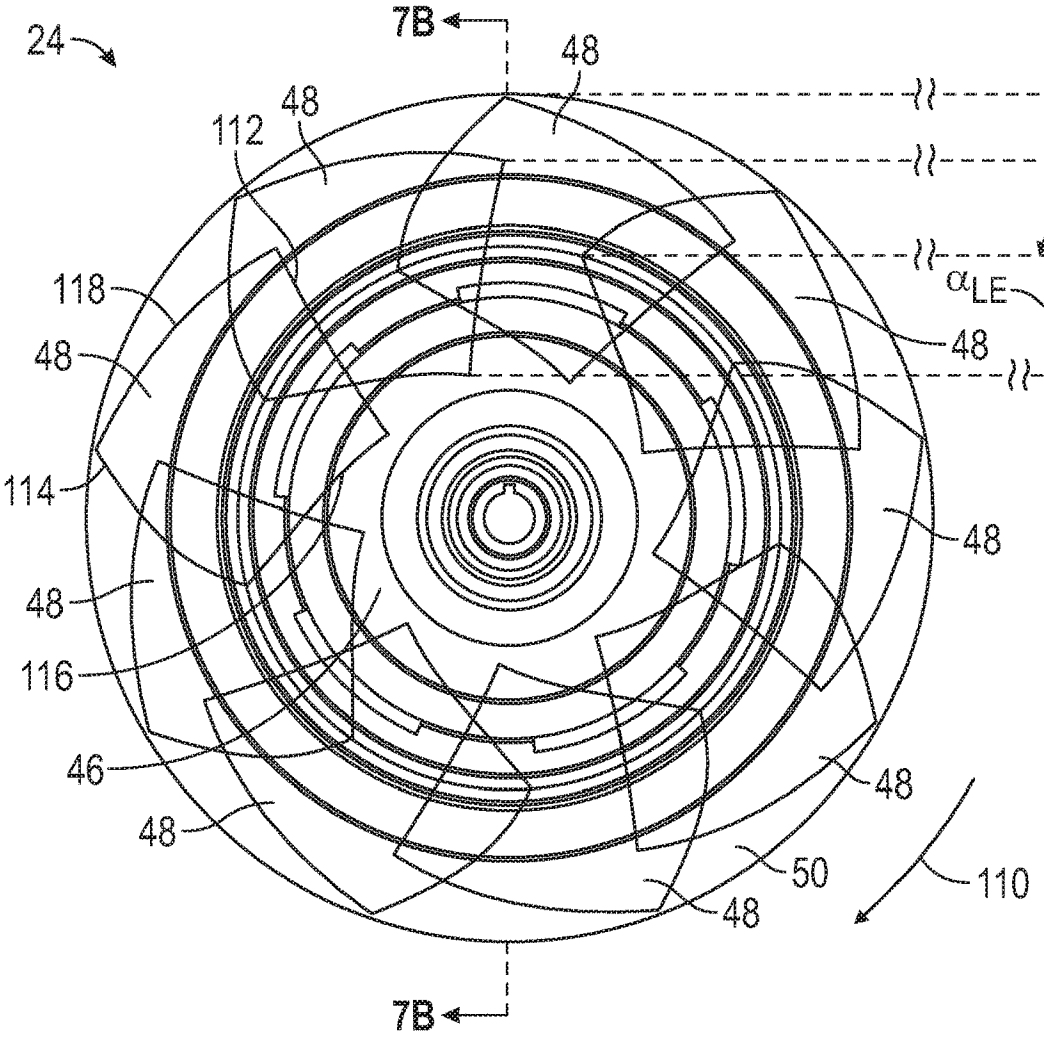
FIG. 15 is a transparent axial view of the wheel assembly of the inline centrifugal mixed flow fan system, in accordance with an aspect of the present disclosure.

As described herein, the plurality of fan blades 48 of the wheel assembly 24 are directly coupled to both the hub cone 46 and the shroud 50 such that the hub cone 46, the plurality of fan blades 48, and the shroud 50 form an integrated wheel when assembled together. FIGS. 15 and 16 are a transparent axial view and a cutaway side view, respectively, of the wheel assembly 24 of the inline centrifugal mixed flow fan system 10, in accordance with an aspect of the present disclosure. As illustrated, in certain embodiments, the wheel assembly 24 may include nine fan blades 48 disposed circumferentially equiangular from each other, for example, spaced approximately 40 degrees apart from each other circumferentially, about the central longitudinal axis 54 of the wheel assembly 24 at least partially radially between the hub cone 46 and the shroud 50. However, in other embodiments, the wheel assembly 24 may include any number of fan blades 48, for example, six, eight, ten, twelve, and so forth, that are disposed circumferentially equiangular from each other about the central longitudinal axis 54.

As illustrated in FIG. 15, when in operation, the fan blades 48 of the wheel assembly 24 rotate about the central longitudinal axis 54 in the direction illustrated by arrow 110. As such, each of the plurality of fan blades 48 include a leading edge 112 and a trailing edge 114, a hub cone edge 116 that extends from the leading edge 112 to the trailing edge 114 and is directly coupled to the hub cone 46, and a shroud edge 118 that extends from the leading edge 112 to the trailing edge 114 and is directly coupled to the shroud 50. As illustrated in FIG. 16, in certain embodiments, an angle $\alpha_{LE}$, for example, relative to a line 120 parallel to the central longitudinal axis 54, of the leading edge 112 of each of the plurality of fan blades 48 may be within a range of approximately 61 degrees to approximately 69 degrees, may be within a range of approximately 62 degrees to approximately 68 degrees, may be within a range of approximately 63 degrees to approximately 67 degrees, or may be within a range of approximately 64 degrees to approximately 66 degrees. In addition, in certain embodiments, an angle $\alpha_{TE}$, for example, relative to a line 122 parallel to the central longitudinal axis 54, of the trailing edge 114 of each of the plurality of fan blades 48 may be within a range of approximately 50 degrees to approximately 58 degrees, may be within a range of approximately 51 degrees to approximately 57 degrees, may be within a range of approximately 52 degrees to approximately 56 degrees, or may be within a range of approximately 53 degrees to approximately 55 degrees.

As also illustrated in FIG. 16, in certain embodiments, in addition to the hub cone 46, the plurality of fan blades 48, and the shroud 50, the wheel assembly 24 may also include a hub 124 that is configured to directly couple to both the drive shaft 42 and the hub cone 46 to facilitate the drive shaft 42 causing rotation of the wheel assembly 24. In certain embodiments, one or more locking mechanisms 126, such as lock rings, lock pins, and so forth, may be used to lock the hub 124 and, in turn, the wheel assembly 24 into position axially and/or or circumferentially with respect to the drive shaft 42, thereby facilitating the rotation.

Figure 17:
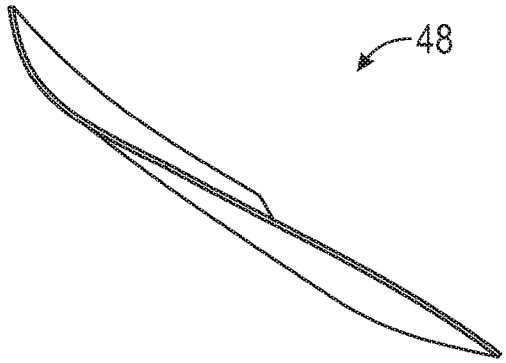
FIG. 17 is a perspective view of one of a plurality of fan blades of the wheel assembly of the inline centrifugal mixed flow fan system, in accordance with an aspect of the present disclosure.
Figure 18:
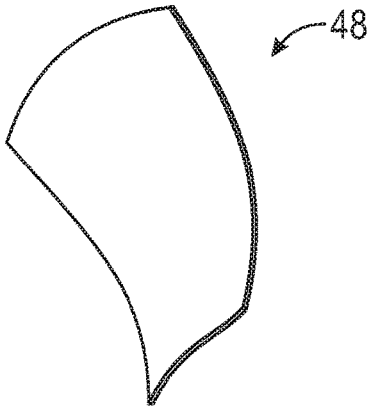
FIG. 18 is a perspective view of one of a plurality of fan blades of the wheel assembly of the inline centrifugal mixed flow fan system, in accordance with an aspect of the present disclosure.
Figure 19:
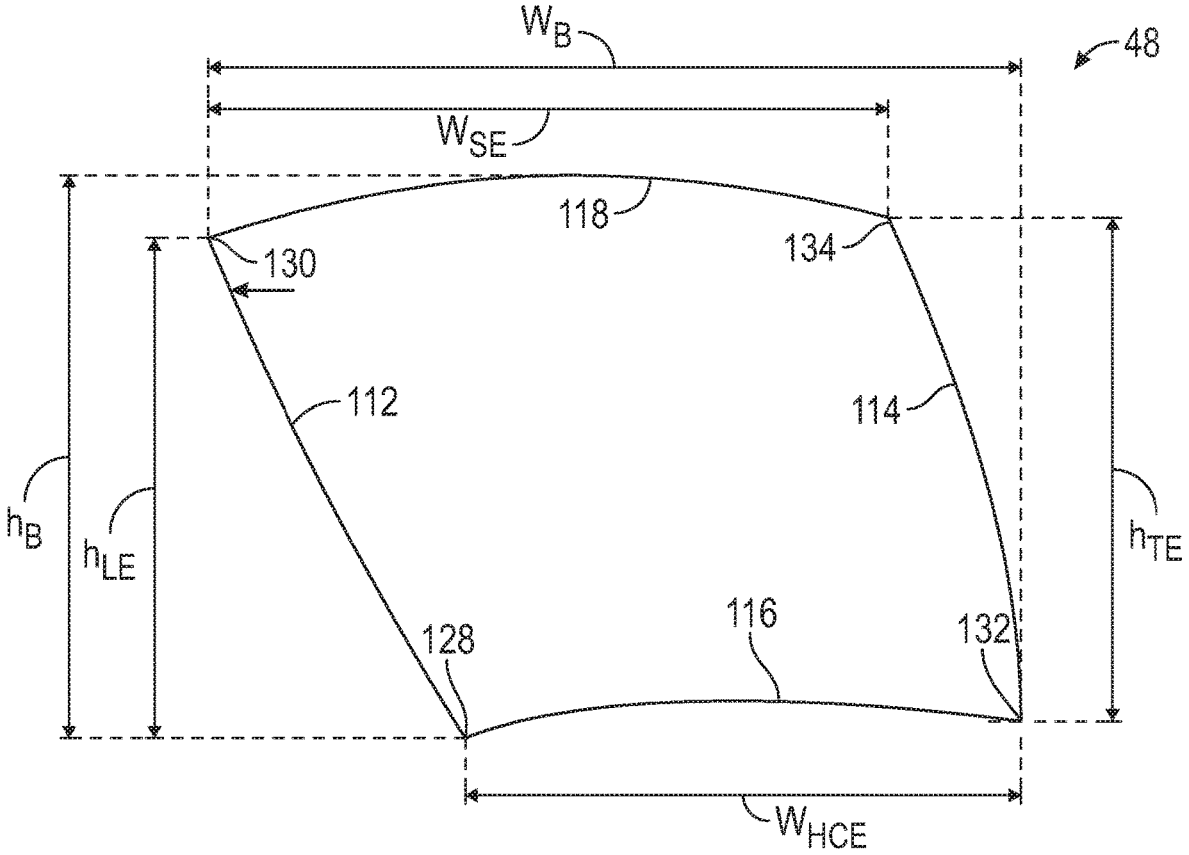
FIG. 19 is a side view of one of a plurality of fan blades of the wheel assembly of the inline centrifugal mixed flow fan system, in accordance with an aspect of the present disclosure.

FIGS. 17, 18, and 19 are two perspective views and a side view, respectively, of one of the plurality of fan blades 48 of the wheel assembly 24 of the inline centrifugal mixed flow fan system 10, in accordance with an aspect of the present disclosure. As illustrated in FIG. 19, when viewed from the side, in certain embodiments, a ratio of a height $h_{LE}$ of the leading edge 112 of the fan blade 48, for example, from a leading hub cone-blade intersection point 128 to a leading shroud-blade intersection point 130, relative to a total height $h_B$ of the fan blade 48 may be within a range of approximately 0.85 to approximately 0.92, may be within a range of approximately 0.86 to approximately 0.91, may be within a range of approximately 0.87 to approximately 0.90, or may be within a range of approximately 0.88 to approximately 0.89. In addition, in certain embodiments, a ratio of a height $h_{TE}$ of the trailing edge 114 of the fan blade 48, for example, from a trailing hub cone-blade intersection point 132 to a trailing shroud-blade intersection point 134, relative to the total height $h_B$ of the fan blade 48 may be within a range of approximately 0.85 to approximately 0.93, may be within a range of approximately 0.86 to approximately 0.92, may be within a range of approximately 0.87 to approximately 0.91, or may be within a range of approximately 0.88 to approximately 0.90. In addition, in certain embodiments, a ratio of the height $h_{LE}$ of the leading edge 112 of the fan blade 48, for example, from the leading hub cone-blade intersection point 128 to the leading shroud-blade intersection point 130, relative to the height $h_{TE}$ of the trailing edge 114 of the fan blade 48, for example, from the trailing hub cone-blade intersection point 132 to the trailing shroud-blade intersection point 134, may be within a range of approximately 0.96 to approximately 1.01, may be within a range of approximately 0.97 to approximately 1.00, or may be within a range of approximately 0.98 to approximately 0.99.

In addition, in certain embodiments, a ratio of a width $w_{HCE}$ of the hub cone edge 116 of the fan blade 48, for example, from the leading hub cone-blade intersection point 128 to the trailing hub cone-blade intersection point 132, relative to a total width $w_B$ of the fan blade 48 may be within a range of approximately 0.64 to approximately 0.72, may be within a range of approximately 0.65 to approximately 0.71, may be within a range of approximately 0.66 to approximately 0.70, or may be within a range of approximately 0.67 to approximately 0.69. In addition, in certain embodiments, a ratio of a width $w_{SE}$ of the shroud edge 118 of the fan blade 48, for example, from the leading shroud-blade intersection point 130 to the trailing shroud-blade intersection point 134, relative to the total width $w_B$ of the fan blade 48 may be within a range of approximately 0.80 to approximately 0.88, may be within a range of approximately 0.81 to approximately 0.87, may be within a range of approximately 0.82 to approximately 0.86, or may be within a range of approximately 0.83 to approximately 0.85.

Figure 20:
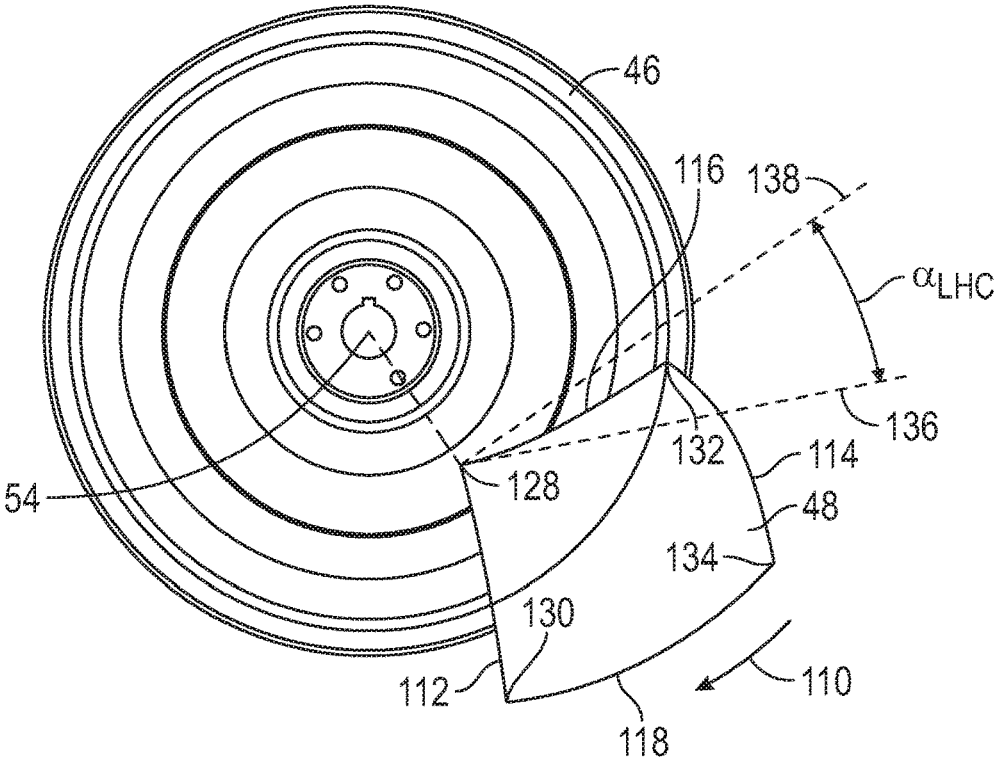
FIG. 20 is an axial view of the inline centrifugal mixed flow fan system, in accordance with an aspect of the present disclosure.

FIGS. 20 through 23 are a series of an axial view of the hub cone 46 and one of the plurality of fan blades 48 of the wheel assembly 24 of the inline centrifugal mixed flow fan system 10, in accordance with an aspect of the present disclosure. In particular, only one of the plurality of fan blades 48 are illustrated for clarity purposes. As illustrated in FIG. 20, in certain embodiments, an angle $\alpha_{LHC}$, for example, in a plane perpendicular to the central longitudinal axis 54, such as illustrated in FIG. 20, between a line 136 along the hub cone edge 116 at the leading hub cone-blade intersection point 128 relative to a line 138 indicative of the direction of rotation 110 of the hub cone 46, for example, in the plane perpendicular to the central longitudinal axis 54, such as illustrated in FIG. 20, at the leading hub cone-blade intersection point 128 may be within a range of approximately 20 degrees to approximately 27 degrees, may be within a range of approximately 21 degrees to approximately 26 degrees, may be within a range of approximately 22 degrees to approximately 25 degrees, or may be within a range of approximately 23 degrees to approximately 24 degrees.

Figure 21:
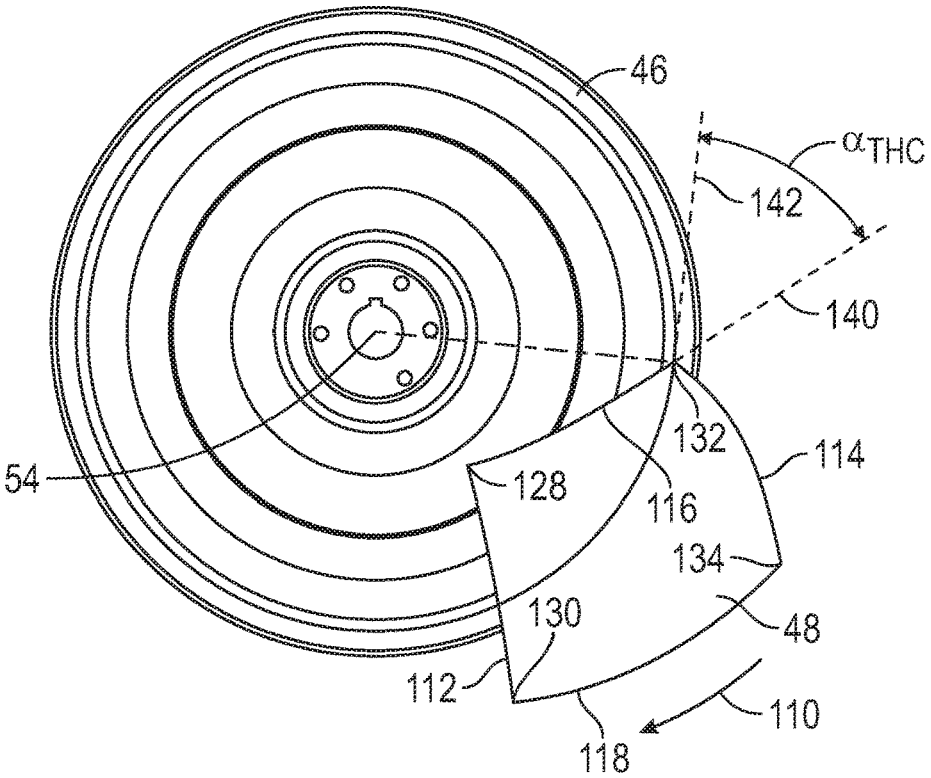
FIG. 21 is an axial view of the inline centrifugal mixed flow fan system, in accordance with an aspect of the present disclosure.

As illustrated in FIG. 21, in certain embodiments, an angle $\alpha_{THC}$, for example, in a plane perpendicular to the central longitudinal axis 54, such as illustrated in FIG. 21, between a line 140 along the hub cone edge 116 at the trailing hub cone-blade intersection point 132 relative to a line 142 indicative of the direction of rotation 110 of the hub cone 46, for example, in the plane perpendicular to the central longitudinal axis 54, such as illustrated in FIG. 21, at the trailing hub cone-blade intersection point 132 may be within a range of approximately 47 degrees to approximately 54 degrees, may be within a range of approximately 48 degrees to approximately 53 degrees, may be within a range of approximately 49 degrees to approximately 52 degrees, or may be within a range of approximately 50 degrees to approximately 51 degrees.

Figure 22:
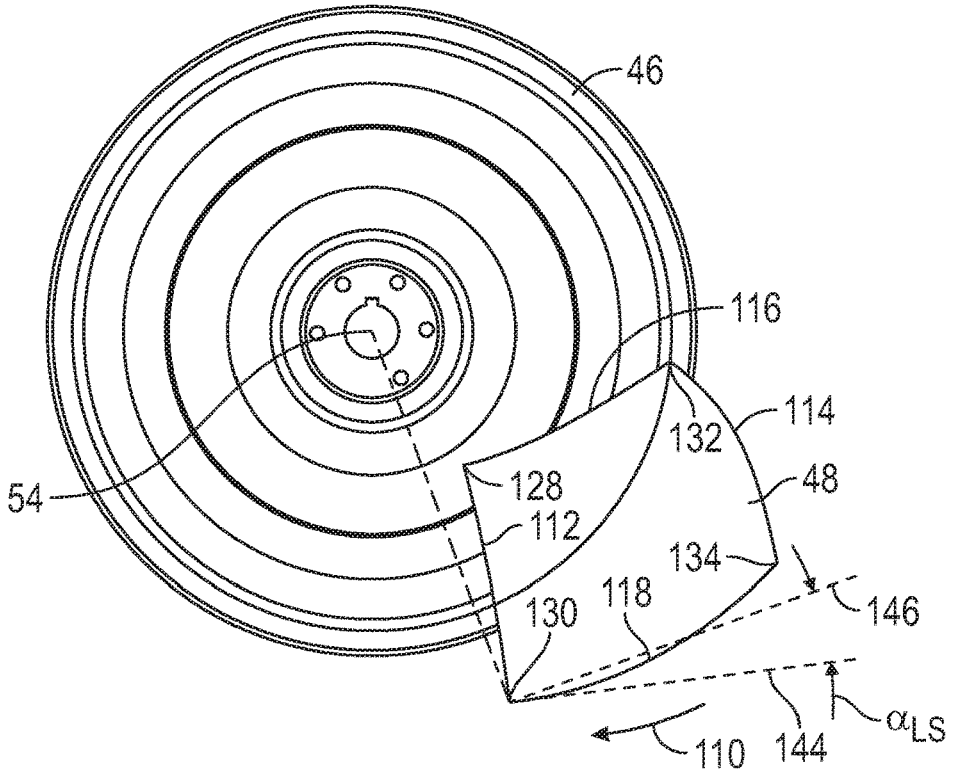
FIG. 22 is an axial view of the inline centrifugal mixed flow fan system, in accordance with an aspect of the present disclosure.

As illustrated in FIG. 22, in certain embodiments, an angle $\alpha_{LS}$, for example, in a plane perpendicular to the central longitudinal axis 54, such as illustrated in FIG. 22, between a line 144 along the shroud edge 118 at the leading shroud-blade intersection point 130 relative to a line 146 indicative of the direction of rotation 110 of the shroud 50, for example, in the plane perpendicular to the central longitudinal axis 54, such as illustrated in FIG. 22, at the leading shroud-blade intersection point 130 may be within a range of approximately 10 degrees to approximately 17 degrees, may be within a range of approximately 11 degrees to approximately 16 degrees, may be within a range of approximately 12 degrees to approximately 15 degrees, or may be within a range of approximately 13 degrees to approximately 14 degrees.

Figure 23:
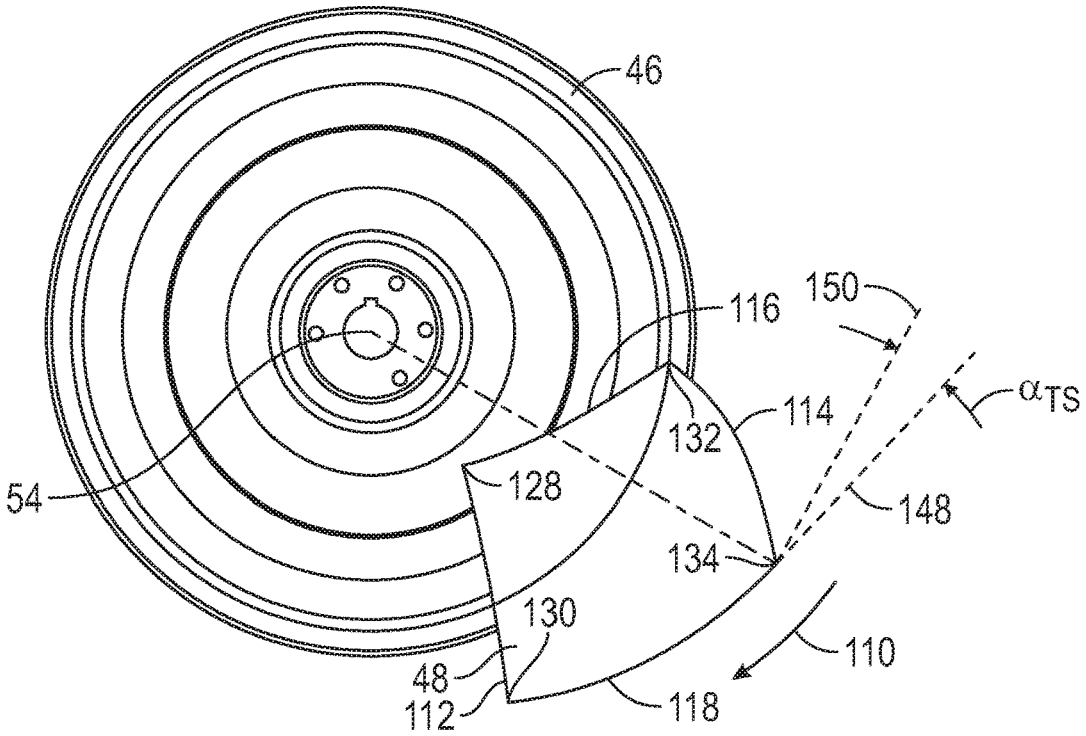
FIG. 23 is an axial view of the inline centrifugal mixed flow fan system, in accordance with an aspect of the present disclosure.

As illustrated in FIG. 23, in certain embodiments, an angle $\alpha_{TS}$, for example, in a plane perpendicular to the central longitudinal axis 54, such as illustrated in FIG. 23, between a line 148 along the shroud edge 118 at the trailing shroud-blade intersection point 134 relative to a line 150 indicative of the direction of rotation 110 of the shroud 50, for example, in the plane perpendicular to the central longitudinal axis 54, such as illustrated in FIG. 23, at the trailing shroud-blade intersection point 134 may be within a range of approximately 11 degrees to approximately 18 degrees, may be within a range of approximately 12 degrees to approximately 17 degrees, may be within a range of approximately 13 degrees to approximately 16 degrees, or may be within a range of approximately 14 degrees to approximately 15 degrees.

Figure 24:
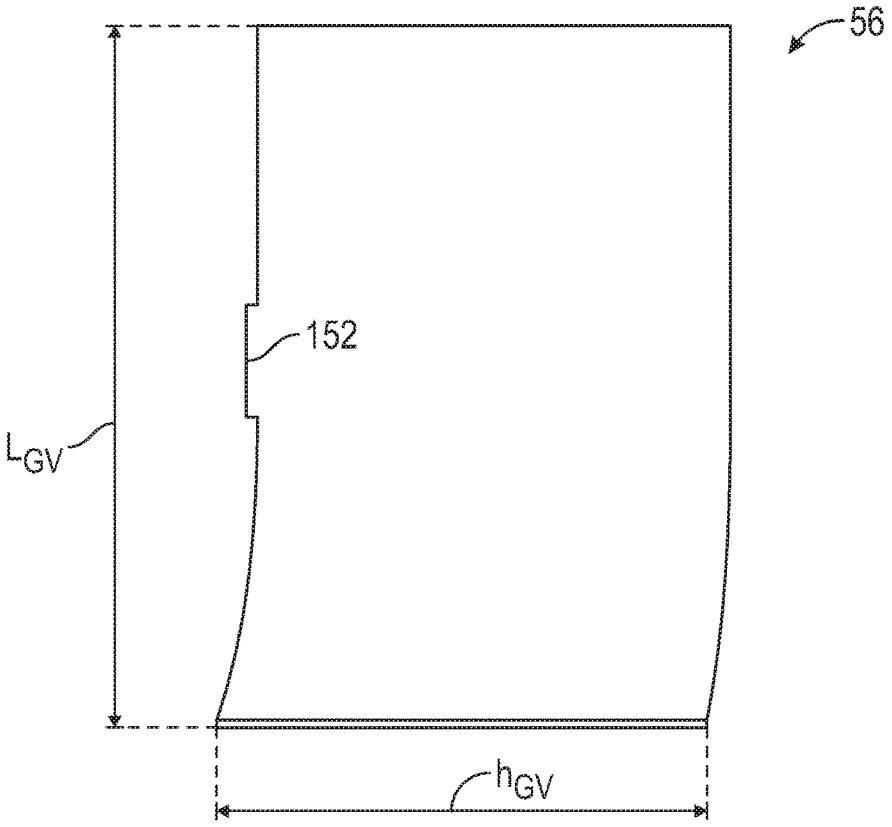
FIG. 24 is a side view of one of the plurality of guide vanes of the inline centrifugal mixed flow fan system, in accordance with an aspect of the present disclosure.
Figure 25:
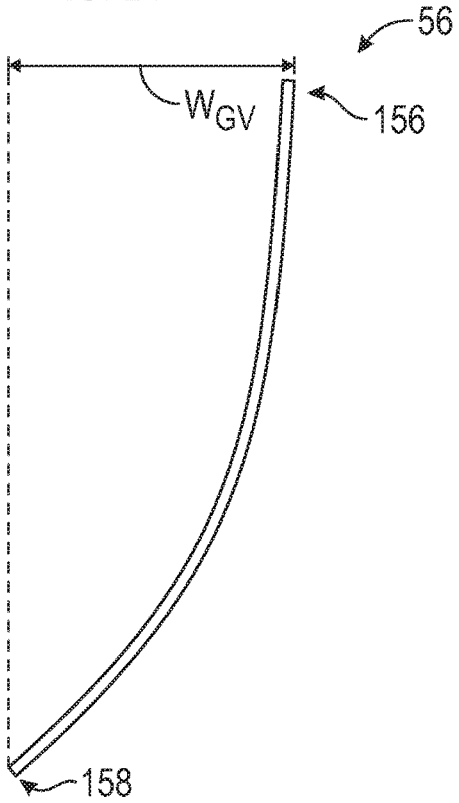
FIG. 25 is a side view of one of the plurality of guide vanes of the inline centrifugal mixed flow fan system, in accordance with an aspect of the present disclosure.

FIGS. 24 and 25 are side views of one of the plurality of guide vanes 56 of the inline centrifugal mixed flow fan system 10, in accordance with an aspect of the present disclosure. As illustrated in FIG. 24, in certain embodiments, each guide vane 56 is a single piece that includes a single tab 152 that is configured to be inserted into a respective slot 154 in the bearing tunnel 32 to align the guide vane 56 with the other guide vanes 56 along the circumference of the bearing tunnel 32. In addition, as illustrated in FIG. 25, in certain embodiments, each guide vane 56 is generally parallel to the central longitudinal axis 54 of the fan system 10 at a discharge, or downstream, end 156 of the guide vane 56, but is curved near an inlet, or upstream, end 158 of the guide vane 56. As such, the inlet end 158 of the guide vane 56 may contact the air flow 52 downstream of the wheel assembly 24 first, and the curved nature of the guide vane 56 may generally "straighten", for example, generally counteract radial and circumferential movement of, the air flow 52 to travel substantially axially, for example, generally parallel to the central longitudinal axis 54, out through the discharge end 16 of the fan system 10.

As illustrated, in certain embodiments, a ratio of a height $h_{GV}$ of the guide vane 56 relative to a length $L_{GV}$ of the guide vane 56 may be within a range of approximately 0.66 to approximately 0.77, may be within a range of approximately 0.68 to approximately 0.79, may be within a range of approximately 0.70 to approximately 0.77, or may be within a range of approximately 0.72 to approximately 0.75. In addition, in certain embodiments, a ratio of a width $w_{GV}$ of the guide vane 56 relative to the length $L_{GV}$ of the guide vane 56 may be within a range of approximately 0.33 to approximately 0.49, may be within a range of approximately 0.35 to approximately 0.47, may be within a range of approximately 0.37 to approximately 0.45, or may be within a range of approximately 0.39 to approximately 0.43. In addition, in certain embodiments, a ratio of the width $w_{GV}$ of the guide vane 56 relative to the height $h_{GV}$ of the guide vane 56 may be within a range of approximately 0.48 to approximately 0.63, may be within a range of approximately 0.50 to approximately 0.61, may be within a range of approximately 0.52 to approximately 0.59, or may be within a range of approximately 0.54 to approximately 0.57.

As described above, the dimensions of the inline centrifugal mixed flow fan system 10 described herein have been specifically designed to improve certain performance parameters of the inline centrifugal mixed flow fan system 10 as compared to conventional fan systems, such as conventional centrifugal fan systems and axial fan systems. In particular, the relatively compact and lightweight design of the inline centrifugal mixed flow fan system 10 described herein combines the relatively higher volume advantage of axial fan systems with the relatively lower sound and relatively higher efficiency of centrifugal fan systems. Tables 1A through 17C provide performance parameters for various models of various sizes of the inline centrifugal mixed flow fan system 10 described herein. In particular, Tables 1A through 17A provide air performance data for seventeen models, Model 1 through Model 17, Tables 1B through 17B provide inlet sound performance data for the seventeen models, and Tables 1C through 17C provide outlet sound performance data for the seventeen models.

In particular, Tables 1A through 17A provide rotational speeds (revolutions per minute, or RPM) of the wheel assembly 24, and brake horsepower (BHP), of the inline centrifugal mixed flow fan system 10 at various static pressures (SP), for example, 0.5" through 4.25" in Table 1A, and various air flow rates (cubic feet per minute, or CFM), which directly relate to outlet velocities (OV) as measured in feet/minute, for the seventeen models. In addition, Tables 1B through 17B provide inlet sound power levels (Lwi), as measured in decibels (dB), of the inline centrifugal mixed flow fan system 10 by octave bands, for example, 63 Hz through 8000 Hz in Table 1B, at various rotational speeds (revolutions per minute, or RPM) of the wheel assembly 24 of the inline centrifugal mixed flow fan system 10 and nominal pressures (Ps), as measured in inches. In addition, for each combination of rotational speed (RPM) and nominal pressure (Ps), the weighted average of the inlet sound power levels (LwiA) is provided. Similarly, Tables 1C through 17C provide outlet sound power levels (Lwi), as measured in decibels (dB), of the inline centrifugal mixed flow fan system 10 by octave bands, for example, 63 Hz through 8000 Hz in Table 1C, at various rotational speeds (revolutions per minute, or RPM) of the wheel assembly 24 of the inline centrifugal mixed flow fan system 10 and nominal pressures (Ps), as measured in inches. In addition, for each combination of rotational speed (RPM) and nominal pressure (Ps), the weighted average of the outlet sound power levels (LwiA) is provided.

For each of the air performance tables, for example, Tables 1A through 17A, any and all values for static pressure (SP) and air flow rate (cubic feet per minute, or CFM), and associated outlet velocity (OV), may serve as endpoints for performance ranges that encompass the minimum and maximum values for rotational speed (revolutions per minute, or RPM) of the wheel assembly 24, and brake horsepower (BHP), of the inline centrifugal mixed flow fan system 10 that are included between these endpoints. For example, as presented in Table 1A, rotational speed of the wheel assembly 24 of the inline centrifugal mixed flow fan system 10 for Model 1 may be between 1758 RPM and 2441 RPM for static pressures between 1" and 2" and for air flow rates between 2050 CFM and 2800 CFM, and for associated outlet velocities between 1208 feet/minute and 1650 feet/minute. Similarly, as also illustrated in Table 1A, brake horsepower of the inline centrifugal mixed flow fan system 10 for Model 1 may be between 0.57 BHP and 1.53 BHP for static pressures between 1" and 2" and for air flow rates between 2050 CFM and 2800 CFM, and for associated outlet velocities between 1208 feet/minute and 1650 feet/minute.

In addition, for each of the inlet sound performance tables, for example, Tables 1B through 17B, any and all values for octave band, rotational speed (revolutions per minute, or RPM) of the wheel assembly 24 of the inline centrifugal mixed flow fan system 10, and nominal pressure (Ps) may serve as endpoints for performance ranges that encompass the minimum and maximum values for inlet sound power level (Lwi), as measured in decibels (dB), of the inline centrifugal mixed flow fan system 10 that are included between these endpoints. For example, as presented in Table 1B, inlet sound power level (Lwi) of the inline centrifugal mixed flow fan system 10 for Model 1 may be between 50 dB and 73 dB for octave bands between 2000 Hz and 4000 Hz, rotational speeds of the wheel assembly 24 of the inline centrifugal mixed flow fan system 10 between 1000 RPM and 1500 RPM, and nominal pressures between 0.0 and 1.0 inches. Similarly, as also presented in Table 1B, weighted average of the inlet sound power level (LwiA) of the inline centrifugal mixed flow fan system 10 for Model 1 may be between 67 dB and 80 dB for rotational speeds of the wheel assembly 24 of the inline centrifugal mixed flow fan system 10 between 1000 RPM and 1500 RPM, and nominal pressures between 0.0 and 1.0 inches.

In addition, for each of the outlet sound performance tables, for example, Tables 1C through 17C, any and all values for octave band, rotational speed (revolutions per minute, or RPM) of the wheel assembly 24 of the inline centrifugal mixed flow fan system 10, and nominal pressure (Ps) may serve as endpoints for performance ranges that encompass the minimum and maximum values for outlet sound power level (Lwo), as measured in decibels (dB), of the inline centrifugal mixed flow fan system 10 that are included between these endpoints. For example, as presented in Table 1C, outlet sound power level (Lwo) of the inline centrifugal mixed flow fan system 10 for Model 1 may be between 50 dB and 74 dB for octave bands between 2000 Hz and 4000 Hz, rotational speeds of the wheel assembly 24 of the inline centrifugal mixed flow fan system 10 between 1000 RPM and 1500 RPM, and nominal pressures between 0.0 and 1.0 inches. Similarly, as also presented in Table 1C, weighted average of the outlet sound power level (LwoA) of the inline centrifugal mixed flow fan system 10 for Model 1 may be between 66 dB and 81 dB for rotational speeds of the wheel assembly 24 of the inline centrifugal mixed flow fan system 10 between 1000 RPM and 1500 RPM, and nominal pressures between 0.0 and 1.0 inches.

TABLE 1A

Model 1 Air Performance

| | | 0.5"SP | | 1"SP | | 1.5"SP | | 2"SP | | 2.5"SP | | 3"SP | | 3.5"SP | | 4"SP | | 4.25"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 1300 | 766 | 1178 | 0.17 | 1474 | 0.34 | 1747 | 0.55 | | | | | | | | | | | | |
| 1425 | 840 | 1232 | 0.20 | 1510 | 0.37 | 1759 | 0.57 | | | | | | | | | | | | |
| 1550 | 913 | 1288 | 0.22 | 1553 | 0.41 | 1794 | 0.61 | 2020 | 0.85 | | | | | | | | | | |
| 1675 | 987 | 1346 | 0.25 | 1601 | 0.44 | 1829 | 0.66 | 2039 | 0.89 | 2255 | 1.18 | | | | | | | | |
| 1800 | 1061 | 1405 | 0.28 | 1651 | 0.48 | 1865 | 0.70 | 2074 | 0.95 | 2262 | 1.21 | 2469 | 1.54 | | | | | | |
| 1925 | 1134 | 1465 | 0.31 | 1702 | 0.52 | 1912 | 0.76 | 2110 | 1.01 | 2294 | 1.27 | 2476 | 1.58 | | | | | | |
| 2050 | 1208 | 1525 | 0.35 | 1758 | 0.57 | 1961 | 0.81 | 2145 | 1.07 | 2330 | 1.35 | 2497 | 1.64 | 2672 | 1.97 | | | | |
| 2175 | 1282 | 1593 | 0.39 | 1814 | 0.62 | 2010 | 0.87 | 2189 | 1.14 | 2365 | 1.42 | 2532 | 1.72 | 2686 | 2.03 | 2856 | 2.41 | 2940 | 2.61 |
| 2300 | 1355 | 1664 | 0.44 | 1872 | 0.67 | 2061 | 0.93 | 2238 | 1.21 | 2401 | 1.50 | 2567 | 1.81 | 2721 | 2.13 | 2865 | 2.46 | 2947 | 2.66 |
| 2425 | 1429 | 1736 | 0.49 | 1930 | 0.73 | 2114 | 0.99 | 2287 | 1.28 | 2445 | 1.58 | 2603 | 1.90 | 2756 | 2.23 | 2899 | 2.57 | 2968 | 2.74 |
| 2550 | 1503 | 1808 | 0.55 | 1989 | 0.79 | 2170 | 1.06 | 2337 | 1.36 | 2494 | 1.67 | 2639 | 2.00 | 2792 | 2.33 | 2935 | 2.68 | 3003 | 2.86 |
| 2675 | 1576 | 1881 | 0.61 | 2049 | 0.85 | 2227 | 1.14 | 2387 | 1.44 | 2543 | 1.76 | 2686 | 2.10 | 2828 | 2.44 | 2970 | 2.80 | | |
| 2800 | 1650 | 1954 | 0.68 | 2109 | 0.92 | 2285 | 1.22 | 2441 | 1.53 | 2592 | 1.86 | 2734 | 2.20 | 2867 | 2.56 | 3006 | 2.93 | | |
| 2925 | 1723 | 2027 | 0.75 | 2170 | 1.00 | 2343 | 1.30 | 2497 | 1.62 | 2642 | 1.96 | 2783 | 2.31 | 2915 | 2.68 | | | | |
| 3050 | 1797 | 2101 | 0.83 | 2239 | 1.08 | 2401 | 1.39 | 2554 | 1.72 | 2694 | 2.07 | 2833 | 2.43 | 2963 | 2.80 | | | | |
| 3175 | 1871 | 2176 | 0.92 | 2309 | 1.18 | 2461 | 1.48 | 2611 | 1.82 | 2749 | 2.18 | 2883 | 2.55 | 3012 | 2.93 | | | | |
| 3300 | 1944 | 2251 | 1.01 | 2381 | 1.28 | 2520 | 1.58 | 2669 | 1.93 | 2806 | 2.30 | 2933 | 2.67 | | | | | | |
| 3425 | 2018 | 2326 | 1.11 | 2452 | 1.38 | 2581 | 1.69 | 2727 | 2.05 | 2862 | 2.42 | 2988 | 2.80 | | | | | | |
| 3550 | 2092 | 2401 | 1.21 | 2524 | 1.50 | 2642 | 1.80 | 2786 | 2.17 | 2920 | 2.55 | | | | | | | | |
| 3675 | 2165 | 2476 | 1.32 | 2597 | 1.62 | 2708 | 1.92 | 2845 | 2.29 | 2977 | 2.68 | | | | | | | | |
| 3800 | 2239 | 2552 | 1.44 | 2670 | 1.75 | 2778 | 2.06 | 2905 | 2.43 | | | | | | | | | | |
| 3925 | 2313 | 2628 | 1.57 | 2743 | 1.88 | 2849 | 2.20 | 2966 | 2.57 | | | | | | | | | | |
| 4050 | 2386 | 2704 | 1.70 | 2816 | 2.02 | 2920 | 2.35 | | | | | | | | | | | | |

TABLE 1B

Model 1 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 1000 | 0.00 | 61 | 63 | 65 | 67 | 66 | 60 | 50 | 40 | 69 |
| | 0.13 | 61 | 63 | 65 | 66 | 65 | 59 | 50 | 40 | 69 |
| | 0.25 | 61 | 63 | 64 | 65 | 64 | 59 | 50 | 39 | 68 |
| | 0.38 | 61 | 62 | 63 | 64 | 63 | 59 | 50 | 39 | 67 |

TABLE 1B-continued

| Model 1 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 1500 | 0.00 | 71 | 69 | 74 | 74 | 78 | 73 | 65 | 55 | 80 |
| | 0.50 | 71 | 69 | 73 | 73 | 75 | 72 | 65 | 54 | 79 |
| | 0.75 | 71 | 69 | 73 | 72 | 73 | 71 | 65 | 54 | 77 |
| | 1.00 | 81 | 76 | 74 | 73 | 70 | 70 | 65 | 55 | 76 |
| 2000 | 0.00 | 77 | 76 | 80 | 80 | 82 | 81 | 75 | 65 | 87 |
| | 0.50 | 77 | 76 | 80 | 80 | 81 | 80 | 74 | 65 | 86 |
| | 1.00 | 77 | 76 | 79 | 79 | 80 | 79 | 74 | 65 | 85 |
| | 1.90 | 99 | 94 | 84 | 82 | 78 | 75 | 73 | 65 | 85 |
| 2500 | 0.00 | 82 | 81 | 82 | 85 | 86 | 88 | 82 | 74 | 92 |
| | 0.50 | 82 | 81 | 81 | 85 | 86 | 87 | 82 | 74 | 91 |
| | 1.50 | 82 | 81 | 81 | 84 | 84 | 85 | 81 | 73 | 90 |
| | 3.00 | 105 | 103 | 94 | 88 | 84 | 80 | 79 | 73 | 93 |
| 3000 | 0.00 | 86 | 86 | 84 | 89 | 89 | 93 | 88 | 80 | 97 |
| | 1.50 | 86 | 86 | 84 | 88 | 88 | 91 | 87 | 80 | 95 |
| | 2.50 | 86 | 86 | 84 | 88 | 88 | 90 | 87 | 80 | 94 |
| | 4.25 | 106 | 106 | 98 | 91 | 90 | 84 | 84 | 80 | 97 |

TABLE 1C

| Model 1 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 1000 | 0.00 | 71 | 70 | 66 | 68 | 67 | 60 | 50 | 40 | 70 |
| | 0.13 | 71 | 69 | 65 | 67 | 66 | 59 | 50 | 40 | 69 |
| | 0.25 | 71 | 68 | 64 | 66 | 64 | 58 | 49 | 40 | 68 |
| | 0.38 | 70 | 66 | 63 | 64 | 63 | 58 | 50 | 40 | 66 |
| 1500 | 0.00 | 81 | 79 | 72 | 76 | 78 | 74 | 64 | 55 | 81 |
| | 0.50 | 84 | 76 | 71 | 73 | 75 | 71 | 64 | 54 | 78 |
| | 0.75 | 85 | 75 | 71 | 72 | 73 | 70 | 64 | 55 | 76 |
| | 1.00 | 86 | 76 | 71 | 72 | 72 | 69 | 64 | 55 | 76 |
| 2000 | 0.00 | 87 | 86 | 81 | 81 | 83 | 82 | 75 | 65 | 87 |
| | 0.50 | 88 | 86 | 80 | 80 | 82 | 81 | 74 | 65 | 86 |
| | 1.00 | 90 | 86 | 80 | 79 | 81 | 79 | 73 | 65 | 85 |
| | 1.90 | 92 | 86 | 79 | 78 | 78 | 77 | 72 | 65 | 83 |
| 2500 | 0.00 | 92 | 91 | 88 | 87 | 88 | 88 | 83 | 73 | 93 |
| | 0.50 | 93 | 92 | 88 | 86 | 87 | 87 | 82 | 73 | 92 |
| | 1.50 | 94 | 93 | 86 | 84 | 85 | 85 | 81 | 72 | 91 |
| | 3.00 | 97 | 94 | 85 | 83 | 83 | 82 | 79 | 73 | 89 |
| 3000 | 0.00 | 96 | 96 | 94 | 91 | 91 | 93 | 89 | 79 | 98 |
| | 1.50 | 98 | 98 | 92 | 89 | 89 | 91 | 87 | 79 | 96 |
| | 2.50 | 99 | 99 | 91 | 88 | 88 | 90 | 86 | 79 | 95 |
| | 4.25 | 101 | 101 | 90 | 87 | 87 | 87 | 84 | 79 | 94 |

TABLE 2A

| Model 2 Air Performance | | | | | | | | | | | | | | | | | | | |
|---|---|---|---|---|---|---|---|---|---|---|---|---|---|---|---|---|---|---|---|
| | | 0.5"SP | | 1"SP | | 1.5"SP | | 2"SP | | 2.5"SP | | 3"SP | | 3.5"SP | | 4"SP | | 4.25"SP | |
| CFM | OV | RPM | BHP | RPM | BHP | RPM | BHP | RPM | BHP | RPM | BHP | RPM | BHP | RPM | BHP | RPM | BHP | RPM | BHP |
| 1325 | 638 | 995 | 0.17 | 1296 | 0.37 | | | | | | | | | | | | | | |
| 1500 | 722 | 1046 | 0.20 | 1321 | 0.40 | | | | | | | | | | | | | | |
| 1675 | 806 | 1099 | 0.23 | 1358 | 0.44 | 1589 | 0.68 | | | | | | | | | | | | |
| 1850 | 891 | 1158 | 0.26 | 1400 | 0.48 | 1621 | 0.73 | 1832 | 1.03 | | | | | | | | | | |
| 2025 | 975 | 1218 | 0.30 | 1450 | 0.53 | 1658 | 0.79 | 1848 | 1.08 | 2046 | 1.43 | | | | | | | | |
| 2200 | 1059 | 1280 | 0.34 | 1502 | 0.59 | 1696 | 0.86 | 1885 | 1.16 | 2053 | 1.47 | 2241 | 1.87 | | | | | | |
| 2375 | 1143 | 1342 | 0.39 | 1557 | 0.65 | 1746 | 0.93 | 1922 | 1.24 | 2090 | 1.57 | 2248 | 1.92 | 2420 | 2.36 | | | | |
| 2550 | 1228 | 1407 | 0.44 | 1615 | 0.71 | 1797 | 1.01 | 1960 | 1.33 | 2127 | 1.67 | 2278 | 2.03 | 2427 | 2.42 | 2588 | 2.89 | | |
| 2725 | 1312 | 1481 | 0.50 | 1675 | 0.78 | 1849 | 1.09 | 2011 | 1.43 | 2164 | 1.78 | 2315 | 2.15 | 2455 | 2.53 | 2595 | 2.95 | 2671 | 3.20 |
| 2900 | 1396 | 1556 | 0.58 | 1736 | 0.86 | 1904 | 1.18 | 2062 | 1.53 | 2206 | 1.89 | 2352 | 2.27 | 2491 | 2.67 | 2622 | 3.08 | 2684 | 3.29 |
| 3075 | 1480 | 1631 | 0.66 | 1797 | 0.94 | 1962 | 1.28 | 2114 | 1.64 | 2256 | 2.01 | 2390 | 2.41 | 2529 | 2.82 | 2658 | 3.24 | 2720 | 3.45 |
| 3250 | 1564 | 1707 | 0.74 | 1859 | 1.03 | 2021 | 1.38 | 2166 | 1.75 | 2308 | 2.14 | 2437 | 2.54 | 2566 | 2.97 | 2695 | 3.40 | | |
| 3425 | 1649 | 1784 | 0.84 | 1922 | 1.13 | 2082 | 1.50 | 2223 | 1.87 | 2359 | 2.27 | 2488 | 2.69 | 2608 | 3.13 | 2733 | 3.58 | | |
| 3600 | 1733 | 1861 | 0.94 | 1988 | 1.24 | 2142 | 1.61 | 2282 | 2.01 | 2412 | 2.42 | 2540 | 2.85 | 2659 | 3.30 | | | | |
| 3775 | 1817 | 1938 | 1.06 | 2061 | 1.37 | 2204 | 1.74 | 2342 | 2.15 | 2468 | 2.57 | 2592 | 3.01 | 2710 | 3.47 | | | | |

TABLE 2A-continued

| Model 2 Air Performance | | | | | | | | | | | | | | | | | | | |
|---|---|---|---|---|---|---|---|---|---|---|---|---|---|---|---|---|---|---|---|
| | | 0.5"SP | | 1"SP | | 1.5"SP | | 2"SP | | 2.5"SP | | 3"SP | | 3.5"SP | | 4"SP | | 4.25"SP | |
| CFM | OV | RPM | BHP | RPM | BHP | RPM | BHP | RPM | BHP | RPM | BHP | RPM | BHP | RPM | BHP | RPM | BHP | RPM | BHP |
| 3950 | 1901 | 2016 | 1.18 | 2136 | 1.50 | 2266 | 1.88 | 2402 | 2.30 | 2526 | 2.73 | 2644 | 3.18 | | | | | | |
| 4125 | 1986 | 2095 | 1.32 | 2210 | 1.65 | 2329 | 2.02 | 2463 | 2.45 | 2585 | 2.90 | 2700 | 3.37 | | | | | | |
| 4300 | 2070 | 2173 | 1.46 | 2286 | 1.81 | 2393 | 2.17 | 2524 | 2.62 | 2645 | 3.08 | | | | | | | | |
| 4475 | 2154 | 2252 | 1.62 | 2361 | 1.97 | 2462 | 2.35 | 2586 | 2.80 | 2706 | 3.27 | | | | | | | | |
| 4650 | 2238 | 2332 | 1.78 | 2438 | 2.16 | 2536 | 2.54 | 2649 | 2.98 | | | | | | | | | | |
| 4825 | 2323 | 2411 | 1.96 | 2514 | 2.35 | 2610 | 2.74 | 2712 | 3.18 | | | | | | | | | | |
| 5000 | 2407 | 2491 | 2.16 | 2591 | 2.55 | 2685 | 2.96 | | | | | | | | | | | | |
| 5175 | 2491 | 2571 | 2.36 | 2669 | 2.77 | | | | | | | | | | | | | | |

TABLE 2B

| Model 2 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 1000 | 0.00 | 64 | 66 | 68 | 71 | 69 | 63 | 53 | 43 | 73 |
| | 0.25 | 64 | 66 | 67 | 69 | 68 | 62 | 53 | 43 | 71 |
| | 0.38 | 64 | 66 | 67 | 68 | 67 | 62 | 53 | 42 | 70 |
| | 0.50 | 64 | 65 | 66 | 66 | 66 | 62 | 53 | 42 | 69 |
| 1400 | 0.00 | 72 | 71 | 76 | 76 | 79 | 74 | 66 | 55 | 81 |
| | 0.50 | 72 | 71 | 75 | 75 | 77 | 73 | 66 | 55 | 80 |
| | 0.75 | 72 | 71 | 74 | 74 | 75 | 73 | 66 | 55 | 79 |
| | 1.00 | 72 | 71 | 74 | 74 | 73 | 72 | 66 | 55 | 78 |
| 1800 | 0.00 | 78 | 77 | 81 | 81 | 84 | 81 | 74 | 65 | 87 |
| | 0.75 | 78 | 77 | 80 | 80 | 82 | 80 | 74 | 64 | 86 |
| | 1.25 | 78 | 77 | 80 | 80 | 81 | 79 | 74 | 64 | 85 |
| | 1.75 | 87 | 83 | 81 | 80 | 78 | 77 | 73 | 64 | 84 |
| 2200 | 0.00 | 82 | 81 | 85 | 85 | 87 | 87 | 81 | 72 | 92 |
| | 1.00 | 82 | 81 | 85 | 85 | 86 | 86 | 81 | 72 | 91 |
| | 2.00 | 82 | 81 | 84 | 84 | 84 | 84 | 80 | 72 | 89 |
| | 2.75 | 99 | 96 | 89 | 86 | 84 | 81 | 79 | 72 | 90 |
| 2700 | 0.00 | 87 | 86 | 86 | 90 | 91 | 93 | 88 | 80 | 97 |
| | 1.00 | 87 | 86 | 86 | 59 | 90 | 92 | 87 | 80 | 96 |
| | 2.00 | 87 | 86 | 85 | 89 | 89 | 91 | 87 | 79 | 95 |
| | 4.00 | 98 | 97 | 93 | 90 | 89 | 86 | 85 | 79 | 94 |

TABLE 2C

| Model 2 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 1000 | 0.00 | 74 | 73 | 69 | 71 | 70 | 63 | 53 | 43 | 73 |
| | 0.25 | 74 | 71 | 67 | 69 | 68 | 62 | 53 | 43 | 71 |
| | 0.38 | 74 | 70 | 66 | 68 | 67 | 61 | 53 | 43 | 70 |
| | 0.50 | 73 | 69 | 66 | 67 | 65 | 61 | 53 | 44 | 69 |
| 1400 | 0.00 | 82 | 80 | 74 | 78 | 79 | 75 | 65 | 55 | 82 |
| | 0.50 | 84 | 78 | 73 | 76 | 77 | 73 | 65 | 55 | 80 |
| | 0.75 | 85 | 77 | 73 | 74 | 76 | 72 | 65 | 55 | 79 |
| | 1.00 | 86 | 76 | 72 | 73 | 74 | 71 | 65 | 56 | 78 |
| 1800 | 0.00 | 88 | 86 | 81 | 82 | 84 | 82 | 74 | 64 | 88 |
| | 0.75 | 90 | 86 | 80 | 80 | 82 | 80 | 73 | 64 | 86 |
| | 1.25 | 91 | 85 | 79 | 79 | 81 | 79 | 73 | 64 | 85 |
| | 1.75 | 92 | 85 | 79 | 79 | 79 | 77 | 72 | 64 | 84 |
| 2200 | 0.00 | 92 | 91 | 87 | 85 | 88 | 88 | 81 | 71 | 93 |
| | 1.00 | 94 | 92 | 86 | 84 | 86 | 86 | 80 | 71 | 91 |
| | 2.00 | 96 | 92 | 85 | 83 | 84 | 84 | 79 | 71 | 90 |
| | 2.75 | 97 | 92 | 85 | 83 | 83 | 82 | 78 | 71 | 89 |
| 2700 | 0.00 | 97 | 96 | 94 | 92 | 92 | 93 | 89 | 79 | 98 |
| | 1.00 | 98 | 97 | 93 | 91 | 91 | 92 | 88 | 79 | 97 |
| | 2.00 | 99 | 98 | 92 | 89 | 90 | 91 | 87 | 78 | 96 |
| | 4.00 | 101 | 100 | 90 | 88 | 88 | 88 | 85 | 78 | 94 |

TABLE 3A

Model 3 Air Performance

| | | 0.5"SP | | 1"SP | | 1.5"SP | | 2"SP | | 2.5"SP | | 3"SP | | 3.5"SP | | 4"SP | | 4.25"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 1700 | 663 | 909 | 0.22 | 1168 | 0.46 | | | | | | | | | | | | | | |
| 1900 | 741 | 952 | 0.25 | 1196 | 0.50 | 1425 | 0.81 | | | | | | | | | | | | |
| 2100 | 819 | 997 | 0.29 | 1227 | 0.55 | 1431 | 0.84 | | | | | | | | | | | | |
| 2300 | 897 | 1046 | 0.33 | 1263 | 0.60 | 1461 | 0.91 | 1649 | 1.27 | | | | | | | | | | |
| 2500 | 975 | 1096 | 0.37 | 1305 | 0.66 | 1492 | 0.98 | 1664 | 1.33 | 1842 | 1.77 | | | | | | | | |
| 2700 | 1053 | 1148 | 0.42 | 1349 | 0.72 | 1523 | 1.06 | 1694 | 1.42 | 1847 | 1.81 | 2016 | 2.31 | | | | | | |
| 2900 | 1131 | 1200 | 0.47 | 1393 | 0.79 | 1564 | 1.14 | 1725 | 1.52 | 1876 | 1.92 | 2022 | 2.36 | 2177 | 2.90 | | | | |
| 3100 | 1209 | 1253 | 0.53 | 1442 | 0.86 | 1607 | 1.22 | 1756 | 1.62 | 1907 | 2.03 | 2043 | 2.47 | 2183 | 2.97 | 2328 | 3.55 | | |
| 3300 | 1287 | 1313 | 0.60 | 1491 | 0.94 | 1650 | 1.32 | 1796 | 1.72 | 1938 | 2.16 | 2074 | 2.61 | 2200 | 3.08 | 2333 | 3.62 | 2402 | 3.92 |
| 3500 | 1365 | 1375 | 0.68 | 1542 | 1.03 | 1694 | 1.42 | 1839 | 1.84 | 1969 | 2.28 | 2105 | 2.75 | 2230 | 3.23 | 2347 | 3.73 | 2408 | 4.01 |
| 3700 | 1443 | 1438 | 0.76 | 1593 | 1.12 | 1742 | 1.52 | 1882 | 1.96 | 2010 | 2.42 | 2136 | 2.90 | 2261 | 3.40 | 2378 | 3.91 | 2433 | 4.17 |
| 3900 | 1521 | 1501 | 0.86 | 1644 | 1.22 | 1791 | 1.64 | 1925 | 2.09 | 2053 | 2.56 | 2170 | 3.05 | 2292 | 3.57 | 2408 | 4.09 | | |
| 4100 | 1599 | 1564 | 0.96 | 1696 | 1.32 | 1841 | 1.76 | 1970 | 2.22 | 2096 | 2.71 | 2212 | 3.22 | 2323 | 3.74 | 2439 | 4.29 | | |
| 4300 | 1677 | 1628 | 1.08 | 1749 | 1.44 | 1891 | 1.89 | 2019 | 2.37 | 2139 | 2.87 | 2255 | 3.39 | 2362 | 3.93 | | | | |
| 4500 | 1755 | 1693 | 1.20 | 1806 | 1.57 | 1942 | 2.03 | 2068 | 2.52 | 2183 | 3.03 | 2298 | 3.57 | 2404 | 4.12 | | | | |
| 4700 | 1833 | 1757 | 1.33 | 1867 | 1.72 | 1994 | 2.18 | 2117 | 2.68 | 2231 | 3.21 | 2341 | 3.76 | 2447 | 4.33 | | | | |
| 4900 | 1911 | 1822 | 1.47 | 1929 | 1.87 | 2046 | 2.34 | 2168 | 2.86 | 2279 | 3.39 | 2385 | 3.96 | | | | | | |
| 5100 | 1989 | 1888 | 1.63 | 1992 | 2.04 | 2098 | 2.50 | 2218 | 3.04 | 2329 | 3.59 | 2432 | 4.17 | | | | | | |
| 5300 | 2067 | 1953 | 1.79 | 2054 | 2.22 | 2151 | 2.67 | 2270 | 3.23 | 2379 | 3.80 | | | | | | | | |
| 5500 | 2145 | 2019 | 1.97 | 2118 | 2.42 | 2208 | 2.87 | 2321 | 3.43 | 2429 | 4.01 | | | | | | | | |
| 5700 | 2223 | 2085 | 2.16 | 2181 | 2.62 | 2270 | 3.09 | 2373 | 3.64 | | | | | | | | | | |
| 5900 | 2301 | 2151 | 2.36 | 2245 | 2.84 | 2331 | 3.32 | 2426 | 3.86 | | | | | | | | | | |
| 6100 | 2379 | 2218 | 2.58 | 2309 | 3.07 | 2394 | 3.57 | | | | | | | | | | | | |

TABLE 3B

Model 3 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 1000 | 0.00 | 67 | 69 | 71 | 74 | 72 | 66 | 57 | 46 | 76 |
| | 0.25 | 67 | 69 | 71 | 72 | 71 | 66 | 56 | 46 | 75 |
| | 0.50 | 67 | 69 | 70 | 70 | 70 | 65 | 56 | 46 | 73 |
| | 0.63 | 67 | 68 | 69 | 69 | 69 | 65 | 56 | 46 | 72 |
| 1350 | 0.00 | 75 | 74 | 78 | 79 | 81 | 76 | 68 | 57 | 84 |
| | 0.50 | 74 | 74 | 77 | 77 | 79 | 75 | 68 | 57 | 82 |
| | 1.00 | 75 | 74 | 76 | 76 | 77 | 74 | 67 | 57 | 81 |
| | 1.25 | 88 | 82 | 79 | 77 | 74 | 73 | 67 | 58 | 80 |
| 1700 | 0.00 | 80 | 78 | 83 | 83 | 86 | 83 | 76 | 66 | 89 |
| | 0.50 | 80 | 78 | 83 | 82 | 85 | 82 | 76 | 66 | 88 |
| | 1.50 | 80 | 78 | 82 | 81 | 82 | 81 | 75 | 65 | 86 |
| | 2.00 | 95 | 90 | 85 | 83 | 79 | 78 | 74 | 66 | 86 |
| 2050 | 0.00 | 84 | 83 | 87 | 87 | 89 | 88 | 82 | 73 | 93 |
| | 1.00 | 84 | 83 | 86 | 86 | 88 | 87 | 81 | 72 | 92 |
| | 2.00 | 84 | 83 | 86 | 86 | 86 | 86 | 81 | 72 | 91 |
| | 3.00 | 104 | 100 | 91 | 89 | 85 | 82 | 80 | 72 | 92 |
| 2450 | 0.00 | 88 | 87 | 88 | 91 | 92 | 93 | 88 | 79 | 98 |
| | 1.50 | 88 | 87 | 87 | 90 | 91 | 92 | 87 | 79 | 96 |
| | 3.00 | 88 | 87 | 87 | 89 | 90 | 90 | 87 | 79 | 95 |
| | 4.25 | 107 | 105 | 98 | 93 | 90 | 86 | 85 | 79 | 97 |

TABLE 3C

Model 3 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 1000 | 0.00 | 77 | 76 | 72 | 75 | 73 | 66 | 56 | 46 | 76 |
| | 0.25 | 77 | 75 | 71 | 73 | 71 | 65 | 56 | 46 | 75 |
| | 0.50 | 77 | 73 | 69 | 71 | 70 | 64 | 56 | 46 | 73 |
| | 0.63 | 76 | 72 | 69 | 70 | 68 | 64 | 56 | 47 | 72 |
| 1350 | 0.00 | 85 | 82 | 77 | 80 | 81 | 77 | 67 | 57 | 84 |
| | 0.50 | 86 | 80 | 76 | 78 | 79 | 75 | 67 | 57 | 82 |
| | 1.00 | 87 | 79 | 75 | 76 | 77 | 73 | 66 | 57 | 80 |
| | 1.25 | 88 | 79 | 75 | 76 | 76 | 73 | 66 | 58 | 80 |

TABLE 3C-continued

Model 3 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 1700 | 0.00 | 90 | 88 | 83 | 84 | 87 | 84 | 75 | 65 | 90 |
| | 0.50 | 91 | 88 | 82 | 83 | 85 | 83 | 75 | 65 | 89 |
| | 1.50 | 93 | 86 | 81 | 81 | 82 | 80 | 74 | 65 | 86 |
| | 2.00 | 94 | 86 | 81 | 81 | 81 | 79 | 74 | 66 | 86 |
| 2050 | 0.00 | 94 | 93 | 88 | 87 | 90 | 89 | 82 | 72 | 94 |
| | 1.00 | 95 | 93 | 87 | 86 | 88 | 87 | 81 | 72 | 93 |
| | 2.00 | 97 | 93 | 86 | 85 | 87 | 85 | 80 | 72 | 91 |
| | 3.00 | 99 | 93 | 86 | 85 | 85 | 84 | 79 | 72 | 90 |
| 2450 | 0.00 | 98 | 97 | 94 | 93 | 93 | 94 | 88 | 78 | 99 |
| | 1.50 | 99 | 98 | 93 | 91 | 92 | 92 | 87 | 78 | 97 |
| | 3.00 | 101 | 99 | 91 | 89 | 90 | 90 | 86 | 78 | 96 |
| | 4.25 | 103 | 100 | 91 | 89 | 89 | 88 | 85 | 78 | 95 |

TABLE 4A

Model 4 Air Performance

| | | 0.5"SP | | 1"SP | | 1.5"SP | | 2"SP | | 2.5"SP | | 3"SP | | 3.5"SP | | 4"SP | | 4.5"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 1550 | 505 | 729 | 0.17 | | | | | | | | | | | | | | | | |
| 1850 | 603 | 763 | 0.20 | | | | | | | | | | | | | | | | |
| 2150 | 700 | 805 | 0.23 | 1027 | 0.48 | | | | | | | | | | | | | | |
| 2450 | 798 | 853 | 0.28 | 1056 | 0.53 | | | | | | | | | | | | | | |
| 2750 | 896 | 903 | 0.32 | 1097 | 0.59 | 1270 | 0.91 | | | | | | | | | | | | |
| 3050 | 993 | 962 | 0.38 | 1140 | 0.66 | 1300 | 0.99 | 1454 | 1.37 | | | | | | | | | | |
| 3350 | 1091 | 1025 | 0.46 | 1187 | 0.75 | 1341 | 1.08 | 1483 | 1.46 | | | | | | | | | | |
| 3650 | 1189 | 1090 | 0.54 | 1237 | 0.84 | 1383 | 1.19 | 1519 | 1.57 | 1649 | 2.00 | | | | | | | | |
| 3950 | 1287 | 1155 | 0.63 | 1288 | 0.94 | 1429 | 1.30 | 1560 | 1.70 | 1680 | 2.13 | 1801 | 2.61 | | | | | | |
| 4250 | 1384 | 1222 | 0.74 | 1347 | 1.06 | 1478 | 1.43 | 1602 | 1.84 | 1721 | 2.29 | 1830 | 2.75 | 1944 | 3.28 | | | | |
| 4550 | 1482 | 1290 | 0.85 | 1410 | 1.20 | 1529 | 1.58 | 1648 | 2.00 | 1763 | 2.46 | 1871 | 2.94 | 1973 | 3.45 | 2079 | 4.01 | 2179 | 4.60 |
| 4850 | 1580 | 1360 | 0.98 | 1474 | 1.35 | 1580 | 1.73 | 1697 | 2.17 | 1806 | 2.64 | 1913 | 3.14 | 2012 | 3.66 | 2108 | 4.20 | 2207 | 4.80 |
| 5150 | 1678 | 1431 | 1.13 | 1539 | 1.51 | 1638 | 1.91 | 1748 | 2.36 | 1853 | 2.84 | 1955 | 3.35 | 2054 | 3.89 | 2146 | 4.44 | | |
| 5450 | 1775 | 1502 | 1.29 | 1604 | 1.69 | 1701 | 2.11 | 1798 | 2.56 | 1902 | 3.06 | 1998 | 3.57 | 2096 | 4.13 | 2188 | 4.70 | | |
| 5750 | 1873 | 1573 | 1.47 | 1670 | 1.89 | 1764 | 2.33 | 1851 | 2.78 | 1952 | 3.29 | 2047 | 3.82 | 2138 | 4.38 | | | | |
| 6050 | 1971 | 1645 | 1.67 | 1737 | 2.11 | 1829 | 2.56 | 1913 | 3.03 | 2003 | 3.54 | 2097 | 4.09 | 2185 | 4.66 | | | | |
| 6350 | 2068 | 1717 | 1.88 | 1805 | 2.34 | 1894 | 2.82 | 1976 | 3.30 | 2055 | 3.81 | 2147 | 4.37 | | | | | | |
| 6650 | 2166 | 1789 | 2.11 | 1875 | 2.60 | 1959 | 3.09 | 2039 | 3.59 | 2115 | 4.11 | 2198 | 4.67 | | | | | | |
| 6950 | 2264 | 1862 | 2.36 | 1945 | 2.87 | 2025 | 3.38 | 2104 | 3.91 | 2178 | 4.44 | | | | | | | | |
| 7250 | 2362 | 1935 | 2.64 | 2015 | 3.16 | 2092 | 3.70 | 2169 | 4.24 | | | | | | | | | | |
| 7550 | 2459 | 2009 | 2.94 | 2086 | 3.48 | 2159 | 4.04 | | | | | | | | | | | | |
| 7850 | 2557 | 2082 | 3.25 | 2157 | 3.82 | | | | | | | | | | | | | | |
| 8150 | 2655 | 2156 | 3.60 | | | | | | | | | | | | | | | | |

TABLE 4B

Model 4 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 1000 | 0.00 | 70 | 72 | 69 | 69 | 69 | 65 | 55 | 45 | 72 |
| | 0.50 | 68 | 69 | 66 | 65 | 67 | 64 | 53 | 41 | 70 |
| | 0.75 | 68 | 68 | 64 | 64 | 66 | 63 | 53 | 41 | 69 |
| | 0.90 | 68 | 67 | 63 | 63 | 65 | 60 | 51 | 41 | 68 |
| 1300 | 0.00 | 76 | 77 | 78 | 74 | 75 | 73 | 65 | 55 | 79 |
| | 0.50 | 75 | 75 | 76 | 72 | 73 | 72 | 64 | 53 | 77 |
| | 1.00 | 75 | 73 | 74 | 70 | 71 | 71 | 63 | 51 | 76 |
| | 1.60 | 76 | 73 | 71 | 68 | 70 | 68 | 59 | 50 | 74 |
| 1600 | 0.00 | 80 | 81 | 83 | 79 | 79 | 79 | 73 | 62 | 84 |
| | 1.00 | 79 | 78 | 80 | 76 | 76 | 77 | 72 | 60 | 82 |
| | 1.75 | 81 | 77 | 78 | 74 | 75 | 76 | 71 | 59 | 81 |
| | 2.40 | 82 | 78 | 76 | 73 | 73 | 75 | 67 | 57 | 79 |
| 1900 | 0.00 | 84 | 84 | 87 | 83 | 82 | 83 | 78 | 68 | 88 |
| | 1.00 | 83 | 82 | 85 | 81 | 81 | 82 | 78 | 67 | 87 |
| | 2.00 | 84 | 81 | 83 | 79 | 79 | 81 | 77 | 66 | 86 |
| | 3.40 | 87 | 82 | 80 | 77 | 77 | 79 | 73 | 63 | 83 |

TABLE 4B-continued

| Model 4 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 2200 | 0.00 | 87 | 87 | 90 | 87 | 86 | 86 | 83 | 74 | 92 |
| | 1.50 | 87 | 86 | 87 | 85 | 84 | 85 | 82 | 73 | 90 |
| | 3.00 | 88 | 85 | 86 | 83 | 82 | 83 | 81 | 72 | 89 |
| | 4.50 | 90 | 86 | 83 | 81 | 80 | 82 | 78 | 69 | 87 |

TABLE 4C

| Model 4 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 1000 | 0.00 | 73 | 73 | 73 | 72 | 70 | 66 | 58 | 49 | 75 |
| | 0.50 | 72 | 72 | 71 | 71 | 70 | 66 | 56 | 46 | 73 |
| | 0.75 | 70 | 69 | 69 | 69 | 68 | 64 | 55 | 45 | 72 |
| | 0.90 | 70 | 70 | 69 | 68 | 68 | 63 | 57 | 51 | 71 |
| 1300 | 0.00 | 85 | 77 | 79 | 78 | 77 | 74 | 67 | 58 | 81 |
| | 0.50 | 84 | 77 | 79 | 77 | 76 | 73 | 67 | 56 | 81 |
| | 1.00 | 83 | 75 | 77 | 76 | 75 | 73 | 66 | 55 | 79 |
| | 1.60 | 82 | 74 | 76 | 73 | 73 | 71 | 66 | 61 | 78 |
| 1600 | 0.00 | 95 | 81 | 84 | 83 | 82 | 80 | 75 | 65 | 87 |
| | 1.00 | 93 | 80 | 83 | 82 | 81 | 79 | 74 | 64 | 86 |
| | 1.75 | 91 | 79 | 80 | 80 | 79 | 78 | 73 | 62 | 84 |
| | 2.40 | 91 | 78 | 81 | 78 | 78 | 77 | 72 | 66 | 83 |
| 1900 | 0.00 | 101 | 86 | 87 | 87 | 86 | 84 | 80 | 71 | 91 |
| | 1.00 | 100 | 86 | 87 | 86 | 86 | 84 | 80 | 70 | 90 |
| | 2.00 | 98 | 85 | 86 | 84 | 84 | 83 | 79 | 69 | 89 |
| | 3.40 | 96 | 83 | 85 | 82 | 82 | 81 | 77 | 72 | 87 |
| 2200 | 0.00 | 104 | 93 | 90 | 90 | 90 | 88 | 84 | 76 | 95 |
| | 1.50 | 103 | 92 | 90 | 89 | 89 | 87 | 84 | 75 | 94 |
| | 3.00 | 100 | 91 | 88 | 87 | 87 | 86 | 83 | 74 | 92 |
| | 4.50 | 100 | 89 | 88 | 86 | 85 | 85 | 81 | 76 | 91 |

TABLE 5A

| Model 5 Air Performance | | | | | | | | | | | | | | | | | | | |
|---|---|---|---|---|---|---|---|---|---|---|---|---|---|---|---|---|---|---|---|
| | | 0.5"SP | | 1"SP | | 1.5"SP | | 2"SP | | 2.5"SP | | 3"SP | | 3.5"SP | | 4"SP | | 4.5"SP | |
| CFM | OV | RPM | BHP | RPM | BHP | RPM | BHP | RPM | BHP | RPM | BHP | RPM | BHP | RPM | BHP | RPM | BHP | RPM | BHP |
| 3400 | 953 | 821 | 0.40 | 996 | 0.73 | 1150 | 1.12 | | | | | | | | | | | | |
| 3700 | 1038 | 865 | 0.46 | 1027 | 0.80 | 1172 | 1.20 | 1312 | 1.66 | | | | | | | | | | |
| 4000 | 1122 | 911 | 0.53 | 1061 | 0.88 | 1203 | 1.29 | 1334 | 1.76 | | | | | | | | | | |
| 4300 | 1206 | 959 | 0.61 | 1098 | 0.97 | 1234 | 1.40 | 1356 | 1.85 | 1479 | 2.39 | | | | | | | | |
| 4600 | 1290 | 1007 | 0.70 | 1135 | 1.07 | 1265 | 1.50 | 1387 | 1.98 | 1500 | 2.50 | 1612 | 3.08 | | | | | | |
| 4900 | 1374 | 1056 | 0.79 | 1173 | 1.17 | 1300 | 1.62 | 1418 | 2.12 | 1526 | 2.64 | 1633 | 3.22 | 1736 | 3.85 | | | | |
| 5200 | 1458 | 1105 | 0.90 | 1218 | 1.30 | 1337 | 1.76 | 1449 | 2.26 | 1556 | 2.80 | 1655 | 3.37 | 1758 | 4.02 | 1854 | 4.69 | | |
| 5500 | 1542 | 1155 | 1.02 | 1264 | 1.43 | 1374 | 1.90 | 1482 | 2.41 | 1587 | 2.97 | 1685 | 3.56 | 1779 | 4.18 | 1875 | 4.87 | 1965 | 5.58 |
| 5800 | 1626 | 1207 | 1.14 | 1311 | 1.58 | 1411 | 2.05 | 1518 | 2.58 | 1618 | 3.14 | 1715 | 3.75 | 1806 | 4.38 | 1896 | 5.05 | 1986 | 5.78 |
| 6100 | 1711 | 1259 | 1.28 | 1359 | 1.74 | 1450 | 2.21 | 1555 | 2.76 | 1651 | 3.33 | 1746 | 3.95 | 1836 | 4.60 | 1920 | 5.26 | 2007 | 5.99 |
| 6400 | 1795 | 1311 | 1.44 | 1407 | 1.91 | 1496 | 2.40 | 1592 | 2.95 | 1687 | 3.54 | 1778 | 4.17 | 1867 | 4.83 | 1951 | 5.52 | | |
| 6700 | 1879 | 1363 | 1.60 | 1456 | 2.10 | 1543 | 2.60 | 1630 | 3.15 | 1724 | 3.77 | 1811 | 4.40 | 1898 | 5.07 | 1981 | 5.77 | | |
| 7000 | 1963 | 1416 | 1.78 | 1504 | 2.29 | 1590 | 2.82 | 1668 | 3.37 | 1761 | 4.00 | 1847 | 4.65 | 1929 | 5.32 | 2012 | 6.05 | | |
| 7300 | 2047 | 1469 | 1.97 | 1554 | 2.51 | 1637 | 3.05 | 1714 | 3.62 | 1798 | 4.24 | 1884 | 4.92 | 1963 | 5.60 | | | | |
| 7600 | 2131 | 1522 | 2.17 | 1604 | 2.74 | 1685 | 3.30 | 1760 | 3.88 | 1836 | 4.50 | 1921 | 5.19 | 2000 | 5.90 | | | | |
| 7900 | 2215 | 1576 | 2.40 | 1655 | 2.98 | 1733 | 3.56 | 1807 | 4.16 | 1876 | 4.78 | 1958 | 5.48 | | | | | | |
| 8200 | 2299 | 1629 | 2.63 | 1706 | 3.23 | 1782 | 3.84 | 1854 | 4.46 | 1922 | 5.10 | 1996 | 5.79 | | | | | | |
| 8500 | 2384 | 1683 | 2.89 | 1758 | 3.51 | 1831 | 4.14 | 1902 | 4.78 | 1968 | 5.42 | | | | | | | | |
| 8800 | 2468 | 1737 | 3.16 | 1810 | 3.80 | 1880 | 4.45 | 1950 | 5.11 | 2015 | 5.78 | | | | | | | | |
| 9100 | 2552 | 1791 | 3.45 | 1862 | 4.11 | 1929 | 4.78 | 1998 | 5.46 | | | | | | | | | | |
| 9400 | 2636 | 1846 | 3.76 | 1915 | 4.44 | 1980 | 5.13 | | | | | | | | | | | | |
| 9700 | 2720 | 1900 | 4.09 | 1967 | 4.78 | | | | | | | | | | | | | | |
| 10000 | 2804 | 1955 | 4.44 | 2020 | 5.15 | | | | | | | | | | | | | | |

TABLE 5B

Model 5 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 1000 | 0.00 | 73 | 75 | 72 | 72 | 72 | 68 | 58 | 48 | 75 |
| | 0.50 | 71 | 72 | 69 | 69 | 70 | 67 | 56 | 45 | 74 |
| | 0.75 | 71 | 71 | 68 | 68 | 70 | 66 | 56 | 44 | 73 |
| | 1.10 | 71 | 70 | 66 | 66 | 68 | 63 | 54 | 44 | 71 |
| 1250 | 0.00 | 78 | 79 | 81 | 76 | 77 | 74 | 66 | 56 | 81 |
| | 0.75 | 76 | 76 | 77 | 74 | 75 | 73 | 65 | 53 | 79 |
| | 1.25 | 77 | 75 | 76 | 72 | 73 | 73 | 65 | 53 | 78 |
| | 1.75 | 78 | 75 | 74 | 71 | 72 | 70 | 62 | 52 | 76 |
| 1500 | 0.00 | 82 | 83 | 85 | 80 | 80 | 80 | 73 | 63 | 86 |
| | 1.00 | 81 | 80 | 82 | 78 | 78 | 78 | 72 | 61 | 84 |
| | 1.75 | 82 | 79 | 80 | 76 | 77 | 78 | 72 | 60 | 83 |
| | 2.50 | 83 | 79 | 78 | 74 | 75 | 76 | 68 | 58 | 81 |
| 1750 | 0.00 | 85 | 86 | 88 | 84 | 84 | 84 | 79 | 68 | 90 |
| | 1.00 | 85 | 84 | 86 | 82 | 82 | 83 | 78 | 67 | 88 |
| | 2.25 | 86 | 82 | 84 | 79 | 80 | 82 | 78 | 66 | 87 |
| | 3.50 | 88 | 83 | 81 | 78 | 78 | 81 | 73 | 64 | 85 |
| 2000 | 0.00 | 88 | 88 | 91 | 88 | 87 | 87 | 83 | 73 | 93 |
| | 1.50 | 87 | 86 | 88 | 85 | 84 | 86 | 82 | 72 | 91 |
| | 3.00 | 89 | 86 | 86 | 83 | 83 | 85 | 81 | 71 | 90 |
| | 4.50 | 91 | 87 | 84 | 81 | 81 | 83 | 78 | 68 | 88 |

TABLE 5C

Model 5 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 1000 | 0.00 | 76 | 76 | 76 | 75 | 73 | 69 | 61 | 52 | 78 |
| | 0.50 | 76 | 75 | 75 | 74 | 73 | 69 | 60 | 49 | 77 |
| | 0.75 | 74 | 73 | 73 | 73 | 72 | 68 | 59 | 49 | 76 |
| | 1.10 | 73 | 73 | 72 | 71 | 71 | 66 | 60 | 54 | 74 |
| 1250 | 0.00 | 87 | 80 | 81 | 80 | 79 | 76 | 69 | 60 | 83 |
| | 0.75 | 85 | 79 | 81 | 79 | 78 | 75 | 68 | 58 | 82 |
| | 1.25 | 84 | 77 | 78 | 77 | 77 | 74 | 67 | 57 | 81 |
| | 1.75 | 83 | 77 | 78 | 76 | 75 | 73 | 67 | 62 | 80 |
| 1500 | 0.00 | 95 | 83 | 85 | 85 | 84 | 81 | 75 | 66 | 88 |
| | 1.00 | 94 | 82 | 85 | 83 | 83 | 80 | 75 | 64 | 87 |
| | 1.75 | 92 | 81 | 82 | 81 | 81 | 79 | 74 | 63 | 86 |
| | 2.50 | 91 | 80 | 82 | 80 | 80 | 78 | 73 | 67 | 84 |
| 1750 | 0.00 | 102 | 86 | 89 | 88 | 87 | 85 | 81 | 71 | 92 |
| | 1.00 | 101 | 85 | 88 | 87 | 87 | 85 | 80 | 70 | 91 |
| | 2.25 | 99 | 84 | 86 | 85 | 85 | 84 | 79 | 69 | 90 |
| | 3.50 | 98 | 82 | 86 | 83 | 83 | 83 | 77 | 72 | 88 |
| 2000 | 0.00 | 105 | 92 | 91 | 91 | 90 | 88 | 84 | 76 | 95 |
| | 1.50 | 104 | 91 | 91 | 90 | 90 | 88 | 84 | 75 | 95 |
| | 3.00 | 101 | 90 | 89 | 88 | 88 | 87 | 83 | 74 | 93 |
| | 4.50 | 100 | 88 | 88 | 87 | 86 | 86 | 81 | 76 | 92 |

TABLE 6A

Model 6 Air Performance

| | | 0.5"SP | | 1"SP | | 1.5"SP | | 2"SP | | 2.5"SP | | 3"SP | | 3.5"SP | | 4"SP | | 4.5"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 4200 | 975 | 761 | 0.51 | 918 | 0.91 | 1056 | 1.38 | | | | | | | | | | | | |
| 4500 | 1045 | 796 | 0.57 | 942 | 0.98 | 1074 | 1.46 | 1201 | 2.02 | | | | | | | | | | |
| 4800 | 1115 | 831 | 0.64 | 968 | 1.06 | 1097 | 1.55 | 1217 | 2.11 | | | | | | | | | | |
| 5100 | 1184 | 867 | 0.72 | 996 | 1.15 | 1121 | 1.65 | 1233 | 2.20 | 1346 | 2.84 | | | | | | | | |
| 5400 | 1254 | 904 | 0.80 | 1024 | 1.24 | 1144 | 1.76 | 1256 | 2.33 | 1362 | 2.96 | 1464 | 3.65 | | | | | | |
| 5700 | 1324 | 940 | 0.89 | 1053 | 1.34 | 1169 | 1.87 | 1279 | 2.46 | 1378 | 3.08 | 1480 | 3.78 | | | | | | |
| 6000 | 1393 | 978 | 0.99 | 1083 | 1.45 | 1197 | 2.00 | 1303 | 2.60 | 1401 | 3.23 | 1497 | 3.93 | 1591 | 4.69 | | | | |
| 6300 | 1463 | 1015 | 1.10 | 1118 | 1.58 | 1225 | 2.13 | 1327 | 2.74 | 1424 | 3.39 | 1514 | 4.08 | 1607 | 4.85 | 1694 | 5.65 | | |
| 6600 | 1533 | 1054 | 1.22 | 1153 | 1.72 | 1253 | 2.27 | 1352 | 2.89 | 1448 | 3.56 | 1537 | 4.27 | 1623 | 5.02 | 1710 | 5.84 | 1793 | 6.70 |
| 6900 | 1602 | 1093 | 1.35 | 1189 | 1.86 | 1282 | 2.43 | 1379 | 3.06 | 1472 | 3.74 | 1560 | 4.46 | 1643 | 5.21 | 1727 | 6.03 | 1809 | 6.90 |
| 7200 | 1672 | 1132 | 1.48 | 1225 | 2.02 | 1311 | 2.59 | 1407 | 3.24 | 1496 | 3.93 | 1584 | 4.66 | 1666 | 5.43 | 1743 | 6.22 | 1825 | 7.11 |

TABLE 6A-continued

| Model 6 Air Performance | | | | | | | | | | | | | | | | | | | |
|---|---|---|---|---|---|---|---|---|---|---|---|---|---|---|---|---|---|---|---|
| | | 0.5"SP | | 1"SP | | 1.5"SP | | 2"SP | | 2.5"SP | | 3"SP | | 3.5"SP | | 4"SP | | 4.5"SP | |
| CFM | OV | RPM | BHP | RPM | BHP | RPM | BHP | RPM | BHP | RPM | BHP | RPM | BHP | RPM | BHP | RPM | BHP | RPM | BHP |
| 7500 | 1741 | 1171 | 1.63 | 1261 | 2.18 | 1343 | 2.76 | 1435 | 3.42 | 1522 | 4.12 | 1607 | 4.87 | 1689 | 5.66 | 1765 | 6.46 | 1841 | 7.32 |
| 7800 | 1811 | 1211 | 1.78 | 1298 | 2.36 | 1379 | 2.96 | 1464 | 3.62 | 1550 | 4.34 | 1631 | 5.09 | 1712 | 5.89 | 1789 | 6.73 | | |
| 8100 | 1881 | 1251 | 1.95 | 1335 | 2.55 | 1414 | 3.16 | 1493 | 3.83 | 1578 | 4.56 | 1657 | 5.32 | 1736 | 6.14 | 1812 | 6.98 | | |
| 8400 | 1950 | 1291 | 2.13 | 1372 | 2.75 | 1450 | 3.38 | 1522 | 4.04 | 1606 | 4.79 | 1685 | 5.58 | 1760 | 6.39 | 1836 | 7.26 | | |
| 8700 | 2020 | 1331 | 2.32 | 1409 | 2.96 | 1486 | 3.61 | 1556 | 4.29 | 1635 | 5.04 | 1713 | 5.85 | 1785 | 6.66 | | | | |
| 9000 | 2090 | 1372 | 2.52 | 1447 | 3.18 | 1522 | 3.85 | 1591 | 4.55 | 1663 | 5.29 | 1741 | 6.12 | 1813 | 6.96 | | | | |
| 9300 | 2159 | 1412 | 2.74 | 1486 | 3.42 | 1559 | 4.11 | 1627 | 4.82 | 1692 | 5.56 | 1769 | 6.40 | 1841 | 7.26 | | | | |
| 9600 | 2229 | 1453 | 2.97 | 1525 | 3.67 | 1595 | 4.38 | 1662 | 5.11 | 1725 | 5.86 | 1797 | 6.69 | | | | | | |
| 9900 | 2299 | 1494 | 3.21 | 1564 | 3.93 | 1632 | 4.66 | 1698 | 5.41 | 1760 | 6.18 | 1826 | 7.00 | | | | | | |
| 10500 | 2438 | 1576 | 3.74 | 1643 | 4.50 | 1707 | 5.27 | 1771 | 6.06 | 1831 | 6.86 | | | | | | | | |
| 11100 | 2577 | 1658 | 4.32 | 1722 | 5.12 | 1782 | 5.94 | 1844 | 6.76 | | | | | | | | | | |
| 11700 | 2717 | 1741 | 4.97 | 1802 | 5.80 | | | | | | | | | | | | | | |

TABLE 6B

| Model 6 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 800 | 0.00 | 72 | 73 | 70 | 70 | 70 | 63 | 53 | 43 | 73 |
| | 0.25 | 70 | 71 | 68 | 68 | 69 | 63 | 51 | 40 | 71 |
| | 0.50 | 68 | 69 | 66 | 66 | 68 | 62 | 50 | 39 | 70 |
| | 0.80 | 68 | 68 | 64 | 65 | 66 | 60 | 49 | 38 | 69 |
| 1050 | 0.00 | 77 | 79 | 77 | 75 | 76 | 72 | 63 | 53 | 79 |
| | 0.50 | 75 | 77 | 74 | 73 | 75 | 71 | 62 | 50 | 78 |
| | 1.00 | 75 | 75 | 72 | 71 | 73 | 71 | 61 | 49 | 77 |
| | 1.50 | 76 | 73 | 70 | 70 | 72 | 67 | 58 | 48 | 75 |
| 1300 | 0.00 | 82 | 83 | 84 | 80 | 80 | 78 | 71 | 60 | 85 |
| | 0.75 | 80 | 81 | 82 | 78 | 79 | 77 | 70 | 58 | 83 |
| | 1.50 | 81 | 79 | 80 | 76 | 77 | 77 | 69 | 57 | 82 |
| | 2.25 | 82 | 78 | 78 | 74 | 76 | 74 | 66 | 56 | 80 |
| 1550 | 0.00 | 86 | 86 | 88 | 84 | 84 | 84 | 77 | 67 | 89 |
| | 1.00 | 85 | 84 | 86 | 82 | 82 | 83 | 76 | 65 | 88 |
| | 2.00 | 85 | 83 | 84 | 80 | 81 | 82 | 76 | 64 | 86 |
| | 3.25 | 87 | 83 | 81 | 78 | 79 | 80 | 72 | 62 | 84 |
| 1800 | 0.00 | 89 | 89 | 91 | 87 | 87 | 88 | 83 | 72 | 93 |
| | 1.50 | 88 | 87 | 89 | 85 | 85 | 87 | 82 | 71 | 91 |
| | 3.00 | 90 | 86 | 87 | 83 | 83 | 85 | 81 | 70 | 90 |
| | 4.50 | 91 | 86 | 84 | 81 | 81 | 84 | 77 | 67 | 88 |

TABLE 6C

| Model 6 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 800 | 0.00 | 72 | 74 | 74 | 73 | 70 | 65 | 56 | 47 | 75 |
| | 0.25 | 71 | 74 | 73 | 72 | 70 | 65 | 55 | 45 | 74 |
| | 0.50 | 71 | 73 | 72 | 71 | 69 | 64 | 54 | 44 | 73 |
| | 0.80 | 69 | 71 | 69 | 69 | 68 | 63 | 55 | 47 | 72 |
| 1050 | 0.00 | 81 | 79 | 80 | 79 | 77 | 74 | 66 | 56 | 82 |
| | 0.50 | 81 | 79 | 79 | 78 | 77 | 73 | 65 | 55 | 81 |
| | 1.00 | 79 | 77 | 77 | 77 | 76 | 72 | 63 | 53 | 80 |
| | 1.50 | 78 | 76 | 76 | 75 | 74 | 71 | 65 | 59 | 78 |
| 1300 | 0.00 | 91 | 83 | 85 | 84 | 83 | 80 | 73 | 64 | 87 |
| | 0.75 | 90 | 83 | 84 | 83 | 82 | 79 | 72 | 62 | 87 |
| | 1.50 | 89 | 81 | 83 | 82 | 81 | 78 | 71 | 61 | 85 |
| | 2.25 | 87 | 80 | 82 | 80 | 79 | 77 | 71 | 65 | 84 |
| 1550 | 0.00 | 99 | 86 | 89 | 88 | 87 | 84 | 79 | 70 | 92 |
| | 1.00 | 98 | 86 | 88 | 87 | 87 | 84 | 79 | 69 | 91 |
| | 2.00 | 96 | 85 | 87 | 86 | 85 | 83 | 78 | 68 | 90 |
| | 3.25 | 95 | 83 | 86 | 83 | 83 | 82 | 77 | 71 | 88 |

TABLE 6C-continued

| Model 6 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 1800 | 0.00 | 105 | 90 | 92 | 92 | 91 | 89 | 84 | 75 | 96 |
| | 1.50 | 104 | 89 | 91 | 90 | 90 | 88 | 84 | 74 | 95 |
| | 3.00 | 102 | 88 | 89 | 88 | 88 | 87 | 83 | 73 | 93 |
| | 4.50 | 101 | 86 | 89 | 87 | 86 | 86 | 81 | 76 | 92 |

TABLE 7A

| Model 7 Air Performance | | | | | | | | | | | | | | | | | | | |
|---|---|---|---|---|---|---|---|---|---|---|---|---|---|---|---|---|---|---|---|
| | | 0.5"SP | | 1"SP | | 1.5"SP | | 2"SP | | 2.5"SP | | 3"SP | | 3.5"SP | | 4"SP | | 4.5"SP | |
| CFM | OV | RPM | BHP | RPM | BHP | RPM | BHP | RPM | BHP | RPM | BHP | RPM | BHP | RPM | BHP | RPM | BHP | RPM | BHP |
| 4750 | 895 | 653 | 0.55 | 800 | 1.03 | 932 | 1.60 | | | | | | | | | | | | |
| 5100 | 961 | 677 | 0.61 | 819 | 1.10 | 945 | 1.68 | | | | | | | | | | | | |
| 5450 | 1027 | 705 | 0.68 | 839 | 1.18 | 959 | 1.77 | 1075 | 2.46 | | | | | | | | | | |
| 5800 | 1093 | 735 | 0.76 | 861 | 1.27 | 978 | 1.87 | 1088 | 2.56 | | | | | | | | | | |
| 6150 | 1159 | 765 | 0.84 | 884 | 1.37 | 998 | 1.99 | 1102 | 2.68 | 1204 | 3.46 | | | | | | | | |
| 6500 | 1225 | 796 | 0.94 | 908 | 1.48 | 1018 | 2.11 | 1119 | 2.81 | 1217 | 3.59 | 1309 | 4.43 | | | | | | |
| 6850 | 1291 | 827 | 1.04 | 932 | 1.59 | 1038 | 2.23 | 1138 | 2.95 | 1231 | 3.73 | 1323 | 4.59 | | | | | | |
| 7200 | 1357 | 858 | 1.15 | 956 | 1.71 | 1061 | 2.38 | 1158 | 3.11 | 1247 | 3.88 | 1336 | 4.75 | 1421 | 5.68 | | | | |
| 7550 | 1423 | 890 | 1.27 | 984 | 1.85 | 1084 | 2.53 | 1178 | 3.27 | 1266 | 4.06 | 1350 | 4.92 | 1435 | 5.87 | 1514 | 6.86 | | |
| 7900 | 1489 | 922 | 1.40 | 1013 | 2.00 | 1108 | 2.69 | 1198 | 3.44 | 1286 | 4.26 | 1367 | 5.12 | 1448 | 6.05 | 1527 | 7.06 | | |
| 8250 | 1555 | 955 | 1.54 | 1043 | 2.16 | 1132 | 2.86 | 1221 | 3.63 | 1306 | 4.45 | 1386 | 5.33 | 1462 | 6.25 | 1541 | 7.28 | 1615 | 8.35 |
| 8600 | 1621 | 988 | 1.69 | 1074 | 2.34 | 1156 | 3.03 | 1244 | 3.82 | 1326 | 4.66 | 1406 | 5.56 | 1480 | 6.49 | 1554 | 7.49 | 1628 | 8.58 |
| 8950 | 1687 | 1021 | 1.85 | 1104 | 2.52 | 1181 | 3.22 | 1268 | 4.03 | 1347 | 4.88 | 1426 | 5.80 | 1499 | 6.74 | 1569 | 7.74 | 1642 | 8.83 |
| 9300 | 1753 | 1055 | 2.02 | 1135 | 2.71 | 1209 | 3.43 | 1291 | 4.24 | 1370 | 5.12 | 1446 | 6.04 | 1519 | 7.01 | 1588 | 8.02 | 1656 | 9.08 |
| 9650 | 1819 | 1088 | 2.20 | 1166 | 2.92 | 1239 | 3.66 | 1316 | 4.48 | 1393 | 5.37 | 1466 | 6.30 | 1539 | 7.29 | 1608 | 8.32 | | |
| 10000 | 1885 | 1122 | 2.40 | 1198 | 3.14 | 1269 | 3.90 | 1340 | 4.72 | 1417 | 5.63 | 1488 | 6.57 | 1559 | 7.57 | 1627 | 8.62 | | |
| 10700 | 2017 | 1190 | 2.83 | 1261 | 3.62 | 1330 | 4.42 | 1393 | 5.25 | 1465 | 6.19 | 1535 | 7.17 | 1600 | 8.18 | | | | |
| 11400 | 2149 | 1259 | 3.31 | 1325 | 4.15 | 1391 | 4.99 | 1453 | 5.87 | 1513 | 6.78 | 1582 | 7.81 | 1647 | 8.87 | | | | |
| 12100 | 2280 | 1328 | 3.85 | 1391 | 4.73 | 1453 | 5.62 | 1513 | 6.54 | 1569 | 7.48 | 1631 | 8.51 | | | | | | |
| 12800 | 2412 | 1397 | 4.44 | 1458 | 5.37 | 1516 | 6.31 | 1574 | 7.27 | 1629 | 8.26 | | | | | | | | |
| 13500 | 2544 | 1467 | 5.11 | 1525 | 6.08 | 1580 | 7.08 | 1636 | 8.07 | | | | | | | | | | |
| 14200 | 2676 | 1537 | 5.84 | 1593 | 6.86 | 1645 | 7.90 | | | | | | | | | | | | |
| 14900 | 2808 | 1607 | 6.64 | 1661 | 7.71 | | | | | | | | | | | | | | |

TABLE 7B

| Model 7 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 600 | 0.00 | 70 | 69 | 67 | 67 | 64 | 56 | 46 | 35 | 68 |
| | 0.25 | 67 | 66 | 64 | 65 | 63 | 55 | 43 | 32 | 66 |
| | 0.50 | 70 | 65 | 62 | 63 | 62 | 54 | 42 | 30 | 65 |
| | 0.63 | 71 | 66 | 61 | 62 | 59 | 50 | 41 | 32 | 63 |
| 850 | 0.00 | 76 | 78 | 74 | 74 | 75 | 69 | 58 | 48 | 78 |
| | 0.50 | 73 | 75 | 71 | 72 | 73 | 68 | 56 | 45 | 76 |
| | 0.75 | 73 | 74 | 70 | 71 | 72 | 68 | 56 | 44 | 75 |
| | 1.25 | 73 | 72 | 68 | 68 | 71 | 63 | 53 | 44 | 73 |
| 1100 | 0.00 | 82 | 83 | 81 | 80 | 80 | 77 | 68 | 57 | 84 |
| | 0.75 | 80 | 81 | 79 | 77 | 79 | 76 | 66 | 55 | 82 |
| | 1.25 | 79 | 79 | 77 | 76 | 78 | 75 | 66 | 54 | 81 |
| | 2.00 | 80 | 78 | 75 | 74 | 76 | 72 | 63 | 53 | 79 |
| 1350 | 0.00 | 86 | 87 | 88 | 84 | 84 | 83 | 75 | 65 | 89 |
| | 1.00 | 85 | 85 | 86 | 82 | 83 | 82 | 74 | 63 | 87 |
| | 2.00 | 85 | 83 | 84 | 80 | 81 | 81 | 74 | 62 | 86 |
| | 3.10 | 86 | 83 | 82 | 78 | 79 | 78 | 70 | 60 | 84 |
| 1600 | 0.00 | 90 | 90 | 92 | 88 | 88 | 88 | 82 | 71 | 93 |
| | 1.50 | 89 | 88 | 90 | 86 | 86 | 87 | 81 | 69 | 92 |
| | 3.00 | 90 | 87 | 88 | 83 | 84 | 86 | 80 | 68 | 90 |
| | 4.40 | 91 | 87 | 85 | 82 | 82 | 84 | 76 | 66 | 88 |

TABLE 7C

Model 7 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 600 | 0.00 | 85 | 71 | 71 | 69 | 66 | 59 | 40 | 40 | 71 |
| | 0.25 | 83 | 70 | 69 | 68 | 65 | 57 | 47 | 37 | 70 |
| | 0.50 | 80 | 67 | 67 | 66 | 64 | 56 | 46 | 36 | 68 |
| | 0.63 | 81 | 67 | 66 | 65 | 62 | 57 | 53 | 48 | 67 |
| 850 | 0.00 | 76 | 79 | 79 | 78 | 75 | 71 | 61 | 52 | 80 |
| | 0.50 | 75 | 78 | 77 | 77 | 75 | 70 | 60 | 50 | 79 |
| | 0.75 | 75 | 77 | 76 | 76 | 74 | 69 | 59 | 49 | 78 |
| | 1.25 | 73 | 76 | 74 | 73 | 73 | 67 | 63 | 58 | 76 |
| 1100 | 0.00 | 87 | 84 | 84 | 84 | 82 | 78 | 71 | 61 | 86 |
| | 0.75 | 86 | 83 | 83 | 83 | 81 | 78 | 69 | 59 | 85 |
| | 1.25 | 85 | 82 | 82 | 81 | 81 | 77 | 69 | 58 | 84 |
| | 2.00 | 83 | 80 | 80 | 79 | 79 | 75 | 69 | 63 | 83 |
| 1350 | 0.00 | 96 | 87 | 89 | 88 | 87 | 84 | 78 | 68 | 91 |
| | 1.00 | 95 | 87 | 89 | 87 | 86 | 84 | 77 | 67 | 91 |
| | 2.00 | 93 | 85 | 87 | 86 | 85 | 83 | 76 | 66 | 89 |
| | 3.10 | 92 | 84 | 86 | 83 | 83 | 81 | 76 | 70 | 88 |
| 1600 | 0.00 | 104 | 90 | 93 | 92 | 91 | 89 | 84 | 74 | 96 |
| | 1.50 | 103 | 90 | 92 | 91 | 90 | 88 | 83 | 73 | 95 |
| | 3.00 | 100 | 88 | 90 | 89 | 89 | 87 | 82 | 72 | 93 |
| | 4.40 | 100 | 87 | 90 | 87 | 87 | 86 | 81 | 76 | 92 |

TABLE 8A

Model 8 Air Performance

| | | 0.5"SP | | 1"SP | | 1.25"SP | | 1.5"SP | | 2"SP | | 2.5"SP | | 3"SP | | 3.5"SP | | 4"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 6000 | 929 | 605 | 0.70 | 736 | 1.29 | 794 | 1.62 | 853 | 2.00 | | | | | | | | | | |
| 6300 | 975 | 621 | 0.76 | 749 | 1.36 | 806 | 1.70 | 862 | 2.07 | | | | | | | | | | |
| 6600 | 1021 | 640 | 0.82 | 762 | 1.43 | 819 | 1.78 | 871 | 2.14 | | | | | | | | | | |
| 6900 | 1068 | 659 | 0.89 | 775 | 1.51 | 831 | 1.86 | 883 | 2.23 | 984 | 3.06 | | | | | | | | |
| 7200 | 1114 | 678 | 0.96 | 790 | 1.59 | 844 | 1.95 | 895 | 2.32 | 993 | 3.16 | | | | | | | | |
| 7500 | 1161 | 698 | 1.03 | 805 | 1.67 | 857 | 2.04 | 908 | 2.42 | 1002 | 3.26 | | | | | | | | |
| 7800 | 1207 | 718 | 1.12 | 820 | 1.76 | 871 | 2.13 | 921 | 2.53 | 1012 | 3.36 | 1103 | 4.32 | | | | | | |
| 8100 | 1254 | 737 | 1.20 | 836 | 1.86 | 886 | 2.24 | 934 | 2.64 | 1025 | 3.49 | 1112 | 4.44 | | | | | | |
| 8400 | 1300 | 757 | 1.29 | 851 | 1.96 | 901 | 2.35 | 947 | 2.75 | 1038 | 3.62 | 1121 | 4.56 | 1204 | 5.61 | | | | |
| 8700 | 1346 | 778 | 1.39 | 867 | 2.07 | 916 | 2.46 | 962 | 2.87 | 1050 | 3.75 | 1131 | 4.69 | 1213 | 5.75 | | | | |
| 9000 | 1393 | 798 | 1.49 | 883 | 2.17 | 932 | 2.58 | 977 | 3.00 | 1063 | 3.89 | 1144 | 4.85 | 1222 | 5.90 | 1298 | 7.02 | | |
| 9300 | 1439 | 818 | 1.59 | 902 | 2.30 | 947 | 2.70 | 992 | 3.13 | 1076 | 4.03 | 1156 | 5.01 | 1230 | 6.03 | 1307 | 7.19 | | |
| 9600 | 1486 | 839 | 1.71 | 922 | 2.44 | 963 | 2.83 | 1007 | 3.27 | 1089 | 4.18 | 1169 | 5.17 | 1242 | 6.21 | 1316 | 7.36 | 1387 | 8.57 |
| 9900 | 1532 | 860 | 1.83 | 941 | 2.57 | 979 | 2.97 | 1023 | 3.41 | 1103 | 4.33 | 1182 | 5.35 | 1255 | 6.41 | 1325 | 7.53 | 1396 | 8.76 |
| 10500 | 1625 | 902 | 2.08 | 980 | 2.87 | 1016 | 3.28 | 1054 | 3.72 | 1133 | 4.67 | 1208 | 5.70 | 1280 | 6.79 | 1347 | 7.92 | | |
| 11100 | 1718 | 945 | 2.36 | 1019 | 3.19 | 1054 | 3.61 | 1087 | 4.05 | 1164 | 5.04 | 1235 | 6.08 | 1306 | 7.21 | 1372 | 8.37 | | |
| 11700 | 1811 | 988 | 2.67 | 1059 | 3.54 | 1093 | 3.98 | 1125 | 4.43 | 1195 | 5.43 | 1265 | 6.50 | 1332 | 7.64 | 1398 | 8.85 | | |
| 12300 | 1904 | 1032 | 3.01 | 1099 | 3.91 | 1132 | 4.38 | 1164 | 4.85 | 1226 | 5.84 | 1296 | 6.96 | 1360 | 8.11 | | | | |
| 12900 | 1996 | 1076 | 3.39 | 1140 | 4.33 | 1172 | 4.81 | 1203 | 5.30 | 1260 | 6.30 | 1326 | 7.43 | 1390 | 8.62 | | | | |
| 13500 | 2089 | 1120 | 3.79 | 1181 | 4.77 | 1212 | 5.27 | 1242 | 5.78 | 1299 | 6.83 | 1358 | 7.95 | | | | | | |
| 14100 | 2182 | 1164 | 4.22 | 1223 | 5.25 | 1253 | 5.77 | 1282 | 6.30 | 1337 | 7.37 | 1389 | 8.48 | | | | | | |
| 14700 | 2275 | 1208 | 4.69 | 1265 | 5.75 | 1293 | 6.30 | 1322 | 6.85 | 1376 | 7.96 | | | | | | | | |
| 15300 | 2368 | 1252 | 5.19 | 1308 | 6.30 | 1335 | 6.88 | 1362 | 7.43 | | | | | | | | | | |

TABLE 8B

Model 8 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 500 | 0.00 | 69 | 66 | 66 | 66 | 62 | 52 | 42 | 31 | 66 |
| | 0.13 | 68 | 65 | 64 | 65 | 61 | 51 | 40 | 29 | 65 |
| | 0.25 | 66 | 63 | 62 | 64 | 61 | 50 | 38 | 27 | 65 |
| | 0.50 | 70 | 60 | 60 | 62 | 57 | 48 | 38 | 27 | 62 |
| 700 | 0.00 | 75 | 76 | 73 | 73 | 72 | 65 | 54 | 44 | 75 |
| | 0.50 | 72 | 72 | 70 | 70 | 70 | 63 | 51 | 40 | 73 |
| | 0.75 | 72 | 72 | 68 | 69 | 70 | 63 | 51 | 39 | 72 |
| | 1.00 | 71 | 72 | 67 | 68 | 68 | 60 | 50 | 40 | 71 |

TABLE 8B-continued

Model 8 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 900 | 0.00 | 80 | 82 | 79 | 78 | 79 | 74 | 63 | 53 | 82 |
| | 0.50 | 78 | 80 | 76 | 76 | 78 | 73 | 62 | 51 | 81 |
| | 1.00 | 77 | 78 | 74 | 75 | 77 | 73 | 61 | 49 | 80 |
| | 1.70 | 78 | 76 | 72 | 73 | 75 | 68 | 58 | 49 | 77 |
| 1100 | 0.00 | 84 | 86 | 84 | 83 | 83 | 80 | 71 | 60 | 87 |
| | 0.75 | 83 | 84 | 82 | 81 | 82 | 79 | 70 | 58 | 85 |
| | 1.50 | 82 | 82 | 80 | 79 | 81 | 78 | 69 | 57 | 84 |
| | 2.50 | 83 | 81 | 78 | 77 | 79 | 75 | 66 | 56 | 82 |
| 1400 | 0.00 | 90 | 90 | 92 | 88 | 88 | 87 | 80 | 69 | 93 |
| | 1.50 | 88 | 88 | 89 | 85 | 86 | 86 | 79 | 67 | 91 |
| | 3.00 | 89 | 87 | 87 | 83 | 84 | 85 | 78 | 66 | 90 |
| | 4.10 | 90 | 86 | 85 | 82 | 83 | 82 | 74 | 65 | 88 |

TABLE 8C

Model 8 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 500 | 0.00 | 84 | 70 | 69 | 67 | 63 | 55 | 46 | 36 | 69 |
| | 0.13 | 83 | 69 | 69 | 67 | 63 | 54 | 44 | 35 | 68 |
| | 0.25 | 82 | 68 | 68 | 67 | 63 | 53 | 43 | 33 | 68 |
| | 0.50 | 79 | 66 | 65 | 65 | 60 | 54 | 48 | 42 | 66 |
| 700 | 0.00 | 76 | 78 | 77 | 76 | 73 | 67 | 58 | 48 | 77 |
| | 0.50 | 75 | 76 | 75 | 75 | 72 | 66 | 55 | 45 | 76 |
| | 0.75 | 73 | 74 | 74 | 73 | 71 | 65 | 55 | 44 | 75 |
| | 1.00 | 72 | 74 | 72 | 72 | 70 | 65 | 59 | 53 | 74 |
| 900 | 0.00 | 81 | 83 | 83 | 82 | 80 | 75 | 66 | 57 | 84 |
| | 0.50 | 80 | 83 | 82 | 81 | 79 | 75 | 65 | 55 | 84 |
| | 1.00 | 79 | 81 | 80 | 80 | 79 | 74 | 64 | 54 | 83 |
| | 1.70 | 77 | 80 | 78 | 77 | 77 | 72 | 67 | 62 | 81 |
| 1100 | 0.00 | 90 | 86 | 87 | 87 | 85 | 81 | 73 | 64 | 89 |
| | 0.75 | 89 | 86 | 86 | 86 | 84 | 81 | 73 | 63 | 88 |
| | 1.50 | 88 | 85 | 85 | 84 | 83 | 80 | 72 | 61 | 87 |
| | 2.50 | 86 | 83 | 83 | 82 | 82 | 78 | 73 | 67 | 86 |
| 1400 | 0.00 | 101 | 91 | 93 | 92 | 91 | 88 | 82 | 73 | 95 |
| | 1.50 | 100 | 90 | 92 | 91 | 90 | 87 | 81 | 71 | 94 |
| | 3.00 | 97 | 88 | 89 | 89 | 88 | 86 | 80 | 70 | 93 |
| | 4.10 | 97 | 87 | 90 | 87 | 87 | 85 | 80 | 75 | 92 |

TABLE 9A

Model 9 Air Performance

| | | 0.5"SP | | 1"SP | | 1.25"SP | | 1.5"SP | | 2"SP | | 2.5"SP | | 3"SP | | 3.5"SP | | 4"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 8000 | 1020 | 580 | 0.99 | 691 | 1.74 | 742 | 2.15 | 790 | 2.60 | 885 | 3.61 | | | | | | | | |
| 8300 | 1058 | 594 | 1.06 | 701 | 1.81 | 752 | 2.24 | 799 | 2.69 | 891 | 3.69 | | | | | | | | |
| 8600 | 1096 | 608 | 1.13 | 712 | 1.89 | 761 | 2.32 | 808 | 2.78 | 898 | 3.79 | | | | | | | | |
| 8900 | 1134 | 623 | 1.20 | 723 | 1.98 | 771 | 2.41 | 817 | 2.87 | 905 | 3.89 | 988 | 5.02 | | | | | | |
| 9200 | 1172 | 638 | 1.28 | 734 | 2.06 | 781 | 2.50 | 827 | 2.98 | 911 | 3.98 | 995 | 5.14 | | | | | | |
| 9500 | 1211 | 652 | 1.36 | 746 | 2.16 | 791 | 2.60 | 837 | 3.09 | 920 | 4.10 | 1001 | 5.25 | | | | | | |
| 9800 | 1249 | 667 | 1.44 | 757 | 2.25 | 802 | 2.70 | 846 | 3.18 | 929 | 4.22 | 1008 | 5.37 | 1084 | 6.63 | | | | |
| 10400 | 1325 | 697 | 1.63 | 780 | 2.45 | 825 | 2.92 | 867 | 3.42 | 948 | 4.49 | 1021 | 5.61 | 1097 | 6.91 | | | | |
| 11000 | 1402 | 727 | 1.83 | 805 | 2.67 | 848 | 3.16 | 889 | 3.67 | 967 | 4.76 | 1040 | 5.93 | 1110 | 7.19 | 1180 | 8.58 | | |
| 11600 | 1478 | 758 | 2.05 | 833 | 2.93 | 871 | 3.41 | 912 | 3.94 | 986 | 5.04 | 1059 | 6.25 | 1125 | 7.50 | 1193 | 8.91 | 1258 | 10.39 |
| 12200 | 1555 | 789 | 2.29 | 862 | 3.20 | 895 | 3.68 | 935 | 4.23 | 1008 | 5.37 | 1078 | 6.59 | 1144 | 7.89 | 1206 | 9.24 | 1271 | 10.76 |
| 12800 | 1631 | 821 | 2.55 | 891 | 3.50 | 924 | 4.00 | 958 | 4.53 | 1030 | 5.70 | 1097 | 6.94 | 1163 | 8.28 | 1224 | 9.66 | | |
| 13400 | 1708 | 853 | 2.83 | 921 | 3.83 | 953 | 4.35 | 982 | 4.86 | 1053 | 6.07 | 1118 | 7.34 | 1182 | 8.69 | 1243 | 10.11 | | |
| 14000 | 1784 | 886 | 3.14 | 951 | 4.18 | 982 | 4.71 | 1011 | 5.25 | 1076 | 6.45 | 1140 | 7.75 | 1201 | 9.11 | 1262 | 10.58 | | |
| 14600 | 1861 | 918 | 3.46 | 981 | 4.55 | 1011 | 5.09 | 1040 | 5.66 | 1099 | 6.85 | 1163 | 8.20 | 1222 | 9.58 | | | | |
| 15200 | 1937 | 951 | 3.82 | 1011 | 4.94 | 1040 | 5.50 | 1069 | 6.09 | 1123 | 7.29 | 1186 | 8.66 | 1244 | 10.08 | | | | |
| 15800 | 2014 | 983 | 4.19 | 1041 | 5.35 | 1070 | 5.94 | 1098 | 6.54 | 1150 | 7.76 | 1209 | 9.15 | 1266 | 10.58 | | | | |
| 16400 | 2090 | 1016 | 4.60 | 1072 | 5.80 | 1100 | 6.40 | 1127 | 7.02 | 1178 | 8.27 | 1232 | 9.65 | | | | | | |
| 17000 | 2166 | 1049 | 5.03 | 1103 | 6.27 | 1130 | 6.89 | 1157 | 7.53 | 1207 | 8.83 | 1256 | 10.19 | | | | | | |

TABLE 9A-continued

| Model 9 Air Performance | | | | | | | | | | | | | | | | | | | |
|---|---|---|---|---|---|---|---|---|---|---|---|---|---|---|---|---|---|---|---|
| | | 0.5"SP | | 1"SP | | 1.25"SP | | 1.5"SP | | 2"SP | | 2.5"SP | | 3"SP | | 3.5"SP | | 4"SP | |
| CFM | OV | RPM | BHP | RPM | BHP | RPM | BHP | RPM | BHP | RPM | BHP | RPM | BHP | RPM | BHP | RPM | BHP | RPM | BHP |
| 17600 | 2243 | 1082 | 5.49 | 1135 | 6.78 | 1161 | 7.43 | 1187 | 8.08 | 1236 | 9.40 | | | | | | | | |
| 18200 | 2319 | 1115 | 5.97 | 1167 | 7.31 | 1191 | 7.97 | 1217 | 8.65 | 1266 | 10.03 | | | | | | | | |
| 18800 | 2396 | 1149 | 6.51 | 1199 | 7.87 | 1222 | 8.55 | 1247 | 9.25 | | | | | | | | | | |
| 19400 | 2472 | 1182 | 7.05 | 1231 | 8.46 | 1254 | 9.17 | | | | | | | | | | | | |

TABLE 9B

| Model 9 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 500 | 0.00 | 72 | 69 | 68 | 69 | 65 | 55 | 45 | 34 | 69 |
| | 0.25 | 69 | 67 | 66 | 67 | 64 | 53 | 42 | 30 | 68 |
| | 0.50 | 72 | 64 | 64 | 66 | 63 | 53 | 41 | 29 | 67 |
| | 0.63 | 73 | 63 | 63 | 65 | 59 | 50 | 40 | 31 | 65 |
| 700 | 0.00 | 78 | 79 | 76 | 76 | 75 | 68 | 57 | 47 | 78 |
| | 0.25 | 77 | 77 | 74 | 75 | 74 | 67 | 56 | 45 | 77 |
| | 0.75 | 75 | 75 | 72 | 73 | 73 | 66 | 54 | 42 | 76 |
| | 1.25 | 74 | 75 | 70 | 71 | 70 | 62 | 52 | 43 | 73 |
| 900 | 0.00 | 83 | 85 | 82 | 81 | 82 | 77 | 66 | 56 | 85 |
| | 0.75 | 81 | 83 | 79 | 79 | 80 | 76 | 65 | 53 | 83 |
| | 1.25 | 80 | 81 | 77 | 78 | 80 | 75 | 64 | 52 | 83 |
| | 2.00 | 80 | 79 | 75 | 76 | 78 | 71 | 62 | 52 | 80 |
| 1100 | 0.00 | 87 | 89 | 87 | 86 | 86 | 83 | 74 | 63 | 90 |
| | 1.00 | 86 | 87 | 85 | 83 | 85 | 82 | 72 | 61 | 88 |
| | 2.00 | 85 | 85 | 83 | 82 | 83 | 81 | 72 | 60 | 87 |
| | 3.00 | 86 | 84 | 81 | 80 | 82 | 78 | 69 | 59 | 85 |
| 1275 | 0.00 | 91 | 92 | 93 | 89 | 89 | 87 | 79 | 69 | 94 |
| | 1.50 | 89 | 89 | 90 | 86 | 87 | 86 | 78 | 67 | 92 |
| | 3.00 | 90 | 88 | 88 | 84 | 86 | 85 | 77 | 65 | 90 |
| | 4.10 | 91 | 87 | 86 | 83 | 84 | 82 | 74 | 64 | 88 |

TABLE 9C

| Model 9 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 500 | 0.00 | 87 | 73 | 72 | 70 | 66 | 58 | 49 | 39 | 72 |
| | 0.25 | 85 | 72 | 71 | 70 | 66 | 57 | 46 | 36 | 71 |
| | 0.50 | 82 | 69 | 69 | 68 | 64 | 55 | 45 | 35 | 69 |
| | 0.63 | 82 | 68 | 68 | 67 | 63 | 58 | 53 | 48 | 69 |
| 700 | 0.00 | 79 | 80 | 80 | 79 | 76 | 70 | 61 | 51 | 80 |
| | 0.25 | 78 | 80 | 79 | 78 | 76 | 69 | 60 | 50 | 80 |
| | 0.75 | 77 | 78 | 77 | 77 | 75 | 68 | 58 | 48 | 79 |
| | 1.25 | 75 | 77 | 75 | 75 | 73 | 68 | 63 | 58 | 77 |
| 900 | 0.00 | 84 | 86 | 86 | 85 | 83 | 78 | 69 | 60 | 87 |
| | 0.75 | 83 | 85 | 84 | 84 | 82 | 78 | 68 | 58 | 86 |
| | 1.25 | 82 | 84 | 83 | 83 | 82 | 77 | 67 | 57 | 85 |
| | 2.00 | 80 | 83 | 81 | 80 | 80 | 75 | 69 | 64 | 84 |
| 1100 | 0.00 | 93 | 89 | 90 | 90 | 88 | 84 | 76 | 67 | 92 |
| | 1.00 | 92 | 89 | 89 | 89 | 87 | 84 | 75 | 65 | 91 |
| | 2.00 | 90 | 87 | 87 | 87 | 86 | 83 | 74 | 64 | 90 |
| | 3.00 | 89 | 86 | 86 | 85 | 85 | 81 | 76 | 70 | 89 |
| 1275 | 0.00 | 99 | 92 | 94 | 93 | 91 | 88 | 82 | 72 | 96 |
| | 1.50 | 98 | 91 | 93 | 92 | 91 | 88 | 81 | 71 | 95 |
| | 3.00 | 96 | 89 | 90 | 90 | 89 | 87 | 79 | 69 | 93 |
| | 4.10 | 96 | 89 | 91 | 88 | 88 | 85 | 80 | 75 | 92 |

TABLE 10A

Model 10 Air Performance

| | | 0.5"SP | | 1"SP | | 1.25"SP | | 1.5"SP | | 2"SP | | 2.5"SP | | 3"SP | | 3.5"SP | | 4"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 9000 | 929 | 494 | 1.05 | 601 | 1.94 | 649 | 2.44 | 697 | 3.00 | | | | | | | | | | |
| 9350 | 965 | 504 | 1.12 | 610 | 2.02 | 656 | 2.52 | 702 | 3.07 | | | | | | | | | | |
| 9700 | 1001 | 516 | 1.19 | 618 | 2.10 | 664 | 2.61 | 708 | 3.16 | | | | | | | | | | |
| 10400 | 1073 | 540 | 1.34 | 635 | 2.28 | 680 | 2.80 | 722 | 3.36 | 805 | 4.62 | | | | | | | | |
| 11100 | 1146 | 565 | 1.51 | 654 | 2.47 | 697 | 3.02 | 738 | 3.58 | 816 | 4.84 | 891 | 6.24 | | | | | | |
| 11800 | 1218 | 590 | 1.70 | 673 | 2.68 | 714 | 3.23 | 755 | 3.83 | 829 | 5.08 | 902 | 6.51 | | | | | | |
| 12500 | 1290 | 615 | 1.90 | 693 | 2.91 | 733 | 3.48 | 771 | 4.08 | 845 | 5.38 | 914 | 6.80 | 982 | 8.37 | | | | |
| 13200 | 1362 | 641 | 2.13 | 713 | 3.16 | 753 | 3.76 | 790 | 4.37 | 861 | 5.69 | 927 | 7.11 | 993 | 8.70 | 1056 | 10.39 | | |
| 13900 | 1434 | 667 | 2.38 | 736 | 3.44 | 772 | 4.03 | 809 | 4.67 | 878 | 6.03 | 943 | 7.48 | 1004 | 9.03 | 1067 | 10.77 | | |
| 14600 | 1507 | 693 | 2.65 | 760 | 3.75 | 792 | 4.33 | 828 | 4.99 | 895 | 6.38 | 959 | 7.86 | 1019 | 9.44 | 1078 | 11.15 | 1136 | 12.97 |
| 15300 | 1579 | 720 | 2.93 | 785 | 4.08 | 814 | 4.67 | 848 | 5.34 | 913 | 6.75 | 976 | 8.28 | 1035 | 9.89 | 1090 | 11.56 | 1147 | 13.41 |
| 16000 | 1651 | 747 | 3.24 | 809 | 4.43 | 838 | 5.04 | 868 | 5.71 | 933 | 7.17 | 992 | 8.69 | 1051 | 10.35 | 1106 | 12.07 | | |
| 16700 | 1723 | 774 | 3.57 | 834 | 4.81 | 863 | 5.46 | 890 | 6.11 | 952 | 7.59 | 1010 | 9.15 | 1068 | 10.85 | 1122 | 12.59 | | |
| 17400 | 1796 | 802 | 3.94 | 860 | 5.22 | 888 | 5.89 | 914 | 6.56 | 972 | 8.05 | 1029 | 9.64 | 1084 | 11.34 | 1138 | 13.13 | | |
| 18100 | 1868 | 829 | 4.32 | 885 | 5.65 | 912 | 6.33 | 938 | 7.02 | 992 | 8.53 | 1049 | 10.18 | 1101 | 11.87 | | | | |
| 18800 | 1940 | 857 | 4.73 | 911 | 6.12 | 938 | 6.83 | 963 | 7.53 | 1012 | 9.03 | 1068 | 10.71 | 1120 | 12.45 | | | | |
| 19500 | 2012 | 885 | 5.18 | 937 | 6.61 | 963 | 7.33 | 988 | 8.07 | 1035 | 9.59 | 1088 | 11.29 | 1140 | 13.09 | | | | |
| 20200 | 2085 | 913 | 5.65 | 963 | 7.13 | 988 | 7.86 | 1013 | 8.63 | 1059 | 10.18 | 1108 | 11.89 | | | | | | |
| 20900 | 2157 | 941 | 6.15 | 989 | 7.67 | 1014 | 8.44 | 1038 | 9.22 | 1083 | 10.81 | 1128 | 12.51 | | | | | | |
| 21600 | 2229 | 969 | 6.68 | 1016 | 8.24 | 1040 | 9.05 | 1064 | 9.87 | 1108 | 11.49 | 1150 | 13.18 | | | | | | |
| 22300 | 2301 | 997 | 7.24 | 1043 | 8.85 | 1066 | 9.69 | 1089 | 10.51 | 1133 | 12.20 | | | | | | | | |
| 23000 | 2374 | 1025 | 7.83 | 1071 | 9.52 | 1092 | 10.36 | 1115 | 11.21 | | | | | | | | | | |
| 23700 | 2446 | 1054 | 8.48 | 1098 | 10.19 | 1119 | 11.06 | 1141 | 11.95 | | | | | | | | | | |

TABLE 10B

Model 10 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 500 | 0.00 | 76 | 73 | 72 | 72 | 68 | 58 | 48 | 38 | 73 |
| | 0.25 | 73 | 70 | 70 | 71 | 67 | 57 | 46 | 34 | 71 |
| | 0.50 | 74 | 68 | 68 | 70 | 67 | 56 | 44 | 32 | 70 |
| | 0.75 | 76 | 66 | 66 | 68 | 63 | 54 | 44 | 34 | 68 |
| 700 | 0.00 | 82 | 82 | 79 | 79 | 78 | 71 | 60 | 50 | 81 |
| | 0.50 | 79 | 80 | 77 | 77 | 77 | 70 | 59 | 47 | 80 |
| | 1.00 | 78 | 78 | 75 | 76 | 76 | 69 | 57 | 45 | 79 |
| | 1.50 | 77 | 78 | 73 | 74 | 74 | 66 | 56 | 46 | 77 |
| 900 | 0.00 | 86 | 89 | 85 | 84 | 85 | 80 | 70 | 59 | 88 |
| | 0.75 | 84 | 86 | 83 | 83 | 84 | 79 | 68 | 57 | 87 |
| | 1.50 | 83 | 85 | 81 | 81 | 83 | 79 | 67 | 55 | 86 |
| | 2.50 | 84 | 82 | 79 | 79 | 81 | 74 | 65 | 55 | 84 |
| 1050 | 0.00 | 90 | 91 | 89 | 88 | 88 | 84 | 75 | 65 | 92 |
| | 1.00 | 88 | 89 | 87 | 86 | 87 | 84 | 74 | 63 | 91 |
| | 2.00 | 87 | 88 | 85 | 84 | 86 | 83 | 73 | 61 | 89 |
| | 3.45 | 88 | 86 | 83 | 82 | 84 | 79 | 70 | 61 | 87 |
| 1150 | 0.00 | 92 | 93 | 92 | 90 | 90 | 87 | 79 | 68 | 94 |
| | 1.50 | 90 | 90 | 89 | 87 | 88 | 86 | 77 | 66 | 92 |
| | 3.00 | 90 | 89 | 87 | 85 | 87 | 85 | 76 | 65 | 91 |
| | 4.15 | 91 | 88 | 85 | 84 | 86 | 82 | 73 | 64 | 89 |

TABLE 10C

Model 10 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 500 | 0.00 | 90 | 76 | 76 | 73 | 70 | 61 | 52 | 43 | 75 |
| | 0.25 | 89 | 75 | 75 | 73 | 69 | 60 | 50 | 40 | 74 |
| | 0.50 | 87 | 73 | 73 | 72 | 68 | 59 | 49 | 39 | 73 |
| | 0.75 | 86 | 72 | 71 | 71 | 67 | 61 | 54 | 48 | 72 |
| 700 | 0.00 | 82 | 84 | 83 | 82 | 79 | 73 | 64 | 54 | 83 |
| | 0.50 | 81 | 83 | 82 | 81 | 79 | 72 | 62 | 52 | 83 |
| | 1.00 | 80 | 81 | 80 | 80 | 78 | 71 | 61 | 51 | 82 |
| | 1.50 | 79 | 80 | 78 | 78 | 76 | 71 | 65 | 60 | 80 |

TABLE 10C-continued

| Model 10 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 900 | 0.00 | 87 | 89 | 89 | 88 | 86 | 82 | 73 | 63 | 90 |
| | 0.75 | 86 | 89 | 88 | 87 | 86 | 81 | 71 | 62 | 90 |
| | 1.50 | 85 | 87 | 86 | 86 | 85 | 80 | 70 | 60 | 89 |
| | 2.50 | 83 | 86 | 84 | 84 | 83 | 78 | 73 | 67 | 87 |
| 1050 | 0.00 | 94 | 92 | 92 | 92 | 90 | 86 | 78 | 69 | 94 |
| | 1.00 | 93 | 91 | 91 | 91 | 89 | 86 | 77 | 67 | 94 |
| | 2.00 | 92 | 90 | 90 | 90 | 89 | 85 | 76 | 66 | 93 |
| | 3.45 | 90 | 89 | 88 | 87 | 87 | 83 | 78 | 73 | 91 |
| 1150 | 0.00 | 98 | 93 | 94 | 94 | 92 | 89 | 81 | 72 | 96 |
| | 1.50 | 97 | 93 | 93 | 93 | 92 | 88 | 80 | 70 | 96 |
| | 3.00 | 95 | 91 | 91 | 91 | 90 | 87 | 79 | 69 | 94 |
| | 4.15 | 94 | 90 | 90 | 89 | 89 | 85 | 80 | 75 | 93 |

TABLE 11A

| Model 11 Air Performance | | | | | | | | | | | | | | | | | | | |
|---|---|---|---|---|---|---|---|---|---|---|---|---|---|---|---|---|---|---|---|
| | | 0.5"SP | | 0.75"SP | | 1.25"SP | | 1.5"SP | | 1.75"SP | | 2"SP | | 2.25"SP | | 2.5"SP | | 3"SP | |
| CFM | OV | RPM | BHP | RPM | BHP | RPM | BHP | RPM | BHP | RPM | BHP | RPM | BHP | RPM | BHP | RPM | BHP | RPM | BHP |
| 11000 | 938 | 452 | 1.30 | 502 | 1.81 | 591 | 2.97 | 635 | 3.65 | | | | | | | | | | |
| 11700 | 998 | 468 | 1.43 | 516 | 1.96 | 603 | 3.15 | 643 | 3.81 | 683 | 4.54 | | | | | | | | |
| 12400 | 1058 | 486 | 1.58 | 531 | 2.12 | 615 | 3.34 | 653 | 4.00 | 692 | 4.75 | 729 | 5.52 | | | | | | |
| 13100 | 1118 | 505 | 1.75 | 545 | 2.28 | 627 | 3.54 | 665 | 4.22 | 701 | 4.95 | 738 | 5.75 | 773 | 6.58 | | | | |
| 13800 | 1177 | 523 | 1.92 | 560 | 2.47 | 640 | 3.76 | 678 | 4.47 | 713 | 5.21 | 746 | 5.97 | 781 | 6.81 | 815 | 7.71 | | |
| 14500 | 1237 | 542 | 2.12 | 577 | 2.67 | 654 | 4.00 | 690 | 4.71 | 725 | 5.47 | 758 | 6.26 | 790 | 7.08 | 823 | 7.97 | | |
| 15200 | 1297 | 561 | 2.33 | 596 | 2.91 | 668 | 4.24 | 702 | 4.96 | 737 | 5.74 | 770 | 6.56 | 801 | 7.39 | 831 | 8.24 | 893 | 10.15 |
| 15900 | 1356 | 580 | 2.55 | 614 | 3.15 | 683 | 4.52 | 716 | 5.24 | 749 | 6.03 | 782 | 6.86 | 813 | 7.72 | 842 | 8.58 | | |
| 16600 | 1416 | 600 | 2.80 | 633 | 3.42 | 697 | 4.78 | 731 | 5.56 | 762 | 6.34 | 794 | 7.18 | 825 | 8.06 | 854 | 8.95 | | |
| 17300 | 1476 | 619 | 3.05 | 652 | 3.71 | 712 | 5.08 | 745 | 5.87 | 776 | 6.67 | 807 | 7.54 | 837 | 8.41 | 866 | 9.33 | | |
| 18000 | 1536 | 639 | 3.32 | 671 | 4.01 | 727 | 5.39 | 760 | 6.21 | 791 | 7.04 | 820 | 7.89 | 849 | 8.78 | 878 | 9.71 | | |
| 18700 | 1595 | 660 | 3.63 | 690 | 4.32 | 745 | 5.75 | 775 | 6.56 | 805 | 7.40 | 834 | 8.27 | 862 | 9.18 | 890 | 10.11 | | |
| 19400 | 1655 | 680 | 3.94 | 709 | 4.66 | 763 | 6.13 | 790 | 6.93 | 820 | 7.80 | 849 | 8.70 | 876 | 9.61 | | | | |
| 20100 | 1715 | 701 | 4.28 | 728 | 5.01 | 782 | 6.55 | 806 | 7.32 | 835 | 8.21 | 863 | 9.11 | 890 | 10.04 | | | | |
| 20800 | 1774 | 721 | 4.62 | 748 | 5.40 | 800 | 6.95 | 824 | 7.76 | 850 | 8.63 | 878 | 9.57 | | | | | | |
| 21500 | 1834 | 742 | 5.00 | 767 | 5.78 | 819 | 7.41 | 842 | 8.21 | 865 | 9.07 | 893 | 10.04 | | | | | | |
| 22200 | 1894 | 763 | 5.40 | 788 | 6.22 | 838 | 7.88 | 861 | 8.72 | 883 | 9.57 | | | | | | | | |
| 22900 | 1954 | 783 | 5.81 | 808 | 6.66 | 856 | 8.34 | 879 | 9.21 | | | | | | | | | | |
| 23600 | 2013 | 804 | 6.25 | 828 | 7.12 | 876 | 8.89 | 898 | 9.76 | | | | | | | | | | |
| 24300 | 2073 | 825 | 6.72 | 849 | 7.62 | 895 | 9.42 | | | | | | | | | | | | |
| 25000 | 2133 | 846 | 7.21 | 869 | 8.12 | | | | | | | | | | | | | | |
| 25700 | 2192 | 868 | 7.75 | 890 | 8.67 | | | | | | | | | | | | | | |
| 26400 | 2252 | 889 | 8.30 | | | | | | | | | | | | | | | | |

TABLE 11B

| Model 11 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 500 | 0.00 | 78 | 76 | 75 | 75 | 71 | 61 | 51 | 41 | 76 |
| | 0.25 | 77 | 74 | 73 | 74 | 70 | 60 | 49 | 38 | 74 |
| | 0.50 | 76 | 72 | 71 | 73 | 70 | 59 | 47 | 36 | 74 |
| | 0.95 | 79 | 69 | 69 | 71 | 65 | 56 | 47 | 37 | 71 |
| 600 | 0.00 | 82 | 81 | 79 | 79 | 76 | 68 | 58 | 47 | 80 |
| | 0.50 | 80 | 78 | 76 | 77 | 75 | 67 | 55 | 44 | 79 |
| | 1.00 | 82 | 77 | 74 | 76 | 74 | 66 | 54 | 42 | 78 |
| | 1.35 | 83 | 78 | 73 | 74 | 71 | 63 | 53 | 43 | 75 |
| 700 | 0.00 | 85 | 85 | 82 | 82 | 81 | 74 | 63 | 53 | 84 |
| | 0.60 | 82 | 82 | 80 | 80 | 80 | 73 | 61 | 50 | 83 |
| | 1.20 | 81 | 81 | 78 | 79 | 79 | 72 | 60 | 48 | 82 |
| | 1.80 | 80 | 81 | 76 | 77 | 77 | 69 | 59 | 49 | 80 |
| 800 | 0.00 | 87 | 89 | 85 | 85 | 85 | 79 | 68 | 58 | 88 |
| | 1.00 | 84 | 85 | 82 | 82 | 83 | 78 | 66 | 54 | 86 |
| | 1.50 | 84 | 84 | 81 | 81 | 83 | 77 | 65 | 54 | 85 |
| | 2.40 | 84 | 84 | 79 | 79 | 81 | 73 | 63 | 54 | 83 |

TABLE 11B-continued

| Model 11 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 900 | 0.00 | 89 | 92 | 88 | 87 | 88 | 83 | 73 | 62 | 91 |
| | 1.00 | 87 | 89 | 85 | 85 | 87 | 82 | 71 | 60 | 90 |
| | 2.00 | 86 | 87 | 83 | 83 | 86 | 82 | 70 | 58 | 89 |
| | 3.00 | 87 | 85 | 81 | 82 | 84 | 77 | 68 | 58 | 87 |

TABLE 11C

| Model 11 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 500 | 0.00 | 93 | 79 | 78 | 76 | 72 | 64 | 55 | 46 | 78 |
| | 0.25 | 92 | 78 | 78 | 76 | 72 | 63 | 53 | 43 | 77 |
| | 0.50 | 91 | 77 | 77 | 76 | 72 | 62 | 52 | 42 | 77 |
| | 0.95 | 89 | 75 | 74 | 73 | 69 | 64 | 59 | 54 | 75 |
| 600 | 0.00 | 97 | 83 | 83 | 81 | 78 | 71 | 61 | 52 | 83 |
| | 0.50 | 95 | 82 | 82 | 80 | 77 | 70 | 59 | 49 | 82 |
| | 1.00 | 92 | 80 | 79 | 79 | 76 | 68 | 58 | 48 | 80 |
| | 1.35 | 93 | 79 | 78 | 78 | 75 | 69 | 64 | 59 | 79 |
| 700 | 0.00 | 85 | 87 | 86 | 85 | 82 | 76 | 67 | 57 | 86 |
| | 0.60 | 84 | 86 | 85 | 84 | 82 | 75 | 65 | 55 | 86 |
| | 1.20 | 83 | 84 | 83 | 83 | 81 | 74 | 64 | 54 | 85 |
| | 1.80 | 82 | 83 | 81 | 81 | 79 | 74 | 68 | 62 | 83 |
| 800 | 0.00 | 87 | 90 | 89 | 88 | 86 | 81 | 71 | 62 | 90 |
| | 1.00 | 86 | 89 | 88 | 87 | 85 | 80 | 70 | 59 | 89 |
| | 1.50 | 85 | 87 | 86 | 86 | 85 | 79 | 69 | 59 | 88 |
| | 2.40 | 84 | 86 | 84 | 84 | 83 | 78 | 72 | 67 | 87 |
| 900 | 0.00 | 90 | 92 | 92 | 91 | 89 | 85 | 75 | 66 | 93 |
| | 1.00 | 89 | 92 | 91 | 90 | 88 | 84 | 74 | 64 | 93 |
| | 2.00 | 88 | 90 | 89 | 89 | 88 | 83 | 73 | 63 | 91 |
| | 3.00 | 86 | 89 | 87 | 87 | 86 | 81 | 76 | 70 | 90 |

TABLE 12A

| Model 12 Air Performance | | | | | | | | | | | | | | | | | | | |
|---|---|---|---|---|---|---|---|---|---|---|---|---|---|---|---|---|---|---|---|
| | | 0.5"SP | | 0.75"SP | | 1.25"SP | | 1.5"SP | | 1.75"SP | | 2"SP | | 2.25"SP | | 2.5"SP | | 3"SP | |
| CFM | OV | RPM | BHP | RPM | BHP | RPM | BHP | RPM | BHP | RPM | BHP | RPM | BHP | RPM | BHP | RPM | BHP | RPM | BHP |
| 14000 | 976 | 417 | 1.68 | 462 | 2.33 | 541 | 3.77 | 579 | 4.60 | 615 | 5.48 | | | | | | | | |
| 14800 | 1032 | 432 | 1.85 | 474 | 2.50 | 551 | 3.98 | 586 | 4.79 | 622 | 5.69 | 656 | 6.64 | | | | | | |
| 15600 | 1088 | 448 | 2.04 | 486 | 2.69 | 562 | 4.22 | 596 | 5.04 | 629 | 5.91 | 663 | 6.89 | 695 | 7.90 | | | | |
| 16400 | 1143 | 464 | 2.24 | 499 | 2.90 | 572 | 4.44 | 606 | 5.29 | 638 | 6.18 | 670 | 7.14 | 702 | 8.17 | 732 | 9.22 | | |
| 17200 | 1199 | 479 | 2.44 | 512 | 3.11 | 583 | 4.70 | 617 | 5.58 | 648 | 6.47 | 678 | 7.42 | 709 | 8.45 | 739 | 9.53 | | |
| 18000 | 1255 | 495 | 2.66 | 527 | 3.36 | 595 | 4.98 | 627 | 5.85 | 659 | 6.80 | 688 | 7.75 | 716 | 8.73 | 746 | 9.84 | 803 | 12.18 |
| 18800 | 1311 | 512 | 2.92 | 543 | 3.64 | 607 | 5.26 | 638 | 6.16 | 669 | 7.11 | 699 | 8.12 | 726 | 9.10 | 754 | 10.19 | 810 | 12.54 |
| 19600 | 1367 | 528 | 3.18 | 558 | 3.91 | 620 | 5.59 | 650 | 6.49 | 680 | 7.46 | 709 | 8.47 | 737 | 9.52 | 763 | 10.57 | 817 | 12.92 |
| 20400 | 1422 | 544 | 3.45 | 574 | 4.22 | 632 | 5.90 | 662 | 6.83 | 690 | 7.79 | 719 | 8.83 | 747 | 9.91 | 773 | 10.98 | | |
| 21200 | 1478 | 561 | 3.76 | 590 | 4.54 | 645 | 6.25 | 674 | 7.19 | 703 | 8.21 | 730 | 9.23 | 757 | 10.30 | 783 | 11.41 | | |
| 22000 | 1534 | 578 | 4.07 | 606 | 4.89 | 657 | 6.59 | 687 | 7.59 | 715 | 8.61 | 741 | 9.64 | 768 | 10.75 | 794 | 11.89 | | |
| 22800 | 1590 | 595 | 4.41 | 622 | 5.25 | 672 | 7.00 | 699 | 7.97 | 727 | 9.02 | 753 | 10.08 | 778 | 11.18 | 804 | 12.34 | | |
| 23600 | 1645 | 612 | 4.76 | 638 | 5.62 | 687 | 7.42 | 712 | 8.40 | 739 | 9.45 | 765 | 10.54 | 790 | 11.67 | 814 | 12.80 | | |
| 24400 | 1701 | 629 | 5.12 | 655 | 6.05 | 703 | 7.89 | 725 | 8.83 | 752 | 9.93 | 778 | 11.06 | 802 | 12.17 | | | | |
| 25200 | 1757 | 647 | 5.54 | 671 | 6.46 | 719 | 8.37 | 740 | 9.32 | 764 | 10.38 | 790 | 11.55 | 814 | 12.69 | | | | |
| 26000 | 1813 | 664 | 5.95 | 688 | 6.93 | 734 | 8.85 | 756 | 9.87 | 777 | 10.89 | 802 | 12.05 | | | | | | |
| 26800 | 1869 | 682 | 6.40 | 704 | 7.37 | 750 | 9.38 | 771 | 10.40 | 792 | 11.47 | 815 | 12.61 | | | | | | |
| 27600 | 1924 | 699 | 6.86 | 722 | 7.89 | 766 | 9.93 | 787 | 10.98 | 807 | 12.05 | | | | | | | | |
| 28400 | 1980 | 717 | 7.36 | 739 | 8.41 | 782 | 10.50 | 803 | 11.59 | | | | | | | | | | |
| 29200 | 2036 | 735 | 7.89 | 756 | 8.94 | 798 | 11.10 | 819 | 12.23 | | | | | | | | | | |
| 30000 | 2092 | 752 | 8.41 | 773 | 9.50 | 814 | 11.71 | | | | | | | | | | | | |
| 30800 | 2147 | 770 | 8.99 | 791 | 10.12 | | | | | | | | | | | | | | |
| 31600 | 2203 | 788 | 9.60 | 808 | 10.73 | | | | | | | | | | | | | | |

TABLE 12B

Model 12 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 500 | 0.00 | 81 | 79 | 78 | 78 | 74 | 64 | 54 | 44 | 79 |
| | 0.25 | 80 | 77 | 76 | 77 | 73 | 63 | 52 | 41 | 78 |
| | 0.75 | 80 | 74 | 74 | 76 | 73 | 62 | 50 | 38 | 76 |
| | 1.15 | 82 | 72 | 72 | 74 | 69 | 59 | 50 | 40 | 74 |
| 575 | 0.00 | 84 | 82 | 81 | 81 | 78 | 70 | 59 | 49 | 82 |
| | 0.50 | 82 | 80 | 79 | 80 | 77 | 68 | 57 | 46 | 81 |
| | 1.00 | 83 | 78 | 77 | 78 | 76 | 68 | 56 | 44 | 80 |
| | 1.50 | 85 | 76 | 75 | 77 | 73 | 65 | 55 | 45 | 77 |
| 650 | 0.00 | 86 | 86 | 83 | 84 | 82 | 74 | 64 | 53 | 85 |
| | 0.75 | 84 | 83 | 81 | 82 | 81 | 73 | 61 | 50 | 84 |
| | 1.25 | 83 | 82 | 79 | 81 | 80 | 72 | 60 | 49 | 83 |
| | 1.95 | 82 | 82 | 77 | 79 | 77 | 69 | 59 | 49 | 80 |
| 725 | 0.00 | 88 | 89 | 86 | 86 | 85 | 78 | 68 | 57 | 88 |
| | 0.75 | 86 | 87 | 84 | 84 | 84 | 77 | 66 | 55 | 87 |
| | 1.50 | 85 | 85 | 82 | 83 | 83 | 77 | 65 | 53 | 86 |
| | 2.40 | 84 | 85 | 80 | 81 | 81 | 73 | 63 | 53 | 84 |
| 820 | 0.00 | 90 | 92 | 89 | 88 | 89 | 83 | 72 | 62 | 92 |
| | 1.00 | 88 | 90 | 86 | 86 | 87 | 82 | 71 | 59 | 90 |
| | 2.00 | 87 | 88 | 84 | 85 | 86 | 81 | 69 | 58 | 89 |
| | 3.10 | 87 | 87 | 82 | 83 | 85 | 77 | 67 | 58 | 87 |

TABLE 12C

Model 12 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 500 | 0.00 | 96 | 82 | 82 | 79 | 76 | 67 | 58 | 49 | 81 |
| | 0.25 | 95 | 81 | 81 | 79 | 75 | 66 | 57 | 47 | 80 |
| | 0.75 | 92 | 79 | 79 | 78 | 74 | 65 | 55 | 44 | 79 |
| | 1.15 | 92 | 78 | 77 | 77 | 72 | 67 | 62 | 57 | 78 |
| 575 | 0.00 | 99 | 85 | 85 | 83 | 79 | 72 | 63 | 54 | 85 |
| | 0.50 | 98 | 84 | 84 | 82 | 79 | 71 | 61 | 51 | 84 |
| | 1.00 | 95 | 82 | 82 | 81 | 78 | 70 | 60 | 50 | 83 |
| | 1.50 | 95 | 81 | 80 | 80 | 76 | 71 | 65 | 60 | 81 |
| 650 | 0.00 | 87 | 88 | 88 | 86 | 83 | 76 | 67 | 58 | 87 |
| | 0.75 | 86 | 87 | 86 | 85 | 82 | 75 | 65 | 55 | 87 |
| | 1.25 | 85 | 85 | 85 | 84 | 82 | 75 | 64 | 54 | 86 |
| | 1.95 | 83 | 84 | 83 | 82 | 80 | 75 | 70 | 64 | 84 |
| 725 | 0.00 | 88 | 90 | 90 | 89 | 86 | 80 | 71 | 62 | 90 |
| | 0.75 | 88 | 90 | 89 | 88 | 86 | 80 | 70 | 60 | 90 |
| | 1.50 | 87 | 88 | 87 | 87 | 85 | 79 | 68 | 58 | 89 |
| | 2.40 | 85 | 87 | 85 | 85 | 83 | 78 | 72 | 67 | 87 |
| 820 | 0.00 | 91 | 93 | 93 | 92 | 89 | 85 | 75 | 66 | 94 |
| | 1.00 | 90 | 93 | 92 | 91 | 89 | 84 | 74 | 64 | 93 |
| | 2.00 | 89 | 91 | 90 | 90 | 88 | 83 | 73 | 63 | 92 |
| | 3.10 | 87 | 90 | 88 | 87 | 87 | 82 | 76 | 71 | 90 |

TABLE 13A

Model 13 Air Performance

| | | 0.5"SP | | 0.75"SP | | 1.25"SP | | 1.5"SP | | 1.75"SP | | 2"SP | | 2.25"SP | | 2.5"SP | | 3"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 16000 | 920 | 366 | 1.87 | 446 | 3.44 | 482 | 4.34 | 518 | 5.35 | | | | | | | | | | |
| 17000 | 977 | 378 | 2.04 | 456 | 3.67 | 491 | 4.59 | 525 | 5.59 | 558 | 6.67 | | | | | | | | |
| 18000 | 1035 | 392 | 2.25 | 466 | 3.92 | 500 | 4.85 | 532 | 5.84 | 564 | 6.92 | 595 | 8.08 | | | | | | |
| 19000 | 1092 | 407 | 2.49 | 476 | 4.17 | 510 | 5.14 | 541 | 6.14 | 571 | 7.21 | 602 | 8.41 | 631 | 9.64 | | | | |
| 20000 | 1150 | 421 | 2.72 | 487 | 4.44 | 519 | 5.41 | 550 | 6.45 | 579 | 7.53 | 608 | 8.70 | 637 | 9.96 | 664 | 11.23 | | |
| 21000 | 1207 | 436 | 2.99 | 499 | 4.76 | 530 | 5.76 | 560 | 6.80 | 589 | 7.92 | 616 | 9.07 | 644 | 10.33 | 671 | 11.63 | | |
| 22000 | 1265 | 451 | 3.28 | 510 | 5.06 | 541 | 6.10 | 570 | 7.17 | 598 | 8.29 | 625 | 9.47 | 651 | 10.71 | 678 | 12.05 | 729 | 14.87 |
| 23000 | 1322 | 466 | 3.59 | 522 | 5.40 | 552 | 6.45 | 580 | 7.54 | 608 | 8.70 | 635 | 9.92 | 660 | 11.15 | 684 | 12.41 | 735 | 15.29 |
| 24000 | 1380 | 481 | 3.91 | 534 | 5.77 | 564 | 6.86 | 591 | 7.95 | 618 | 9.14 | 644 | 10.35 | 669 | 11.61 | 693 | 12.91 | 742 | 15.79 |
| 25000 | 1437 | 497 | 4.28 | 548 | 6.18 | 575 | 7.24 | 603 | 8.42 | 628 | 9.57 | 654 | 10.83 | 679 | 12.13 | 703 | 13.47 | 748 | 16.23 |
| 26000 | 1495 | 512 | 4.65 | 562 | 6.60 | 587 | 7.68 | 614 | 8.85 | 640 | 10.09 | 664 | 11.33 | 689 | 12.67 | 712 | 13.99 | | |

TABLE 13A-continued

Model 13 Air Performance

| | | 0.5"SP | | 0.75"SP | | 1.25"SP | | 1.5"SP | | 1.75"SP | | 2"SP | | 2.25"SP | | 2.5"SP | | 3"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 27000 | 1552 | 528 | 5.05 | 577 | 7.08 | 599 | 8.13 | 626 | 9.35 | 651 | 10.59 | 675 | 11.87 | 698 | 13.16 | 722 | 14.58 | | |
| 28000 | 1610 | 544 | 5.48 | 591 | 7.55 | 613 | 8.64 | 637 | 9.83 | 662 | 11.10 | 686 | 12.42 | 709 | 13.78 | 732 | 15.19 | | |
| 29000 | 1667 | 560 | 5.93 | 606 | 8.08 | 628 | 9.21 | 649 | 10.36 | 674 | 11.68 | 697 | 12.99 | 720 | 14.39 | 742 | 15.81 | | |
| 30000 | 1725 | 576 | 6.40 | 621 | 8.63 | 642 | 9.77 | 662 | 10.94 | 686 | 12.28 | 709 | 13.63 | 731 | 15.02 | | | | |
| 31000 | 1782 | 592 | 6.90 | 636 | 9.20 | 657 | 10.39 | 677 | 11.61 | 697 | 12.85 | 721 | 14.30 | 742 | 15.66 | | | | |
| 32000 | 1840 | 609 | 7.46 | 651 | 9.81 | 671 | 10.99 | 691 | 12.25 | 710 | 13.53 | 732 | 14.92 | | | | | | |
| 33000 | 1897 | 625 | 8.02 | 666 | 10.44 | 686 | 11.67 | 705 | 12.92 | 724 | 14.25 | 744 | 15.63 | | | | | | |
| 34000 | 1955 | 641 | 8.60 | 681 | 11.10 | 701 | 12.37 | 720 | 13.67 | 738 | 14.99 | | | | | | | | |
| 35000 | 2012 | 658 | 9.25 | 697 | 11.83 | 716 | 13.11 | 735 | 14.45 | | | | | | | | | | |
| 36000 | 2070 | 674 | 9.90 | 712 | 12.55 | 731 | 13.87 | 750 | 15.26 | | | | | | | | | | |
| 37000 | 2127 | 691 | 10.62 | 728 | 13.34 | 746 | 14.66 | | | | | | | | | | | | |
| 38000 | 2185 | 707 | 11.32 | 743 | 14.09 | | | | | | | | | | | | | | |

TABLE 13B

Model 13 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 500 | 0.00 | 84 | 82 | 81 | 81 | 77 | 67 | 57 | 47 | 82 |
| | 0.50 | 82 | 79 | 78 | 80 | 76 | 66 | 54 | 43 | 80 |
| | 1.00 | 83 | 77 | 76 | 78 | 75 | 65 | 53 | 41 | 79 |
| | 1.40 | 85 | 75 | 75 | 77 | 71 | 62 | 53 | 43 | 77 |
| 575 | 0.00 | 87 | 85 | 84 | 84 | 81 | 72 | 62 | 52 | 85 |
| | 0.50 | 85 | 83 | 82 | 83 | 80 | 71 | 60 | 49 | 84 |
| | 1.00 | 85 | 82 | 80 | 82 | 80 | 71 | 59 | 47 | 83 |
| | 1.85 | 88 | 79 | 78 | 80 | 76 | 67 | 58 | 48 | 80 |
| 625 | 0.00 | 88 | 88 | 85 | 86 | 83 | 76 | 65 | 55 | 87 |
| | 0.75 | 86 | 85 | 83 | 84 | 82 | 74 | 63 | 52 | 86 |
| | 1.50 | 85 | 84 | 81 | 83 | 82 | 74 | 62 | 50 | 85 |
| | 2.20 | 84 | 84 | 79 | 81 | 79 | 70 | 61 | 51 | 82 |
| 675 | 0.00 | 90 | 90 | 87 | 87 | 86 | 78 | 68 | 58 | 89 |
| | 0.75 | 88 | 88 | 85 | 86 | 85 | 77 | 66 | 55 | 88 |
| | 1.50 | 86 | 86 | 83 | 84 | 84 | 77 | 65 | 53 | 87 |
| | 2.50 | 86 | 86 | 81 | 83 | 82 | 73 | 63 | 54 | 85 |
| 750 | 0.00 | 92 | 93 | 89 | 90 | 89 | 82 | 72 | 61 | 92 |
| | 1.00 | 90 | 90 | 87 | 88 | 88 | 81 | 70 | 59 | 91 |
| | 2.00 | 88 | 89 | 85 | 86 | 87 | 81 | 69 | 57 | 90 |
| | 3.15 | 88 | 88 | 83 | 84 | 85 | 77 | 67 | 57 | 87 |

TABLE 13C

Model 13 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 500 | 0.00 | 99 | 85 | 84 | 82 | 78 | 70 | 61 | 52 | 84 |
| | 0.50 | 97 | 84 | 83 | 82 | 78 | 69 | 59 | 49 | 83 |
| | 1.00 | 95 | 82 | 82 | 81 | 77 | 68 | 57 | 47 | 82 |
| | 1.40 | 95 | 81 | 80 | 80 | 75 | 70 | 65 | 60 | 81 |
| 575 | 0.00 | 102 | 88 | 88 | 86 | 82 | 75 | 66 | 56 | 87 |
| | 0.50 | 101 | 87 | 87 | 86 | 82 | 74 | 64 | 54 | 87 |
| | 1.00 | 99 | 86 | 86 | 85 | 82 | 73 | 63 | 53 | 86 |
| | 1.85 | 98 | 84 | 83 | 83 | 79 | 74 | 69 | 64 | 84 |
| 625 | 0.00 | 89 | 90 | 90 | 88 | 85 | 78 | 69 | 59 | 89 |
| | 0.75 | 88 | 89 | 88 | 87 | 84 | 77 | 67 | 57 | 89 |
| | 1.50 | 86 | 87 | 87 | 86 | 83 | 76 | 66 | 55 | 87 |
| | 2.20 | 86 | 86 | 85 | 84 | 82 | 77 | 72 | 67 | 86 |
| 675 | 0.00 | 90 | 99 | 91 | 90 | 87 | 81 | 71 | 62 | 91 |
| | 0.75 | 90 | 91 | 90 | 89 | 87 | 80 | 70 | 60 | 91 |
| | 1.50 | 89 | 90 | 89 | 88 | 86 | 79 | 69 | 59 | 90 |
| | 2.50 | 87 | 88 | 87 | 86 | 84 | 79 | 73 | 67 | 88 |

TABLE 13C-continued

| Model 13 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 750 | 0.00 | 92 | 94 | 94 | 93 | 90 | 84 | 75 | 66 | 94 |
| | 1.00 | 91 | 94 | 93 | 92 | 89 | 84 | 74 | 64 | 94 |
| | 2.00 | 90 | 92 | 91 | 91 | 89 | 83 | 73 | 62 | 93 |
| | 3.15 | 89 | 91 | 89 | 88 | 87 | 82 | 77 | 72 | 91 |

TABLE 14A

| Model 14 Air Performance | | | | | | | | | | | | | | | | | | | |
|---|---|---|---|---|---|---|---|---|---|---|---|---|---|---|---|---|---|---|---|
| | | 0.5"SP | | 0.75"SP | | 1.25"SP | | 1.5"SP | | 1.75"SP | | 2"SP | | 2.25"SP | | 2.5"SP | | 3"SP | |
| CFM | OV | RPM | BHP | RPM | BHP | RPM | BHP | RPM | BHP | RPM | BHP | RPM | BHP | RPM | BHP | RPM | BHP | RPM | BHP |
| 20000 | 938 | 335 | 2.36 | 407 | 4.32 | 438 | 5.39 | 471 | 6.65 | | | | | | | | | | |
| 21200 | 994 | 346 | 2.58 | 415 | 4.57 | 447 | 5.72 | 477 | 6.94 | 506 | 8.23 | | | | | | | | |
| 22400 | 1051 | 359 | 2.84 | 424 | 4.87 | 455 | 6.03 | 484 | 7.27 | 512 | 8.57 | 540 | 10.00 | | | | | | |
| 23600 | 1107 | 372 | 3.13 | 434 | 5.21 | 464 | 6.39 | 492 | 7.63 | 518 | 8.91 | 546 | 10.38 | 572 | 11.88 | | | | |
| 24800 | 1163 | 385 | 3.43 | 444 | 5.55 | 472 | 6.72 | 500 | 8.00 | 527 | 9.38 | 552 | 10.77 | 578 | 12.30 | 603 | 13.91 | | |
| 26000 | 1220 | 398 | 3.75 | 454 | 5.91 | 482 | 7.14 | 509 | 8.44 | 535 | 9.81 | 559 | 11.19 | 584 | 12.74 | 609 | 14.38 | | |
| 27200 | 1276 | 411 | 4.09 | 464 | 6.29 | 492 | 7.57 | 518 | 8.89 | 543 | 10.25 | 568 | 11.74 | 591 | 13.23 | 614 | 14.79 | 660 | 18.24 |
| 28400 | 1332 | 425 | 4.48 | 475 | 6.72 | 502 | 8.01 | 527 | 9.34 | 552 | 10.76 | 576 | 12.23 | 599 | 13.77 | 621 | 15.35 | 666 | 18.81 |
| 29600 | 1388 | 438 | 4.87 | 485 | 7.13 | 512 | 8.47 | 537 | 9.84 | 561 | 11.29 | 585 | 12.81 | 607 | 14.32 | 629 | 15.94 | 672 | 19.38 |
| 30800 | 1445 | 452 | 5.31 | 498 | 7.64 | 522 | 8.94 | 547 | 10.37 | 570 | 11.81 | 593 | 13.34 | 616 | 14.96 | 637 | 16.55 | | |
| 32000 | 1501 | 466 | 5.78 | 511 | 8.18 | 533 | 9.49 | 557 | 10.91 | 580 | 12.40 | 602 | 13.95 | 625 | 15.62 | 646 | 17.26 | | |
| 33200 | 1557 | 480 | 6.26 | 524 | 8.75 | 544 | 10.05 | 568 | 11.54 | 590 | 13.01 | 612 | 14.61 | 633 | 16.22 | 655 | 17.98 | | |
| 34400 | 1614 | 494 | 6.77 | 537 | 9.34 | 557 | 10.69 | 578 | 12.12 | 601 | 13.71 | 622 | 15.29 | 642 | 16.90 | 663 | 18.64 | | |
| 35600 | 1670 | 508 | 7.30 | 550 | 9.96 | 569 | 11.31 | 589 | 12.79 | 611 | 14.37 | 632 | 15.99 | 652 | 17.65 | 672 | 19.40 | | |
| 36800 | 1726 | 523 | 7.91 | 563 | 10.61 | 582 | 12.01 | 600 | 13.44 | 621 | 15.04 | 642 | 16.72 | 662 | 18.42 | | | | |
| 38000 | 1782 | 537 | 8.50 | 576 | 11.29 | 595 | 12.74 | 613 | 14.23 | 632 | 15.81 | 653 | 17.54 | 672 | 19.21 | | | | |
| 39200 | 1839 | 551 | 9.13 | 590 | 12.06 | 608 | 13.50 | 626 | 15.04 | 643 | 16.60 | 663 | 18.31 | | | | | | |
| 40400 | 1895 | 566 | 9.83 | 603 | 12.79 | 621 | 14.30 | 639 | 15.89 | 655 | 17.42 | 673 | 19.10 | | | | | | |
| 41600 | 1951 | 581 | 10.58 | 617 | 13.63 | 635 | 15.19 | 652 | 16.77 | 668 | 18.35 | | | | | | | | |
| 42800 | 2008 | 595 | 11.30 | 630 | 14.43 | 648 | 16.05 | 665 | 17.68 | | | | | | | | | | |
| 44000 | 2064 | 610 | 12.12 | 644 | 15.34 | 661 | 16.94 | | | | | | | | | | | | |
| 45200 | 2120 | 624 | 12.91 | 658 | 16.28 | 675 | 17.94 | | | | | | | | | | | | |
| 46400 | 2176 | 639 | 13.81 | 672 | 17.23 | | | | | | | | | | | | | | |

TABLE 14B

| Model 14 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 400 | 0.00 | 83 | 79 | 79 | 79 | 73 | 62 | 52 | 41 | 79 |
| | 0.50 | 79 | 76 | 76 | 77 | 72 | 60 | 48 | 37 | 77 |
| | 0.75 | 81 | 74 | 75 | 77 | 71 | 59 | 48 | 36 | 76 |
| | 1.10 | 83 | 73 | 73 | 75 | 67 | 57 | 48 | 38 | 74 |
| 475 | 0.00 | 87 | 83 | 83 | 83 | 78 | 69 | 58 | 48 | 83 |
| | 0.50 | 84 | 81 | 81 | 82 | 78 | 67 | 56 | 44 | 82 |
| | 1.00 | 85 | 79 | 79 | 81 | 77 | 66 | 54 | 42 | 81 |
| | 1.50 | 87 | 77 | 77 | 79 | 74 | 64 | 54 | 44 | 79 |
| 550 | 0.00 | 89 | 87 | 86 | 86 | 83 | 74 | 64 | 53 | 87 |
| | 0.75 | 87 | 85 | 83 | 85 | 82 | 73 | 61 | 50 | 86 |
| | 1.50 | 89 | 82 | 81 | 83 | 81 | 72 | 60 | 48 | 84 |
| | 2.10 | 90 | 81 | 80 | 82 | 77 | 69 | 59 | 50 | 82 |
| 625 | 0.00 | 92 | 91 | 89 | 89 | 87 | 79 | 68 | 58 | 90 |
| | 1.00 | 89 | 88 | 86 | 87 | 85 | 77 | 66 | 54 | 89 |
| | 2.00 | 88 | 87 | 84 | 85 | 85 | 77 | 65 | 53 | 88 |
| | 2.70 | 87 | 88 | 83 | 84 | 82 | 73 | 64 | 54 | 85 |
| 675 | 0.00 | 93 | 93 | 90 | 90 | 89 | 81 | 71 | 61 | 92 |
| | 1.00 | 91 | 91 | 88 | 89 | 88 | 80 | 69 | 58 | 91 |
| | 2.00 | 89 | 89 | 86 | 87 | 87 | 80 | 68 | 56 | 90 |
| | 3.15 | 89 | 89 | 84 | 85 | 84 | 76 | 66 | 57 | 87 |

TABLE 14C

Model 14 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 400 | 0.00 | 97 | 83 | 87 | 80 | 75 | 65 | 56 | 47 | 81 |
| | 0.50 | 95 | 82 | 81 | 79 | 74 | 64 | 53 | 43 | 80 |
| | 0.75 | 93 | 80 | 80 | 78 | 73 | 63 | 53 | 42 | 79 |
| | 1.10 | 93 | 78 | 78 | 77 | 72 | 67 | 62 | 56 | 78 |
| 475 | 0.00 | 101 | 87 | 86 | 84 | 80 | 71 | 62 | 53 | 86 |
| | 0.50 | 100 | 86 | 86 | 84 | 80 | 70 | 60 | 50 | 85 |
| | 1.00 | 97 | 84 | 84 | 83 | 79 | 69 | 59 | 49 | 84 |
| | 1.50 | 96 | 82 | 82 | 82 | 77 | 71 | 65 | 59 | 83 |
| 550 | 0.00 | 104 | 90 | 90 | 88 | 84 | 77 | 67 | 58 | 89 |
| | 0.75 | 103 | 89 | 89 | 87 | 84 | 75 | 65 | 55 | 89 |
| | 1.50 | 100 | 87 | 87 | 86 | 83 | 74 | 64 | 54 | 87 |
| | 2.10 | 100 | 86 | 85 | 85 | 81 | 76 | 71 | 66 | 86 |
| 625 | 0.00 | 92 | 92 | 93 | 91 | 88 | 81 | 77 | 62 | 92 |
| | 1.00 | 91 | 92 | 91 | 90 | 87 | 80 | 70 | 60 | 92 |
| | 2.00 | 89 | 90 | 89 | 89 | 86 | 79 | 69 | 58 | 90 |
| | 2.70 | 89 | 89 | 88 | 87 | 85 | 80 | 75 | 70 | 89 |
| 675 | 0.00 | 93 | 95 | 94 | 93 | 90 | 84 | 74 | 65 | 94 |
| | 1.00 | 93 | 94 | 93 | 92 | 90 | 83 | 73 | 63 | 94 |
| | 2.00 | 91 | 92 | 92 | 91 | 89 | 82 | 72 | 61 | 93 |
| | 3.15 | 90 | 91 | 89 | 89 | 87 | 82 | 77 | 72 | 91 |

TABLE 15A

Model 15 Air Performance

| | | 0.5"SP | | 0.75"SP | | 1.25"SP | | 1.5"SP | | 1.75"SP | | 2"SP | | 2.25"SP | | 2.5"SP | | 3"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 25000 | 967 | 309 | 2.99 | 373 | 5.38 | 402 | 6.74 | 430 | 8.21 | 457 | 9.80 | | | | | | | | |
| 26500 | 1025 | 321 | 3.31 | 382 | 5.77 | 410 | 7.14 | 436 | 8.60 | 463 | 10.23 | 488 | 11.92 | | | | | | |
| 28000 | 1083 | 333 | 3.65 | 390 | 6.13 | 418 | 7.57 | 444 | 9.08 | 468 | 10.62 | 494 | 12.42 | 517 | 14.17 | | | | |
| 29500 | 1141 | 345 | 4.01 | 399 | 6.53 | 426 | 8.00 | 451 | 9.51 | 475 | 11.12 | 499 | 12.85 | 523 | 14.73 | 545 | 16.60 | | |
| 31000 | 1199 | 357 | 4.40 | 409 | 7.01 | 434 | 8.45 | 459 | 10.02 | 483 | 11.68 | 505 | 13.36 | 528 | 15.22 | 551 | 17.22 | | |
| 32500 | 1257 | 370 | 4.85 | 419 | 7.50 | 444 | 9.01 | 468 | 10.61 | 491 | 12.27 | 513 | 14.00 | 534 | 15.80 | 556 | 17.76 | 598 | 21.94 |
| 34000 | 1315 | 382 | 5.28 | 428 | 7.97 | 453 | 9.54 | 476 | 11.15 | 499 | 12.87 | 521 | 14.66 | 542 | 16.51 | 562 | 18.41 | 603 | 22.57 |
| 35500 | 1373 | 395 | 5.79 | 438 | 8.51 | 463 | 10.14 | 485 | 11.75 | 507 | 13.49 | 529 | 15.33 | 550 | 17.25 | 569 | 19.11 | 609 | 23.33 |
| 37000 | 1432 | 407 | 6.29 | 450 | 9.15 | 472 | 10.71 | 495 | 12.45 | 516 | 14.20 | 537 | 16.03 | 558 | 18.00 | 577 | 19.92 | 614 | 23.99 |
| 38500 | 1490 | 420 | 6.86 | 462 | 9.81 | 482 | 11.37 | 504 | 13.10 | 525 | 14.90 | 545 | 16.75 | 566 | 18.78 | 585 | 20.75 | | |
| 40000 | 1548 | 433 | 7.45 | 474 | 10.50 | 492 | 12.05 | 514 | 13.85 | 535 | 15.72 | 554 | 17.55 | 574 | 19.58 | 593 | 21.60 | | |
| 41500 | 1606 | 447 | 8.13 | 486 | 11.22 | 504 | 12.84 | 524 | 14.62 | 544 | 16.47 | 564 | 18.46 | 582 | 20.39 | 601 | 22.47 | | |
| 43000 | 1664 | 460 | 8.78 | 498 | 11.98 | 516 | 13.67 | 533 | 15.35 | 554 | 17.34 | 573 | 19.30 | 591 | 21.28 | 609 | 23.37 | | |
| 44500 | 1722 | 473 | 9.48 | 510 | 12.78 | 528 | 14.53 | 544 | 16.23 | 563 | 18.15 | 583 | 20.27 | 601 | 22.32 | 618 | 24.37 | | |
| 46000 | 1780 | 487 | 10.27 | 523 | 13.68 | 540 | 15.42 | 556 | 17.19 | 573 | 19.08 | 592 | 21.16 | 610 | 23.27 | | | | |
| 47500 | 1838 | 501 | 11.11 | 535 | 14.55 | 552 | 16.36 | 568 | 18.19 | 583 | 20.03 | 602 | 22.19 | | | | | | |
| 49000 | 1896 | 514 | 11.92 | 548 | 15.54 | 565 | 17.43 | 580 | 19.23 | 595 | 21.14 | 612 | 23.26 | | | | | | |
| 50500 | 1954 | 528 | 12.85 | 561 | 16.58 | 577 | 18.44 | 592 | 20.31 | 607 | 22.28 | | | | | | | | |
| 52000 | 2012 | 541 | 13.75 | 573 | 17.57 | 589 | 19.50 | 605 | 21.54 | 619 | 23.47 | | | | | | | | |
| 53500 | 2070 | 555 | 14.77 | 586 | 18.70 | 602 | 20.70 | 617 | 22.71 | | | | | | | | | | |
| 55000 | 2128 | 569 | 15.84 | 599 | 19.86 | 615 | 21.95 | | | | | | | | | | | | |
| 56500 | 2186 | 583 | 16.97 | 612 | 21.04 | | | | | | | | | | | | | | |
| 58000 | 2244 | 597 | 18.14 | | | | | | | | | | | | | | | | |

TABLE 15B

Model 15 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 300 | 0.00 | 77 | 76 | 76 | 73 | 65 | 55 | 44 | 34 | 73 |
| | 0.75 | 76 | 73 | 74 | 77 | 64 | 52 | 41 | 30 | 72 |
| | 0.50 | 78 | 71 | 73 | 72 | 63 | 51 | 39 | 27 | 71 |
| | 0.75 | 80 | 70 | 71 | 68 | 60 | 50 | 40 | 31 | 68 |
| 375 | 0.00 | 84 | 80 | 80 | 80 | 73 | 63 | 52 | 42 | 80 |
| | 0.50 | 81 | 78 | 78 | 78 | 72 | 60 | 49 | 37 | 78 |
| | 0.75 | 83 | 76 | 77 | 78 | 72 | 60 | 48 | 36 | 77 |
| | 1.15 | 84 | 74 | 75 | 76 | 68 | 58 | 48 | 38 | 75 |

TABLE 15B-continued

Model 15 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 450 | 0.00 | 88 | 85 | 84 | 85 | 80 | 70 | 59 | 49 | 85 |
| | 0.50 | 86 | 83 | 82 | 84 | 79 | 68 | 57 | 46 | 84 |
| | 1.00 | 86 | 80 | 81 | 83 | 79 | 67 | 55 | 43 | 83 |
| | 1.70 | 88 | 78 | 79 | 81 | 74 | 64 | 55 | 45 | 80 |
| 525 | 0.00 | 91 | 89 | 88 | 88 | 84 | 75 | 65 | 54 | 89 |
| | 0.75 | 89 | 83 | 86 | 87 | 83 | 74 | 62 | 51 | 87 |
| | 1.50 | 90 | 84 | 84 | 85 | 83 | 73 | 61 | 49 | 86 |
| | 2.30 | 92 | 82 | 82 | 84 | 79 | 70 | 60 | 51 | 84 |
| 615 | 0.00 | 94 | 93 | 91 | 91 | 89 | 81 | 71 | 60 | 93 |
| | 1.00 | 92 | 91 | 89 | 90 | 88 | 80 | 69 | 57 | 91 |
| | 2.00 | 90 | 90 | 87 | 88 | 87 | 79 | 67 | 55 | 90 |
| | 3.15 | 89 | 90 | 85 | 87 | 84 | 76 | 66 | 56 | 88 |

TABLE 15C

Model 15 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 300 | 0.00 | 94 | 80 | 78 | 75 | 68 | 58 | 49 | 40 | 76 |
| | 0.25 | 92 | 79 | 77 | 74 | 67 | 57 | 46 | 36 | 75 |
| | 0.50 | 90 | 77 | 76 | 73 | 65 | 55 | 45 | 35 | 74 |
| | 0.75 | 90 | 75 | 74 | 72 | 66 | 61 | 56 | 51 | 73 |
| 375 | 0.00 | 99 | 85 | 84 | 81 | 75 | 66 | 57 | 47 | 82 |
| | 0.50 | 97 | 83 | 83 | 80 | 74 | 64 | 54 | 44 | 81 |
| | 0.75 | 95 | 82 | 82 | 80 | 74 | 63 | 53 | 43 | 80 |
| | 1.15 | 94 | 80 | 79 | 78 | 73 | 67 | 62 | 56 | 79 |
| 450 | 0.00 | 102 | 89 | 88 | 86 | 82 | 72 | 63 | 54 | 87 |
| | 0.50 | 101 | 88 | 87 | 85 | 81 | 71 | 61 | 51 | 87 |
| | 1.00 | 100 | 86 | 86 | 85 | 80 | 70 | 60 | 50 | 86 |
| | 1.70 | 98 | 84 | 83 | 83 | 78 | 73 | 68 | 63 | 84 |
| 525 | 0.00 | 106 | 93 | 92 | 90 | 86 | 78 | 69 | 59 | 91 |
| | 0.75 | 105 | 91 | 91 | 89 | 85 | 77 | 67 | 57 | 90 |
| | 1.50 | 102 | 89 | 89 | 88 | 84 | 76 | 65 | 55 | 89 |
| | 2.30 | 102 | 88 | 87 | 87 | 83 | 78 | 72 | 67 | 88 |
| 615 | 0.00 | 95 | 96 | 95 | 94 | 90 | 83 | 74 | 65 | 95 |
| | 1.00 | 94 | 95 | 94 | 93 | 90 | 83 | 73 | 63 | 94 |
| | 2.00 | 93 | 93 | 93 | 92 | 89 | 82 | 71 | 61 | 93 |
| | 3.15 | 91 | 92 | 90 | 90 | 87 | 82 | 77 | 72 | 92 |

TABLE 16A

Model 16 Air Performance

| | | 0.5"SP | | 0.75"SP | | 1.25"SP | | 1.5"SP | | 1.75"SP | | 2"SP | | 2.25"SP | | 2.5"SP | | 3"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 30000 | 949 | 276 | 3.55 | 335 | 6.48 | 361 | 8.12 | 387 | 9.94 | | | | | | | | | | |
| 31800 | 1006 | 286 | 3.91 | 342 | 6.89 | 368 | 8.60 | 392 | 10.38 | 416 | 12.33 | | | | | | | | |
| 33600 | 1063 | 296 | 4.28 | 349 | 7.32 | 375 | 9.09 | 398 | 10.88 | 421 | 12.83 | 444 | 14.97 | | | | | | |
| 35400 | 1120 | 307 | 4.72 | 357 | 7.80 | 382 | 9.60 | 405 | 11.46 | 426 | 13.34 | 449 | 15.55 | 470 | 17.75 | | | | |
| 37200 | 1176 | 318 | 5.19 | 366 | 8.37 | 389 | 10.13 | 412 | 12.05 | 433 | 14.00 | 454 | 16.14 | 475 | 18.40 | 495 | 20.73 | | |
| 39000 | 1233 | 329 | 5.69 | 374 | 8.89 | 397 | 10.74 | 419 | 12.67 | 440 | 14.69 | 460 | 16.80 | 480 | 19.06 | 500 | 21.45 | | |
| 40800 | 1290 | 340 | 6.22 | 383 | 9.51 | 405 | 11.36 | 426 | 13.31 | 447 | 15.39 | 467 | 17.56 | 486 | 19.81 | 505 | 22.18 | 543 | 27.37 |
| 42600 | 1347 | 351 | 6.79 | 391 | 10.09 | 414 | 12.09 | 434 | 14.03 | 454 | 16.12 | 474 | 18.36 | 493 | 20.67 | 511 | 23.03 | 548 | 28.23 |
| 44400 | 1404 | 362 | 7.39 | 401 | 10.82 | 422 | 12.76 | 442 | 14.77 | 462 | 16.97 | 481 | 19.17 | 500 | 21.55 | 518 | 23.98 | 552 | 28.95 |
| 46200 | 1461 | 373 | 8.03 | 411 | 11.54 | 431 | 13.54 | 451 | 15.64 | 470 | 17.82 | 488 | 20.01 | 507 | 22.46 | 525 | 24.95 | 558 | 29.99 |
| 48000 | 1518 | 385 | 8.76 | 422 | 12.38 | 439 | 14.27 | 459 | 16.43 | 478 | 18.68 | 496 | 20.99 | 514 | 23.39 | 532 | 25.95 | | |
| 49800 | 1575 | 396 | 9.45 | 432 | 13.17 | 449 | 15.18 | 468 | 17.36 | 486 | 19.57 | 504 | 21.95 | 521 | 24.35 | 539 | 26.97 | | |
| 51600 | 1632 | 408 | 10.24 | 443 | 14.10 | 459 | 16.08 | 476 | 18.21 | 495 | 20.62 | 512 | 22.95 | 529 | 25.44 | 546 | 28.03 | | |
| 53400 | 1689 | 420 | 11.09 | 454 | 15.06 | 470 | 17.13 | 485 | 19.21 | 503 | 21.57 | 521 | 24.11 | 537 | 26.53 | 553 | 29.10 | | |
| 55200 | 1746 | 432 | 11.98 | 465 | 16.07 | 481 | 18.22 | 495 | 20.28 | 512 | 22.69 | 529 | 25.16 | 546 | 27.81 | | | | |
| 57000 | 1803 | 444 | 12.92 | 476 | 17.12 | 491 | 19.24 | 506 | 21.50 | 521 | 23.84 | 538 | 26.40 | 554 | 28.97 | | | | |
| 58800 | 1860 | 456 | 13.90 | 487 | 18.22 | 502 | 20.43 | 517 | 22.77 | 530 | 24.98 | 546 | 27.52 | | | | | | |
| 60600 | 1917 | 468 | 14.94 | 498 | 19.37 | 513 | 21.66 | 527 | 23.95 | 541 | 26.38 | 555 | 28.83 | | | | | | |
| 62400 | 1973 | 480 | 16.03 | 510 | 20.69 | 524 | 22.94 | 538 | 25.32 | 551 | 27.68 | | | | | | | | |

TABLE 16A-continued

| Model 16 Air Performance | | | | | | | | | | | | | | | | | | | |
|---|---|---|---|---|---|---|---|---|---|---|---|---|---|---|---|---|---|---|---|
| | | 0.5"SP | | 0.75"SP | | 1.25"SP | | 1.5"SP | | 1.75"SP | | 2"SP | | 2.25"SP | | 2.5"SP | | 3"SP | |
| CFM | OV | RPM | BHP | RPM | BHP | RPM | BHP | RPM | BHP | RPM | BHP | RPM | BHP | RPM | BHP | RPM | BHP | RPM | BHP |
| 64200 | 2030 | 492 | 17.18 | 521 | 21.94 | 535 | 24.27 | 549 | 26.74 | | | | | | | | | | |
| 66000 | 2087 | 504 | 18.38 | 532 | 23.24 | 546 | 25.66 | | | | | | | | | | | | |
| 67800 | 2144 | 516 | 19.63 | 544 | 24.72 | 557 | 27.10 | | | | | | | | | | | | |
| 69600 | 2201 | 529 | 21.07 | 555 | 26.08 | | | | | | | | | | | | | | |

TABLE 16B

| Model 16 Inlet Sound Performance | | | | | | | | | | |
|---|---|---|---|---|---|---|---|---|---|---|
| | Nom | INLET SOUND POWER BY OCTAVE BANDS dB Lwi | | | | | | | | |
| RPM | Ps | 63 | 125 | 250 | 500 | 1000 | 2000 | 4000 | 8000 | LwiA |
| 250 | 0.00 | 76 | 75 | 75 | 71 | 61 | 51 | 41 | 30 | 71 |
| | 0.20 | 73 | 73 | 74 | 70 | 60 | 49 | 37 | 26 | 70 |
| | 0.40 | 71 | 71 | 73 | 69 | 59 | 47 | 35 | 24 | 69 |
| | 0.60 | 69 | 69 | 71 | 67 | 57 | 47 | 36 | 26 | 67 |
| 325 | 0.00 | 83 | 80 | 81 | 79 | 71 | 61 | 50 | 40 | 79 |
| | 0.50 | 81 | 77 | 78 | 77 | 69 | 58 | 46 | 34 | 77 |
| | 0.75 | 83 | 76 | 77 | 77 | 69 | 57 | 45 | 34 | 76 |
| | 1.00 | 84 | 75 | 76 | 75 | 67 | 56 | 46 | 35 | 75 |
| 400 | 0.00 | 89 | 85 | 85 | 85 | 79 | 68 | 58 | 47 | 85 |
| | 0.50 | 86 | 83 | 83 | 84 | 78 | 67 | 55 | 44 | 83 |
| | 1.00 | 87 | 81 | 81 | 83 | 77 | 66 | 54 | 42 | 83 |
| | 1.65 | 89 | 79 | 79 | 81 | 73 | 63 | 54 | 44 | 80 |
| 475 | 0.00 | 93 | 89 | 89 | 89 | 84 | 75 | 64 | 54 | 89 |
| | 0.75 | 90 | 87 | 86 | 88 | 84 | 73 | 62 | 50 | 88 |
| | 1.50 | 91 | 85 | 85 | 87 | 83 | 72 | 60 | 48 | 87 |
| | 2.30 | 93 | 83 | 83 | 85 | 79 | 69 | 60 | 50 | 85 |
| 550 | 0.00 | 95 | 93 | 92 | 92 | 89 | 80 | 70 | 59 | 93 |
| | 1.00 | 93 | 91 | 90 | 91 | 88 | 79 | 67 | 56 | 92 |
| | 2.00 | 94 | 89 | 88 | 89 | 87 | 78 | 66 | 54 | 91 |
| | 3.10 | 96 | 87 | 86 | 88 | 83 | 75 | 65 | 56 | 88 |

TABLE 16C

| Model 16 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 250 | 0.00 | 79 | 79 | 76 | 72 | 64 | 55 | 46 | 36 | 73 |
| | 0.20 | 78 | 78 | 76 | 72 | 63 | 53 | 43 | 33 | 73 |
| | 0.40 | 76 | 76 | 75 | 71 | 62 | 52 | 41 | 31 | 72 |
| | 0.60 | 75 | 74 | 74 | 70 | 63 | 56 | 50 | 43 | 71 |
| 325 | 0.00 | 98 | 84 | 83 | 80 | 73 | 64 | 55 | 46 | 81 |
| | 0.50 | 97 | 83 | 82 | 79 | 72 | 62 | 51 | 41 | 80 |
| | 0.75 | 95 | 81 | 81 | 78 | 71 | 61 | 51 | 41 | 79 |
| | 1.00 | 94 | 80 | 80 | 77 | 71 | 64 | 57 | 50 | 78 |
| 400 | 0.00 | 103 | 89 | 88 | 86 | 81 | 71 | 62 | 53 | 87 |
| | 0.50 | 102 | 88 | 88 | 85 | 80 | 70 | 60 | 50 | 86 |
| | 1.00 | 100 | 86 | 86 | 85 | 79 | 69 | 59 | 48 | 85 |
| | 1.65 | 99 | 84 | 84 | 83 | 78 | 73 | 68 | 63 | 84 |
| 475 | 0.00 | 107 | 92 | 92 | 90 | 86 | 77 | 68 | 59 | 92 |
| | 0.75 | 106 | 92 | 92 | 90 | 86 | 76 | 66 | 56 | 91 |
| | 1.50 | 103 | 90 | 90 | 89 | 85 | 75 | 65 | 55 | 90 |
| | 2.30 | 103 | 88 | 88 | 87 | 83 | 78 | 73 | 67 | 89 |
| 550 | 0.00 | 110 | 96 | 96 | 94 | 90 | 83 | 73 | 64 | 95 |
| | 1.00 | 109 | 95 | 95 | 93 | 90 | 82 | 72 | 61 | 95 |
| | 2.00 | 106 | 93 | 93 | 92 | 89 | 80 | 70 | 60 | 94 |
| | 3.10 | 106 | 92 | 91 | 91 | 87 | 82 | 77 | 72 | 92 |

TABLE 17A

Model 17 Air Performance

| | | 0.5"SP | | 1"SP | | 1.25"SP | | 1.5"SP | | 1.75"SP | | 2"SP | | 2.25"SP | | 2.5"SP | | 3"SP | |
|---|---|---|---|---|---|---|---|---|---|---|---|---|---|---|---|---|---|---|---|
| CFM | OV | RPM | BHP | RPM | BHP | RPM | BHP | RPM | BHP | RPM | BHP | RPM | BHP | RPM | BHP | RPM | BHP | RPM | BHP |
| 35000 | 903 | 244 | 4.07 | 298 | 7.55 | 322 | 9.51 | 346 | 11.71 | | | | | | | | | | |
| 37200 | 960 | 251 | 4.41 | 304 | 8.01 | 327 | 9.99 | 351 | 12.29 | 373 | 14.65 | | | | | | | | |
| 39400 | 1017 | 260 | 4.85 | 311 | 8.57 | 334 | 10.63 | 355 | 12.77 | 377 | 15.20 | | | | | | | | |
| 41600 | 1074 | 270 | 5.37 | 317 | 9.07 | 340 | 11.21 | 361 | 13.43 | 382 | 15.88 | 402 | 18.41 | | | | | | |
| 43800 | 1130 | 280 | 5.91 | 325 | 9.73 | 347 | 11.91 | 367 | 14.10 | 387 | 16.55 | 407 | 19.18 | 426 | 21.89 | | | | |
| 46000 | 1187 | 289 | 6.43 | 332 | 10.33 | 353 | 12.53 | 374 | 14.92 | 393 | 17.33 | 411 | 19.83 | 431 | 22.76 | 449 | 25.63 | | |
| 48200 | 1244 | 299 | 7.06 | 340 | 11.05 | 360 | 13.24 | 380 | 15.64 | 399 | 18.12 | 417 | 20.70 | 435 | 23.49 | 453 | 26.42 | | |
| 50400 | 1301 | 309 | 7.72 | 348 | 11.80 | 368 | 14.09 | 387 | 16.51 | 406 | 19.08 | 424 | 21.75 | 441 | 24.49 | 458 | 27.40 | 492 | 33.72 |
| 52600 | 1357 | 319 | 8.42 | 356 | 12.59 | 376 | 14.97 | 394 | 17.36 | 412 | 19.93 | 430 | 22.67 | 447 | 25.49 | 463 | 28.34 | 496 | 34.67 |
| 54800 | 1414 | 330 | 9.25 | 364 | 13.36 | 383 | 15.77 | 402 | 18.38 | 419 | 20.94 | 437 | 23.79 | 453 | 26.52 | 469 | 29.45 | 500 | 35.63 |
| 57000 | 1471 | 340 | 10.04 | 374 | 14.36 | 391 | 16.72 | 409 | 19.29 | 426 | 21.94 | 443 | 24.77 | 460 | 27.75 | 476 | 30.77 | | |
| 59200 | 1528 | 350 | 10.87 | 383 | 15.29 | 399 | 17.71 | 417 | 20.38 | 434 | 23.12 | 450 | 25.92 | 466 | 28.84 | 482 | 31.93 | | |
| 61400 | 1584 | 361 | 11.82 | 393 | 16.39 | 408 | 18.81 | 425 | 21.50 | 442 | 24.35 | 457 | 27.07 | 473 | 30.14 | 488 | 33.13 | | |
| 63600 | 1641 | 371 | 12.72 | 403 | 17.53 | 417 | 19.92 | 433 | 22.67 | 449 | 25.45 | 465 | 28.43 | 480 | 31.43 | 495 | 34.56 | | |
| 65800 | 1698 | 382 | 13.78 | 413 | 18.73 | 427 | 21.22 | 441 | 23.88 | 457 | 26.75 | 473 | 29.83 | 487 | 32.72 | | | | |
| 68000 | 1755 | 393 | 14.90 | 423 | 19.99 | 437 | 22.58 | 450 | 25.17 | 465 | 28.11 | 480 | 31.09 | 495 | 34.27 | | | | |
| 70200 | 1812 | 404 | 16.08 | 433 | 21.30 | 446 | 23.83 | 460 | 26.69 | 473 | 29.50 | 488 | 32.58 | | | | | | |
| 72400 | 1868 | 415 | 17.32 | 443 | 22.67 | 456 | 25.30 | 469 | 28.09 | 482 | 31.04 | 496 | 34.12 | | | | | | |
| 74600 | 1925 | 425 | 18.50 | 453 | 24.10 | 466 | 26.83 | 479 | 29.72 | 491 | 32.58 | | | | | | | | |
| 76800 | 1982 | 436 | 19.86 | 463 | 25.59 | 476 | 28.42 | 489 | 31.42 | | | | | | | | | | |
| 79000 | 2039 | 447 | 21.30 | 473 | 27.14 | 486 | 30.08 | 498 | 32.98 | | | | | | | | | | |
| 81200 | 2095 | 458 | 22.80 | 483 | 28.76 | 496 | 31.80 | | | | | | | | | | | | |
| 83400 | 2152 | 469 | 24.37 | 494 | 30.58 | | | | | | | | | | | | | | |

TABLE 17B

Model 17 Inlet Sound Performance

| | Nom | INLET SOUND POWER BY OCTAVE BANDS dB Lwi | | | | | | | | |
|---|---|---|---|---|---|---|---|---|---|---|
| RPM | Ps | 63 | 125 | 250 | 500 | 1000 | 2000 | 4000 | 8000 | LwiA |
| 225 | 0.00 | 76 | 75 | 76 | 71 | 61 | 50 | 40 | 29 | 72 |
| | 0.25 | 73 | 73 | 75 | 70 | 59 | 47 | 36 | 24 | 70 |
| | 0.50 | 70 | 71 | 73 | 69 | 58 | 46 | 34 | 22 | 69 |
| | 0.63 | 69 | 70 | 72 | 65 | 56 | 46 | 36 | 26 | 67 |
| 300 | 0.00 | 84 | 82 | 82 | 79 | 71 | 61 | 50 | 40 | 79 |
| | 0.50 | 82 | 79 | 80 | 78 | 70 | 58 | 46 | 35 | 78 |
| | 0.75 | 84 | 77 | 79 | 78 | 69 | 57 | 45 | 34 | 77 |
| | 1.15 | 86 | 76 | 77 | 74 | 65 | 56 | 47 | 38 | 74 |
| 375 | 0.00 | 90 | 87 | 87 | 86 | 79 | 69 | 59 | 48 | 86 |
| | 0.63 | 88 | 84 | 85 | 85 | 78 | 67 | 56 | 44 | 84 |
| | 1.25 | 89 | 82 | 83 | 84 | 78 | 66 | 54 | 42 | 83 |
| | 1.75 | 91 | 80 | 81 | 82 | 74 | 64 | 55 | 45 | 81 |
| 450 | 0.00 | 95 | 91 | 90 | 91 | 86 | 76 | 65 | 55 | 91 |
| | 0.75 | 92 | 89 | 89 | 90 | 85 | 74 | 63 | 52 | 90 |
| | 1.50 | 92 | 87 | 87 | 89 | 85 | 73 | 61 | 50 | 89 |
| | 2.50 | 95 | 85 | 85 | 87 | 80 | 71 | 61 | 51 | 87 |
| 500 | 0.00 | 97 | 94 | 93 | 93 | 89 | 80 | 69 | 59 | 94 |
| | 1.00 | 94 | 91 | 91 | 92 | 88 | 78 | 67 | 56 | 92 |
| | 2.00 | 95 | 89 | 89 | 91 | 88 | 77 | 65 | 54 | 91 |
| | 3.15 | 97 | 87 | 87 | 89 | 83 | 74 | 65 | 55 | 89 |

TABLE 17C

Model 17 Outlet Sound Performance

| | Nom | OUTLET SOUND POWER BY OCTAVE BANDS dB Lwo | | | | | | | | Lwo |
|---|---|---|---|---|---|---|---|---|---|---|
| RPM | Ps | 63 | 125 | 250 | 500 | 1000 | 2000 | 4000 | 8000 | A |
| 225 | 0.00 | 80 | 79 | 7 | 73 | 64 | 54 | 45 | 36 | 73 |
| | 0.25 | 78 | 78 | 77 | 72 | 62 | 52 | 42 | 31 | 73 |
| | 0.50 | 76 | 76 | 75 | 71 | 61 | 51 | 40 | 30 | 71 |
| | 0.63 | 75 | 75 | 74 | 69 | 64 | 58 | 53 | 48 | 71 |
| 300 | 0.00 | 100 | 86 | 84 | 81 | 74 | 64 | 55 | 46 | 82 |
| | 0.50 | 98 | 84 | 83 | 80 | 72 | 62 | 52 | 41 | 81 |
| | 0.75 | 96 | 83 | 82 | 79 | 72 | 61 | 51 | 41 | 80 |
| | 1.15 | 96 | 81 | 81 | 78 | 73 | 68 | 64 | 59 | 80 |

TABLE 17C-continued

| Model 17 Outlet Sound Performance | | | | | | | | | | |
|---|---|---|---|---|---|---|---|---|---|---|
| | Nom | OUTLET SOUND POWER BY OCTAVE BANDS dB Lwo | | | | | | | | Lwo |
| RPM | Ps | 63 | 125 | 250 | 500 | 1000 | 2000 | 4000 | 8000 | A |
| 375 | 0.00 | 105 | 91 | 90 | 87 | 82 | 72 | 63 | 54 | 88 |
| | 0.63 | 103 | 90 | 89 | 87 | 81 | 71 | 61 | 50 | 87 |
| | 1.25 | 101 | 87 | 87 | 85 | 80 | 69 | 59 | 49 | 86 |
| | 1.75 | 101 | 86 | 86 | 84 | 79 | 74 | 69 | 63 | 85 |
| 450 | 0.00 | 109 | 95 | 94 | 92 | 88 | 79 | 69 | 60 | 93 |
| | 0.75 | 108 | 94 | 93 | 92 | 87 | 78 | 68 | 58 | 93 |
| | 1.50 | 106 | 92 | 92 | 91 | 86 | 76 | 66 | 56 | 92 |
| | 2.50 | 104 | 90 | 90 | 89 | 84 | 79 | 73 | 68 | 90 |
| 500 | 0.00 | 111 | 97 | 97 | 95 | 91 | 82 | 73 | 64 | 96 |
| | 1.00 | 110 | 96 | 96 | 94 | 90 | 81 | 71 | 61 | 95 |
| | 2.00 | 108 | 94 | 94 | 93 | 89 | 80 | 70 | 60 | 94 |
| | 3.15 | 107 | 93 | 92 | 92 | 87 | 82 | 77 | 73 | 93 |

While only certain features and embodiments of the disclosure have been illustrated and described, many modifications and changes may occur to those skilled in the art, such as variations in sizes, dimensions, structures, shapes and proportions of the various elements, values of parameters, including temperatures, pressures, and so forth, mounting arrangements, use of materials, colors, orientations, and the like, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein a ratio of an axial length of the shroud relative to an outer diameter of the shroud is within a range of approximately 0.16 to approximately 0.30.

2. The inline centrifugal mixed flow fan system of claim 1, comprising a bearing tunnel radially disposed within the outer housing, wherein the bearing tunnel is disposed axially downstream of the wheel assembly.

3. The inline centrifugal mixed flow fan system of claim 2, comprising a plurality of guide vanes directly coupled to and extending radially outward from the bearing tunnel, wherein the plurality of guide vanes are configured to counteract circumferential movement of the air flow and to direct the air flow to a discharge axial end of the outer housing.

4. The inline centrifugal mixed flow fan system of claim 2, comprising:

a drive shaft disposed within the bearing tunnel and configured to cause rotation of the wheel assembly; and one or more bearings disposed within the bearing tunnel and configured to support the drive shaft.

5. The inline centrifugal mixed flow fan system of claim 2, wherein an outer diameter of the bearing tunnel is substantially similar to the outer diameter of the hub cone.

6. The inline centrifugal mixed flow fan system of claim 1, comprising an inlet venturi fixedly coupled to the outer housing at the inlet axial end of the outer housing.

7. The inline centrifugal mixed flow fan system of claim 6, wherein the inlet venturi comprises a plurality of discrete inlet venturi segments disposed adjacent each other axially along the central longitudinal axis.

8. The inline centrifugal mixed flow fan system of claim 6, wherein the shroud comprises a cylindrical lip at an axial end of the shroud adjacent the inlet venturi, wherein the cylindrical lip is configured to radially surround a portion of the inlet venturi.

9. The inline centrifugal mixed flow fan system of claim 6, wherein the hub cone comprises a plurality of discrete hub cone segments disposed adjacent each other axially along the central longitudinal axis.

10. The inline centrifugal mixed flow fan system of claim 1, wherein an angle, in a plane perpendicular to the central longitudinal axis, between a line along the hub cone at an intersection point of the hub cone and a leading edge of a fan blade of the plurality of fan blades relative to a line indicative of a direction of rotation of the hub cone at the intersection point of the hub cone and the leading edge of the fan blade is within a range of approximately 20 degrees to approximately 27 degrees.

11. The inline centrifugal mixed flow fan system of claim 1, wherein an angle, in a plane perpendicular to the central longitudinal axis, between a line along the hub cone at an intersection point of the hub cone and a trailing edge of a fan blade of the plurality of fan blades relative to a line indicative of a direction of rotation of the hub cone at the intersection point of the hub cone and the trailing edge of the fan blade is within a range of approximately 47 degrees to approximately 54 degrees.

12. The inline centrifugal mixed flow fan system of claim 1, wherein an angle, in a plane perpendicular to the central longitudinal axis, between a line along the shroud at an intersection point of the shroud and a leading edge of a fan blade of the plurality of fan blades relative to a line indicative of a direction of rotation of the shroud at the intersection point of the shroud and the leading edge of the fan blade is within a range of approximately 10 degrees to approximately 17 degrees.

13. The inline centrifugal mixed flow fan system of claim 1, wherein an angle, in a plane perpendicular to the central longitudinal axis, between a line along the shroud at an intersection point of the shroud and a trailing edge of a fan blade of the plurality of fan blades relative to a line indicative of a direction of rotation of the shroud at the intersection point of the shroud and the trailing edge of the fan blade is within a range of approximately 11 degrees to approximately 18 degrees.

14. The inline centrifugal mixed flow fan system of claim 1, wherein an angle, relative to a line parallel to the central longitudinal axis, of a leading edge of a fan blade of the plurality of fan blades is within a range of approximately 61 degrees to approximately 69 degrees.

15. The inline centrifugal mixed flow fan system of claim 1, wherein an angle, relative to a line parallel to the central longitudinal axis, of a trailing edge of a fan blade of the plurality of fan blades is within a range of approximately 50 degrees to approximately 58 degrees.

16. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the shroud relative to an outer diameter of the shroud is within a range of approximately 0.16 to approximately 0.30, and wherein an angle, relative to a line parallel to the central longitudinal axis, of a trailing edge of a fan blade of the plurality of fan blades is within a range of approximately 50 degrees to approximately 58 degrees.

17. The inline centrifugal mixed flow fan system of claim 16, wherein an angle, in a plane perpendicular to the central longitudinal axis, between a line along the hub cone at an intersection point of the hub cone and a leading edge of a fan blade of the plurality of fan blades relative to a line indicative of a direction of rotation of the hub cone at the intersection point of the hub cone and the leading edge of the fan blade is within a range of approximately 20 degrees to approximately 27 degrees.

18. The inline centrifugal mixed flow fan system of claim 16, wherein an angle, in a plane perpendicular to the central longitudinal axis, between a line along the hub cone at an intersection point of the hub cone and a trailing edge of a fan blade of the plurality of fan blades relative to a line indicative of a direction of rotation of the hub cone at the intersection point of the hub cone and the trailing edge of the fan blade is within a range of approximately 47 degrees to approximately 54 degrees.

19. The inline centrifugal mixed flow fan system of claim 16, wherein an angle, in a plane perpendicular to the central longitudinal axis, between a line along the shroud at an intersection point of the shroud and a leading edge of a fan blade of the plurality of fan blades relative to a line indicative of a direction of rotation of the shroud at the intersection point of the shroud and the leading edge of the fan blade is within a range of approximately 10 degrees to approximately 17 degrees.

20. The inline centrifugal mixed flow fan system of claim 16, wherein an angle, in a plane perpendicular to the central longitudinal axis, between a line along the shroud at an intersection point of the shroud and a trailing edge of a fan blade of the plurality of fan blades relative to a line indicative of a direction of rotation of the shroud at the intersection point of the shroud and the trailing edge of the fan blade is within a range of approximately 11 degrees to approximately 18 degrees.

21. The inline centrifugal mixed flow fan system of claim 16, wherein an angle, relative to the line parallel to the central longitudinal axis, of a leading edge of a fan blade of the plurality of fan blades is within a range of approximately 61 degrees to approximately 69 degrees.

22. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein an angle, in a plane perpendicular to the central longitudinal axis, between a line along the hub cone at an intersection point of the hub cone and a leading edge of a fan blade of the plurality of fan blades relative to a line indicative of a direction of rotation of the hub cone at the intersection point of the hub cone and the leading edge of the fan blade is within a range of approximately 20 degrees to approximately 27 degrees.

23. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein an angle, in a plane perpendicular to the central longitudinal axis, between a line along the hub cone at an intersection point of the hub cone and a trailing edge of a fan blade of the plurality of fan blades relative to a line indicative of a direction of rotation of the hub cone at the intersection point of the hub cone and the trailing edge of the fan blade is within a range of approximately 47 degrees to approximately 54 degrees.

24. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein an angle, in a plane perpendicular to the central longitudinal axis, between a line along the shroud at an intersection point of the shroud and a leading edge of a fan blade of the plurality of fan blades relative to a line indicative of a direction of rotation of the shroud at the intersection point of the shroud and the leading edge of the fan blade is within a range of approximately 10 degrees to approximately 17 degrees.

25. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein an angle, in a plane perpendicular to the central longitudinal axis, between a line along the shroud at an intersection point of the shroud and a trailing edge of a fan blade of the plurality of fan blades relative to a line indicative of a direction of rotation of the shroud at the intersection point of the shroud and the trailing edge of the fan blade is within a range of approximately 11 degrees to approximately 18 degrees.

26. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein an angle, relative to a line parallel to the central longitudinal axis, of a leading edge of a fan blade of the plurality of fan blades is within a range of approximately 61 degrees to approximately 69 degrees.

27. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the hub cone relative to an outer diameter of the hub cone is within a range of approximately 0.31 to approximately 0.44, and wherein an angle, relative to a line parallel to the central longitudinal axis, of a trailing edge of a fan blade of the plurality of fan blades is within a range of approximately 50 degrees to approximately 58 degrees.

28. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the shroud relative to an outer diameter of the shroud is within a range of approximately 0.16 to approximately 0.30, and wherein an angle, in a plane perpendicular to the central longitudinal axis, between a line along the hub cone at an intersection point of the hub cone and a leading edge of a fan blade of the plurality of fan blades relative to a line indicative of a direction of rotation of the hub cone at the intersection point of the hub cone and the leading edge of the fan blade is within a range of approximately 20 degrees to approximately 27 degrees.

29. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the shroud relative to an outer diameter of the shroud is within a range of approximately 0.16 to approximately 0.30, and wherein an angle, in a plane perpendicular to the central longitudinal axis, between a line along the hub cone at an intersection point of the hub cone and a trailing edge of a fan blade of the plurality of fan blades relative to a line indicative of a direction of rotation of the hub cone at the intersection point of the hub cone and the trailing edge of the fan blade is within a range of approximately 47 degrees to approximately 54 degrees.

30. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the shroud relative to an outer diameter of the shroud is within a range of approximately 0.16 to approximately 0.30, and wherein an angle, in a plane perpendicular to the central longitudinal axis, between a line along the shroud at an intersection point of the shroud and a leading edge of a fan blade of the plurality of fan blades relative to a line indicative of a direction of rotation of the shroud at the intersection point of the shroud and the leading edge of the fan blade is within a range of approximately 10 degrees to approximately 17 degrees.

31. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the shroud relative to an outer diameter of the shroud is within a range of approximately 0.16 to approximately 0.30, and wherein an angle, in a plane perpendicular to the central longitudinal axis, between a line along the shroud at an intersection point of the shroud and a trailing edge of a fan blade of the plurality of fan blades relative to a line indicative of a direction of rotation of the shroud at the intersection point of the shroud and the trailing edge of the fan blade is within a range of approximately 11 degrees to approximately 18 degrees.

32. An inline centrifugal mixed flow fan system, comprising:

a wheel assembly disposed within an outer housing and comprising a hub cone, a plurality of fan blades directly coupled to and extending radially outward from the hub cone, and a shroud directly coupled to and at least partially radially surrounding the plurality of fan blades, wherein the wheel assembly is configured to receive an air flow at an inlet axial end of the outer housing axially upstream of the wheel assembly, and to redirect the air flow axially downstream relative to a central longitudinal axis, circumferentially about the central longitudinal axis, and radially outward from the central longitudinal axis, wherein a ratio of an axial length of the shroud relative to an outer diameter of the shroud is within a range of approximately 0.16 to approximately 0.30, and wherein an angle, relative to a line parallel to the central longitudinal axis, of a leading edge of a fan blade of the plurality of fan blades is within a range of approximately 61 degrees to approximately 69 degrees.

* * * * *